US012564772B2

(12) United States Patent
Bidal et al.

(10) Patent No.: US 12,564,772 B2
(45) Date of Patent: Mar. 3, 2026

(54) RECYCLABLE ARTICLE

(71) Applicant: Acushnet Company, Fairhaven, MA (US)

(72) Inventors: Jean-Marie Bidal, Marlborough, MA (US); Keith M. Duffy, Whitman, MA (US); Robert S. Bento, Raynham, MA (US)

(73) Assignee: Acushnet Company, Fairhaven, MA (US)

( * ) Notice: Subject to any disclaimer, the term of this patent is extended or adjusted under 35 U.S.C. 154(b) by 174 days.

(21) Appl. No.: 18/504,221

(22) Filed: Nov. 8, 2023

(65) Prior Publication Data

US 2024/0350878 A1 Oct. 24, 2024

Related U.S. Application Data

(63) Continuation-in-part of application No. 18/140,723, filed on Apr. 28, 2023, which is a continuation-in-part of application No. 18/136,907, filed on Apr. 20, 2023.

(51) Int. Cl.

| | |
|---|---|
| ***A63B 55/57*** | (2015.01) |
| *A43B 1/00* | (2006.01) |
| *A43B 5/00* | (2022.01) |
| *A63B 55/40* | (2015.01) |

(52) U.S. Cl.

CPC ..... *A63B 55/57* (2015.10); *A43B 1/0063* (2013.01); *A43B 5/001* (2013.01); *A63B 55/40* (2015.10); *A63B 2209/00* (2013.01)

(58) Field of Classification Search

CPC ..... A63B 55/57; A63B 55/40; A63B 2209/00; A63B 55/53; A63B 2209/10; A63B 2210/50; A43B 1/0063; A43B 5/001

USPC ..... 248/96

See application file for complete search history.

(56) References Cited

U.S. PATENT DOCUMENTS

| | | | | | |
|---|---|---|---|---|---|
| 4,311,178 | A * | 1/1982 | Kennedy | A63B 55/40 | 206/315.6 |
| 5,255,781 | A * | 10/1993 | Dulyea, Sr. | A63B 55/40 | 190/110 |
| 5,279,414 | A * | 1/1994 | Brasher | A63B 55/40 | 206/315.6 |
| 5,505,300 | A * | 4/1996 | Joh | A63B 55/40 | 206/315.6 |
| 5,607,128 | A * | 3/1997 | Suk | A63B 55/57 | 206/315.7 |
| 5,799,785 | A * | 9/1998 | Hsu | A63B 55/40 | 206/315.6 |
| 5,829,719 | A * | 11/1998 | Han | A63B 55/53 | 206/315.7 |
| 5,845,773 | A * | 12/1998 | Kim | A63B 55/40 | 206/315.6 |
| 5,860,521 | A * | 1/1999 | Wu | A63B 55/53 | 206/315.7 |
| 5,868,248 | A * | 2/1999 | Joh | A63B 55/40 | 206/315.6 |
| 5,899,328 | A * | 5/1999 | Dulyea, Sr. | A63B 55/40 | 206/315.6 |

(Continued)

*Primary Examiner* — Muhammad Ijaz

(57) ABSTRACT

The present disclosure provides a recyclable article. The recyclable article may comprise a recyclable shoe, recycle apparel, recyclable gear, a recyclable bag, a recyclable club, and/or a recyclable ball. The recyclable article may be processed into one or more source materials that can be used to produce one or more other articles.

19 Claims, 46 Drawing Sheets

(56) References Cited

U.S. PATENT DOCUMENTS 6,007,031 A * 12/1999 Tang ..... A63B 55/60 280/646
6,047,822 A * 4/2000 Batten ..... A63B 55/40 206/315.6
6,145,660 A * 11/2000 Chou ..... A63B 55/40 206/315.6
6,158,582 A * 12/2000 Chang-Lin ..... A63B 55/40 206/315.6
6,202,841 B1 * 3/2001 Kang ..... A63B 55/40 206/315.6
6,209,721 B1 * 4/2001 Sharpe ..... A63B 55/40 206/315.6
6,318,682 B1 * 11/2001 Chen ..... A63B 55/57 211/70.2
6,386,362 B1 * 5/2002 Cheng ..... A63B 55/57 206/315.3
6,698,696 B1 * 3/2004 Yang ..... A63B 55/53 248/97
6,766,905 B1 * 7/2004 Chang ..... A63B 55/53 206/315.6
7,303,070 B1 * 12/2007 Hong ..... A63B 55/30 206/315.6
7,617,931 B2 * 11/2009 Shiao ..... A63B 55/53 206/315.7
8,528,729 B2 9/2013 Juveland et al.
8,663,531 B2 3/2014 De Taeye et al.
8,919,548 B2 * 12/2014 McGuire ..... A63B 55/57 206/315.3
9,545,549 B2 1/2017 Soracco et al.
10,278,462 B2 5/2019 Vandevelde et al.
10,786,715 B2 * 9/2020 Wang ..... A63B 55/40
10,882,590 B2 1/2021 Bladd-Symms et al.
11,363,866 B2 6/2022 De Taeye et al.
11,627,787 B2 4/2023 Bladd-Symms et al.
2003/0168362 A1 * 9/2003 Yoshida ..... A45F 3/08 206/315.7
2005/0072697 A1 * 4/2005 Yang ..... A63B 55/53 206/315.7
2005/0284780 A1 * 12/2005 Jung ..... A63B 55/40 206/315.6
2006/0108243 A1 * 5/2006 Tan ..... A63B 55/00 206/315.6
2006/0157360 A1 * 7/2006 Chan ..... A63B 55/53 206/315.7
2007/0000799 A1 * 1/2007 Ting ..... A63B 55/40 206/315.3
2007/0039794 A1 * 2/2007 Hwang ..... A63B 55/30 280/DIG. 6
2008/0029657 A1 * 2/2008 Evans ..... A63B 55/57 248/96
2008/0164166 A1 * 7/2008 Quartarone ..... A63B 55/53 206/315.7
2008/0169212 A1 * 7/2008 Quartarone ..... A63B 55/53 206/315.7
2008/0217193 A1 * 9/2008 Amin ..... B62B 3/12 220/756
2013/0075290 A1 3/2013 Chang
2013/0213837 A1 * 8/2013 Suk ..... A63B 55/40 206/315.6
2014/0076752 A1 * 3/2014 Hicks ..... A63B 55/00 206/315.6
2014/0360902 A1 * 12/2014 High ..... A63B 55/50 206/315.7
2015/0367208 A1 * 12/2015 Mittiga ..... A63B 55/40 206/315.6
2016/0199708 A1 * 7/2016 Pittman ..... B65G 65/00 414/811
2017/0036079 A1 * 2/2017 Lai ..... A63B 55/40
2018/0036608 A1 * 2/2018 Martell ..... A63B 55/57
2018/0093146 A1 * 4/2018 Bruce ..... A45F 3/14
2018/0280772 A1 * 10/2018 Logan ..... A63B 55/10
2019/0001202 A1 * 1/2019 Martell ..... A63B 55/57
2019/0143192 A1 * 5/2019 Dittemore ..... A63B 1/00 206/315.6
2020/0222770 A1 * 7/2020 Witkoski ..... A63B 55/40
2020/0305526 A1 10/2020 Gantz et al.
2021/0046366 A1 * 2/2021 Klevana ..... A63B 55/40
2021/0060394 A1 * 3/2021 Arsovic ..... A63B 55/40
2021/0077873 A1 * 3/2021 Lai ..... A63B 55/40
2021/0146207 A1 * 5/2021 Burgess ..... A63B 55/50
2021/0252354 A1 * 8/2021 Isgar ..... A63B 55/40
2021/0299528 A1 * 9/2021 Logan ..... A63B 55/30
2021/0308540 A1 * 10/2021 Bom ..... A63B 55/50
2022/0054907 A1 * 2/2022 Martell ..... A63B 55/57
2022/0088447 A1 * 3/2022 Shiao ..... A63B 55/57
2022/0105400 A1 * 4/2022 Burgess ..... A63B 55/53
2022/0111272 A1 * 4/2022 Martell ..... A63B 55/40
2022/0184476 A1 * 6/2022 Zhang ..... A63B 55/40
2022/0226706 A1 * 7/2022 Cheng ..... A63B 55/50
2022/0241658 A1 * 8/2022 Iacono ..... A63B 55/30
2023/0001276 A1 * 1/2023 Browning ..... A63B 55/40
2023/0173353 A1 * 6/2023 Poirier ..... A63B 55/57 206/315.3
2023/0249041 A1 * 8/2023 Burgess ..... A63B 55/57 206/315.7
2024/0042292 A1 * 2/2024 Lai ..... B62B 1/125
2024/0207704 A1 * 6/2024 Zhang ..... A63B 55/57
2024/0335713 A1 * 10/2024 Poirier ..... A63B 55/406
2024/0335714 A1 * 10/2024 Hailong ..... A63B 55/57
2024/0350878 A1 * 10/2024 Bidal ..... A63B 55/57
2024/0359073 A1 * 10/2024 McGuire ..... A63B 55/408

* cited by examiner

Full TPU hotmelt base without perforations – this would be waterproof but non breathable TPU hotmelt base with localized laser perforations – this would be waterproof and breathable Full microporous TPU membrane base
+
Wax paper or silicone patches to preserve the micropores (in specific areas) during heat press Hotmelt layer with die cut apertures or windows layered over the microporous TPU membrane base

RECYCLABLE ARTICLE

CROSS REFERENCE

This application is a Continuation-in-Part of co-pending and co-assigned U.S. patent application Ser. No. 18/140,723 filed on Apr. 28, 2023, which application is a Continuation-in-Part of co-pending and co-assigned U.S. patent application Ser. No. 18/136,907 filed on Apr. 20, 2023, each of which is incorporated herein by reference in its entirety for all purposes.

BACKGROUND

The sport of golf can involve a variety of actions such as swinging a golf club, walking a golf course, and/or crouching down to line up a putt. The equipment or articles used to play golf can affect how well a golfer performs or executes golf-related actions or movements.

Golf shoes, golf apparel, golf bags, golf clubs, and/or golf balls are one or more non-limiting examples of a golf article or a piece of equipment (e.g., golf equipment) that can affect performance. In some cases, the components and materials of a golf article (e.g., a golf shoe, golf apparel, a golf bag, a golf club, or a golf ball) can be selected based on aesthetics and/or performance considerations. In many cases, the components and materials used for conventional golf shoes, golf apparel, golf bags, golf clubs, or golf balls may not be optimized for recyclability, which can make it difficult or challenging to efficiently recycle golf articles such as golf shoes, apparel, bags, clubs, and/or balls.

SUMMARY

Recognized herein are various shortcomings and disadvantages of conventional golf articles such as, for example, golf shoes. When designed properly, golf shoes can provide stability, traction, and comfort on multiple different types of surfaces. However, in order to provide the performance characteristics needed for golf, many conventional golf shoes incorporate materials that are difficult or impossible to recycle. To mitigate the social and environmental impacts associated with non-recyclable materials or compositions, some golf shoes may utilize recyclable materials. In some cases, the inclusion of recyclable materials may require additional structural optimizations to preserve the performance characteristics needed for golf. However, many recyclable golf shoes that are currently available do not implement such structural optimizations, which can negatively impact performance at the expense of recyclability.

The present disclosure addresses the abovementioned shortcomings and disadvantages of conventional golf shoes, which may not be optimally structured or otherwise configured to provide the response characteristics needed for a high performance recyclable golf shoe. In one aspect, the present disclosure provides various examples of high performance recyclable golf shoes. The golf shoes disclosed herein can be recycled efficiently with minimal effort from end users (e.g., consumers who provide used shoes for recycling) or recyclers (e.g., entities that process or recycle shoes to create a source material for producing another article). The high performance golf shoes of the present disclosure may comprise a recyclable assembly that does not compromise or sacrifice performance to achieve or preserve recyclability. The presently disclosed recyclable golf shoes may provide comfort, traction, stability, support, and/or control, all of which may be desirable performance-related characteristics that can improve or enhance a golfer's game. The high performance golf shoes disclosed herein may also be recycled to generate source materials for constructing other recyclable components or articles, thereby minimizing waste and maximizing the utility of the recyclable source materials used to fabricate the shoes of the present disclosure.

The present disclosure further recognizes similar shortcoming and disadvantages of other golf articles such as, for example, golf apparel, golf bags, golf clubs, and/or golf balls that inevitably compromise or sacrifice performance to achieve or preserve recyclability. The present disclosure also addresses these shortcoming and disadvantages by providing various examples of recyclable golf articles that incorporate structural and/or functional optimizations to preserve the performance characteristics needed for golf-related activities, actions, or movements.

In one non-limiting aspect, the present disclosure provides a golf shoe comprising: an upper and a sole assembly connected to the upper. In some embodiments, the upper may comprise: a membrane layer configured to at least partially surround or enclose a foot of a subject wearing the golf shoe; an internal A-shaped frame structure attached or coupled to the membrane layer to structurally support or stiffen the upper; a mesh layer comprising a first side and a second side, the first side attached or coupled to the membrane layer and the internal A-shaped frame structure; and a saddle connected to the second side of the mesh layer. In some embodiments, the upper and the sole assembly may comprise 100% thermoplastic urethane (TPU) by weight or mass. In some embodiments, the membrane layer, the internal A-shaped frame structure, the mesh layer, and the saddle may each comprise one or more TPU materials. In some embodiments, the one or more TPU materials may comprise a material derived from a recycled shoe comprising at least one recyclable TPU material. In some embodiments, the at least one recyclable TPU material may comprise (i) a virgin TPU material or (ii) a pre-recycled or re-grinded TPU material. In some embodiments, the one or more TPU materials may be processable into another golf shoe comprising the at least one recyclable TPU material.

In some embodiments, the internal A-shaped frame structure may be positioned between (i) the membrane layer and (ii) the mesh layer or the saddle. In some embodiments, the mesh layer may be positioned between (i) the saddle and (ii) the internal A-shaped frame structure or the membrane layer. In some embodiments, the mesh layer and the internal A-shaped frame structure may be positioned between (i) the membrane layer and (ii) the saddle.

In some embodiments, the membrane layer and the mesh layer may have a different translucence or opacity. In some embodiments, the membrane layer and/or the mesh layer may be (i) fully transparent, (ii) translucent, or (iii) fully opaque.

In some embodiments, the membrane layer may comprise one or more regions with one or more surface features or perforations to facilitate a movement of a fluid through or across the membrane layer. In some embodiments, the one or more regions may comprise one or more non-laminated regions. In some embodiments, the one or more regions may be decoupled or detached from the mesh layer to enhance breathability. In some embodiments, the membrane layer may be configured as a hotmelt backer for the mesh layer. In some embodiments, the hotmelt backer may comprise one or more non-laminated regions having one or more mechanical or laser perforations. In some embodiments, the membrane layer may comprise a microporous membrane configured as an internal bootie system or assembly.

In some embodiments, the internal A-shaped frame structure may comprise one or more truss-like members. In some embodiments, the one or more truss-like members may extend between (i) a midfoot or rearfoot region of the golf shoe and (ii) a forefoot region of the golf shoe. In some embodiments, the internal A-shaped frame structure may be asymmetric with different frame configurations on a medial and lateral side of the golf shoe.

In some embodiments, the golf shoe may comprise one or more TPU foam ankle pads attached or coupled to the membrane layer. In some embodiments, the golf shoe may comprise an air pocket or an air bladder that supports or cushions an ankle region of a subject's foot.

In some embodiments, the golf shoe may further comprise one or more TPU heel components hot melted to the membrane layer. In some embodiments, the golf shoe may further comprise a TPU toe component hot melted to the first side of the mesh layer. In some embodiments, the golf shoe may further comprise a TPU collar material hot melted to the upper. In some embodiments, the golf shoe may further comprise one or more TPU eyelets hot melted to the upper. In some embodiments, the golf shoe may further comprise one or more TPU laces threaded through the one or more TPU eyelets. In some embodiments, the one or more TPU laces may comprise a plurality of welded layers to control an elasticity or a tensile strength of the laces. In some embodiments, the one or more TPU laces may have a tensile strength ranging from about 1 megapascal (MPa) to about 100 MPa or more.

In some embodiments, the golf shoe may further comprise a first cement or adhesive for the sole assembly. In some embodiments, the first cement or adhesive may comprise a solvent cement, a water based cement, a water based or solvent based primer, or a hotmelt cement. In some embodiments, the golf shoe may further comprise a second cement or adhesive for the upper. In some embodiments, the second cement or adhesive may comprise a solvent cement, a hotmelt cement, a water based cement, or a water based primer. In some embodiments, the first cement or adhesive and the second cement or adhesive may be configured to evaporate during a chemical recycling process that yields said at least one recyclable TPU material from the one or more TPU materials. In some embodiments, the first cement or adhesive and/or the second cement or adhesive may comprise a water-based, a TPU-based, or a PET-based cement or adhesive.

In some embodiments, the golf shoe may further comprise an additional layer of material that is attached or coupled to a bottom portion of the upper to form a Strobel construction. In some embodiments, the golf shoe may further comprise a footbed for supporting a subject's foot. In some embodiments, the footbed may comprise a die cut TPU sheet foam or a molded footbed.

In some embodiments, the golf shoe may further comprise a stability clip that is insertable between the footbed and a midsole portion of the sole assembly to control a movement or a deformation of the midsole portion in response to one or more forces exerted on the golf shoe. In some embodiments, the stability clip may comprise a sidewall and a beam extending laterally from the sidewall. In some embodiments, the beam and the sidewall may form a T-shape. In some embodiments, the beam may comprise a tapered end or a pointed edge.

In some embodiments, the golf shoe may further comprise a removable insole or tag coupled to the upper or a portion thereof. In some embodiments, the removable insole or tag may include recycling instructions for the golf shoe. In some embodiments, the removable insole or tag may comprise a different material than the upper or the sole assembly.

In some embodiments, the upper of the golf shoe may be water-resistant or waterproof. In some embodiments, the sole assembly of the golf shoe may comprise a midsole and an outsole that are co-molded. In some embodiments, the midsole may comprise a variable hardness that changes along a portion of the midsole.

In some embodiments, the golf shoe may comprise one or more support sidewalls extending along a medial side and/or lateral side of the golf shoe. In some embodiments, the one or more support sidewalls may be integrated or associated with the upper of the golf shoe. In some embodiments, the one or more support sidewalls may be integrated or associated with the sole assembly (e.g., the midsole and/or the outsole) of the golf shoe.

In another non-limiting aspect, the present disclosure provides a golf shoe comprising an upper comprising a mesh layer and a sole assembly connected to the upper. In some embodiments, the sole assembly comprises a first plurality of foam layers in a rearfoot region of the golf shoe; a second plurality of foam layers extending between the rearfoot region of the golf shoe and a forefoot region of the golf shoe; and a support positioned adjacent to the second plurality of foam layers. In some embodiments, the support may comprise a plate, an insert, a panel, a sheet (e.g., a die cut sheet), or a layer of material. In some embodiments, the second plurality of foam layers may be positioned between the first plurality of foam layers and the support.

In some embodiments, the mesh layer, the first plurality of foam layers, the second plurality of foam layers, and/or the support each comprise one or more polyethylene terephthalate (PET) materials. In some embodiments, the upper and the sole assembly comprise 100% PET by weight or mass. In some embodiments, the one or more PET materials comprise a material derived from a recycled shoe comprising at least one recyclable PET material. In some embodiments, the one or more PET materials are processable into another golf shoe comprising the at least one recyclable PET material. In some embodiments, the one or more PET materials may comprise a foamed PET material.

In some embodiments, the shoe may comprise one or more mechanical fasteners configured to attach or couple (i) the first plurality of foam layers to (ii) the second plurality of foam layers. In some embodiments, shoe may comprise one or more mechanical fasteners configured to attach or couple (i) the first plurality of foam layers and/or the second plurality of foam layers to (ii) the support.

In some embodiments, the shoe may comprise a water-based cement or primer configured to adhesively couple the first plurality of foam layers to (i) the second plurality of foam layers or (ii) the support. In some embodiments, the shoe may comprise a water-based cement or primer configured to adhesively couple the second plurality of foam layers to (i) the first plurality of foam layers or (ii) the support.

In some embodiments, the shoe may comprise an insole board. In some embodiments, the insole board may comprise a PET material.

In some embodiments, the second plurality of foam layers and/or the support may be coupled to the insole board. In some embodiments, the second plurality of foam layers and/or the support may be mechanically or adhesively coupled to the insole board. In some embodiments, a portion of the mesh layer may be configured to extend between (i) the insole board and (ii) the support or the second plurality of foam layers.

In some embodiments, the shoe may comprise a footbed that is insertable into an enclosed or partially enclosed interior region formed by the upper and the sole assembly. In some embodiments, the footbed comprises a PET or polyester based material.

In some embodiments, the shoe may comprise one or more laces for securing the upper around a subject's foot. In some embodiments, the one or more laces may comprise a recyclable material (e.g., a recyclable PET material).

In some embodiments, the shoe may comprise an insole component that is attachable to the upper to form a Strobel construction. In some embodiments, the insole component comprises an insole board or a non-woven support layer comprising a polyester filament. In some embodiments, the insole component comprises a ply rib geometry.

In some embodiments, the shoe may comprise a PET foam support positioned between the insole component and the sole assembly. In some embodiments, the PET foam support may be positioned between two or more support members or features of the insole components.

In some embodiments, the shoe may comprise a welt construction configured to provide a plurality of attachment points for (i) coupling the upper to a portion of the sole assembly or (ii) coupling a portion of the sole assembly to the upper. In some embodiments, the welt construction may comprise (i) a first section that is curved to accommodate a curvature of the upper and (ii) a second section configured to extend laterally from the first section across a portion of the sole assembly.

In some embodiments, the sole assembly may comprise a cup sole construction. In some embodiments, the cup sole construction may comprise one or more sidewalls extending across or over the lateral and/or medial sides of the upper. In some embodiments, the one or more sidewalls may extend across or over the forefoot, midfoot, and/or rearfoot regions of the upper or the sole assembly.

In another non-limiting aspect, the present disclosure provides various examples and embodiments of a recyclable golf article. In some cases, the recyclable golf article may be recycled to generate source materials for constructing other recyclable components or articles, in order to minimize waste while maximizing the utility of the recyclable source materials used to fabricate the articles of the present disclosure.

In some embodiments, the recyclable golf article may comprise a recyclable golf bag. In some embodiments, the recyclable golf bag may comprise a top cuff or collar forming a top opening, a bottom base, and an internal frame structure extending between the bottom base and the top cuff or collar. In some embodiments, the internal frame structure may comprise a central support extending along a central axis of the golf bag.

In some embodiments, the recyclable golf bag may comprise a recyclable fabric layer surrounding the internal frame structure to form a partially enclosed interior region for storing golf equipment. In some embodiments, the recyclable fabric layer may comprise one or more extended portions configured to extend through the top cuff or collar and detachably secure to one or more other portions of the recyclable fabric layer.

In some embodiments, the recyclable golf bag may comprise a leg assembly formed of a recyclable thermoplastic polyurethane material. In some embodiments, the leg assembly may comprise a first leg and a second leg pivotally attached to the internal frame structure or the top cuff or collar. In some embodiments, the recyclable golf bag may comprise an actuator rod assembly with a first end coupled to the leg assembly and a second end coupled to the bottom base.

In some embodiments, the recyclable golf bag may comprise a plurality of fasteners. In some embodiments, the plurality of fasteners may comprise a plurality of recyclable fasteners. In some embodiments, the plurality of recyclable fasteners may be configured to detachably secure at least two of (i) the top cuff or collar, (ii) the bottom base, (iii) the internal frame structure, (iv) the recyclable fabric layer, (v) the leg assembly, and (vi) the actuator rod assembly to facilitate disassembly or deconstruction of the golf bag for recycling.

In some embodiments, the central support of the internal frame structure comprises a beam, a strut, or a rod extending along the central axis. In some embodiments, the central support of the internal frame structure comprises a support structure with a first side and a second side opposite the first side. In some embodiments, the first side is configured to extend along a spine portion of the golf bag between the bottom base and the top cuff or collar, and the second side is configured to curve inwards towards the first side to form a concave curvature extending between an upper and lower portion of the second side.

In some embodiments, the internal frame structure comprises a plurality of structural supports arranged around the central support. In some embodiments, the plurality of structural supports comprise a T-frame structure. In some embodiments, the T-frame structure comprises a curved outer perimeter, profile, or edge. In some embodiments, the internal frame structure further comprises a lateral support extending along or around a midsection of the internal frame structure. In some embodiments, the lateral support is detachably coupled to the plurality of structural supports.

In some embodiments, the one or more extended portions are configured to extend through the top cuff or collar, fold downwards and inwards into the interior region of the bag, and detachably secure to an inner surface portion of the recyclable fabric layer. In some embodiments, the one or more extended portions are configured to extend through the top cuff or collar from the interior region of the bag, fold outwards and over a bottom edge of the top cuff or collar, and detachably secure to an outer surface portion of the recyclable fabric layer.

In some embodiments, the golf bag may comprise a plurality of recyclable fasteners. In some embodiments, the plurality of recyclable fasteners includes one or more rivets, buttons, snap fasteners, or clips. In some embodiments, the golf bag may comprise a TPU pin system. In some embodiments, the TPU pin system may be configured to detachably couple (i) the recyclable fabric layer and (ii) the top cuff or collar or (iii) the bottom base.

In some embodiments, the golf bag may include a slidable fastener configured to detachably couple (i) the recyclable fabric layer and (ii) the bottom base or (iii) the top cuff or collar. In some embodiments, the slidable fastener may include a flange portion that is couplable to (i) the top cuff or collar or (ii) the recyclable fabric layer. In some embodiments, the flange portion comprises one or more openings configured to receive or engage with another fastener to facilitate a coupling between the flange portion of the slidable fastener and the top cuff or collar of the golf bag. In some embodiments, the flange portion is bonded, laminated, hot melted, fused, or welded to the recyclable fabric layer to form a waterproof seal.

In some embodiments, the first leg and/or the second leg may comprise a plurality of traction elements extending from a distal end of the first and/or second leg. In some embodiments, the plurality of traction elements includes one or more directional traction elements and/or one or more omni-directional traction elements.

In some embodiments, the first leg and/or the second leg comprises a hollow tubular construction to enhance a structural stiffness or rigidity of the first and/or second leg. In some embodiments, the first leg and/or the second leg comprises one or more flanges or ridges extending along a length of the first or second leg to enhance a structural stiffness or rigidity of the first and/or second leg.

In some embodiments, a width or a thickness of the first leg or the second leg increases from a proximal end of the first or second leg to a midpoint on the first or second leg. In some embodiments, the width or the thickness of the first or second leg decreases from the midpoint on the first or second leg to a distal end of the first or second leg.

In some embodiments, the top cuff or collar of the golf bag may comprise a heavy duty structure. In some embodiments, the heavy duty structure may comprise a U-frame structure with opposing sidewalls and one or more struts or substructures extending between the opposing sidewalls.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

Non-limiting and non-exhaustive examples and embodiments of the present disclosure are described with reference to the following figures.

DETAILED DESCRIPTION

Figure 1:
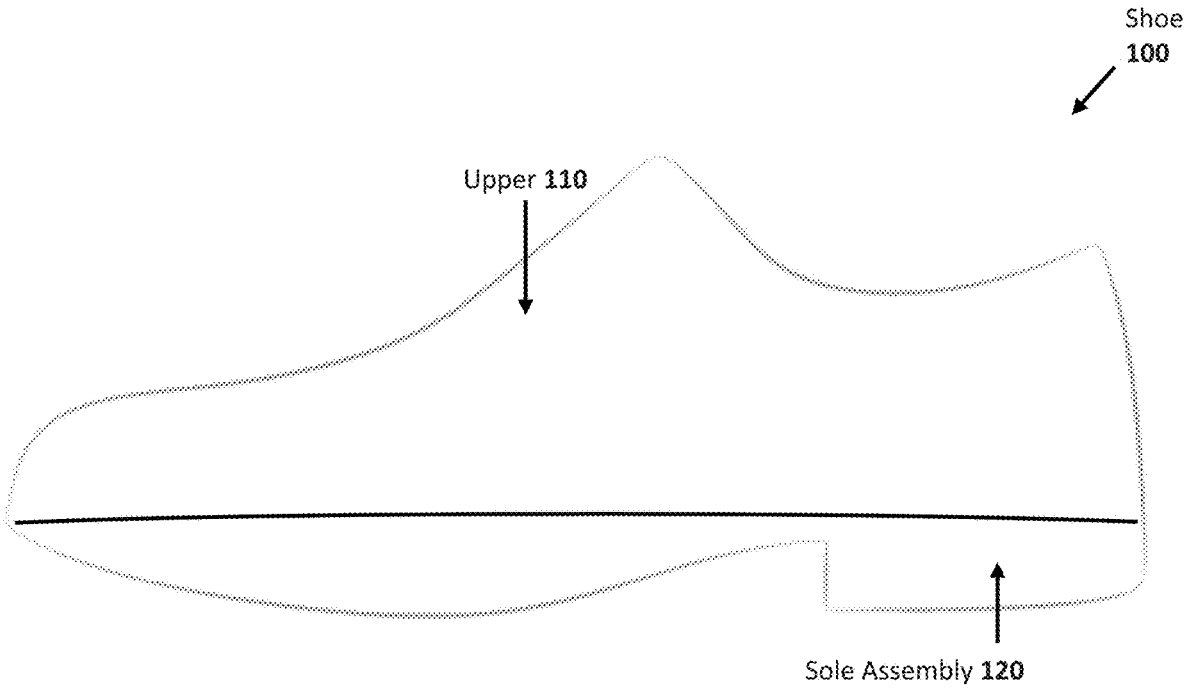
FIG. 1 schematically illustrates an exemplary golf shoe, in accordance with some embodiments.

The present disclosure will now be described more fully in reference to the accompanying figures, which show various non-limiting embodiments. In some cases, the views shown in the figures are of a right shoe and/or a left shoe, and it is understood that in these cases, the components for a left shoe can be mirror images of the right shoe, and vice versa. It shall also be understood that in certain instances where a shoe is depicted, the shoe may be made in various sizes and thus the size and/or shape of the components or features of the shoe may be adjusted depending on the shoe size.

The terminology used herein is for the purpose of describing various embodiments only and is not intended to be limiting. As used herein, the singular forms "a," "an," and "the" are intended to include the plural forms as well, unless the context clearly indicates otherwise.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present technology.

It shall be understood that when an element is referred to as being "attached," "coupled" or "connected" to another element, it can be directly attached, coupled or connected to the other element (with or without any intervening elements). In contrast, when an element is referred to as being "directly attached," directly coupled" or "directly connected" to another element, there may not or need not be any intervening elements present.

It is noted that any one or more aspects or features described with respect to one or more exemplary embodiments may be incorporated in various other different embodiments. That is, embodiments and/or features of any embodiments can be combined in any way and/or in any order with any other embodiments and/or any other features thereof, without limitation. Applicant reserves the right to modify any originally filed claim or file any new claim(s) accordingly, including the right to amend any originally filed claim to depend from and/or incorporate any feature of any other claim. Various non-limiting aspects and embodiments of the present disclosure are provided in further detail in the specification set forth below.

Overview

The present disclosure provides various non-limiting examples and embodiments of recyclable golf articles including recyclable golf shoes, recyclable golf apparel, recyclable golf gear, recyclable golf clubs, and recyclable golf balls. The recyclable golf articles (e.g., golf shoes, apparel, gear, clubs, and/or balls) described herein may be constructed to enhance recyclability without compromising structural integrity or performance. In some embodiments, the recyclable golf shoes of the present disclosure may comprise high performance golf shoes configured to provide the fit, comfort, temperature control, moisture control, weather resistance, traction, stability, support, and/or control characteristics desired and valued by dedicated and aspiring golfers. In some embodiments, the recyclable apparel referenced herein may comprise high performance golf apparel configured to provide the fit, comfort, temperature control, moisture control, and/or weather resistance characteristics that allow a subject wearing the apparel to play golf comfortably in various different environments and environmental conditions. In some embodiments, the recyclable golf gear (e.g., golf bags) disclosed herein may comprise structurally stable, durable, and weatherproof constructions that can reliably house or store golf equipment as a subject traverses through different environments with different types of terrain and/or different climates or weather conditions. In some embodiments, the recyclable golf clubs and golf balls referenced herein may comprise high performance golf clubs and balls with optimized structures and material properties (e.g., weight distribution, moment of inertia, coefficient of restitution, etc.) to enhance golfers' shot making or shot shaping abilities. In some cases, the presently disclosed recyclable golf articles (including, for example, recyclable golf shoes, apparel, gear, clubs, and/or balls) may be recycled easily and efficiently without requiring disassembly into separate components or subassemblies. In other cases, the recyclable golf articles described and referenced herein may be easily and rapidly disassembled with minimal effort so that different components of the articles can be recycled individually or separately.

Recyclable Material

In some embodiments, the recyclable golf articles (e.g., golf shoes, apparel, gear, clubs, and/or balls) of the present disclosure may comprise a recyclable material. In some cases, the recyclable material may comprise a material that can be processed (e.g., recycled) into a source material. The source material may comprise a recycled material derived from the recyclable material. The source material may itself be a recyclable material that can be processed into another source material that is both recycled and recyclable. In some cases, the source material may be used to form another article (e.g., another golf shoe or other golf-related equipment or apparel) and/or a component for another article.

In some embodiments, the recyclable material may comprise a material derived from a recycled article. In some cases, the recycled article may include an article (e.g., a shoe, apparel, gear, a club, and/or a ball) that was previously worn, used, and/or recycled. The recycled article may or may not be derived from other recycled articles. In some cases, the recycled article may be processable (e.g., recyclable) into the recyclable material used to form the recyclable golf articles (e.g., golf shoes, apparel, gear, clubs, and/or balls) of the present disclosure.

In some embodiments, the recyclable material may comprise a recycled material derived from a recycled shoe, apparel, gear, clubs, or ball comprising at least one recyclable material. In some cases, the recycled shoe, apparel, gear, club, or ball may include a shoe, apparel, gear, club, or ball that was previously worn or used. In other cases, the recycled shoe, apparel, gear, club, or ball may include a new shoe, apparel, gear, club, or ball that was not previously worn or used but recycled in order to harvest a source material for constructing the presently disclosed recyclable articles (e.g., recyclable golf shoes, apparel, gear, clubs, and/or balls). In some embodiments, the recyclable material harvested from the recycled shoe, apparel, gear, club, or ball may be processable into another article or component comprising a recyclable material.

In some cases, the recyclable articles disclosed herein may include a first recyclable article that can be recycled into a source material for constructing another recyclable article (e.g., a second recyclable article). In some cases, the first recyclable article may be a same article or a same type of article as the second recyclable article. In other cases, the first and second recyclable articles may be different articles or different types of articles.

In some cases, the recyclable articles disclosed herein may include a first recyclable article with one or more components that can be recycled for use in another recyclable article (e.g., a second recyclable article). In some cases, the one or more components may be integrated into the second recyclable article without any further processing or pre-processing. In some cases, the first recyclable article may be a same article or type of article as the second recyclable article. In other cases, the first and second recyclable articles may be different articles or different types of articles.

In some embodiments, the at least one recyclable material may comprise one or more virgin materials. The one or more virgin materials may not or need not be derived from a previously used or worn article. In other embodiments, the recyclable material may comprise a pre-recycled material and/or a re-grinded material derived from a recycled article or component which may or may not have been previously used or worn. In some cases, the pre-recycled material and/or the re-grinded material may include a first amount of virgin plastic and a second amount of recycled content. In some cases, the first amount and the second amount may be equal or approximately equal. In other cases, the first amount and the second amount may be different. In some cases, the ratio of virgin plastic material to recycled content (by weight, mass, or volume) may be about 90:10, 80:20, 70:30, 60:40, 50:50, 40:60, 30:70, 20:80, or 10:90. In some cases, the recyclable material may comprise 100% re-grinded and/or pre-recycled content (i.e., the recyclable material may not comprise any virgin materials). In other cases, the recyclable material may not or need not include any pre-recycled and/or re-grinded material (i.e., the recyclable material may entirely comprise virgin materials).

In some embodiments, the recyclable articles of the present disclosure may comprise a recyclable shoe. The recyclable shoe may comprise an upper and/or a sole assembly. In some embodiments, the upper and/or the sole assembly may comprise a recyclable material. In some cases, the upper and/or the sole assembly may comprise a thermoplastic urethane (TPU) material. The TPU material may be recyclable, with or without further processing. In some cases, the upper and/or the sole assembly may comprise 100% TPU by weight or mass. In some embodiments, the recyclable golf shoe may comprise a membrane layer, a frame structure, a mesh layer, and/or a saddle (described in greater detail below). In some cases, the membrane layer, the frame structure, the mesh layer, and/or the saddle of the recyclable golf shoe may comprise one or more recyclable TPU materials.

In some embodiments, the recyclable articles of the present disclosure may comprise recyclable apparel, recyclable gear (e.g., a recyclable golf bag), a recyclable club, or a recyclable ball. In some embodiments, the recyclable apparel, gear, club, or ball may comprise a recyclable material. In some cases, the recyclable material may comprise a thermoplastic (poly) urethane (TPU) material. In some cases, the TPU material may be recyclable, either with or without any further processing or pre-processing. In some cases, the recyclable article may comprise 100% TPU by weight or mass.

In some embodiments, the recyclable material may comprise a polymeric material. In some cases, the polymeric material may comprise a urethane material. In some cases, the polymeric material may comprise a polyurethane material. In some cases, the polymeric material may comprise a thermoplastic polyurethane (TPU) material.

In some embodiments, the recyclable golf shoe, apparel, gear, club, or ball may comprise one or more TPU parts. In some cases, the one or more TPU parts may include, for example, injected TPU parts, molded TPU parts, extruded TPU parts, machined TPU parts, and/or 3D printed TPU parts.

In some embodiments, the recyclable articles of the present disclosure may comprise a recyclable shoe. The recyclable shoe may comprise an upper and/or a sole assembly. In some embodiments, the upper and/or the sole assembly may comprise a recyclable material. In some cases, the upper and/or the sole assembly may comprise a polyethylene terephthalate (PET) material. The PET material may be recyclable, with or without further processing. In some cases, the upper and/or the sole assembly may comprise 100% PET by weight or mass. In some embodiments, the recyclable golf shoe may comprise a mesh layer, one or more foam layers, and/or a moderator plate (described in greater detail below). In some cases, the mesh layer, the one or more foam layers, and/or the moderator plate of the recyclable golf shoe may comprise one or more recyclable PET materials.

In some embodiments, the recyclable articles of the present disclosure may comprise recyclable apparel, recyclable gear, a recyclable club, or a recyclable ball. In some embodiments, the recyclable apparel, gear, club, or ball may comprise a recyclable material. In some cases, the recyclable material may comprise a polyethylene terephthalate (PET) material. In some cases, the PET material may be recyclable, with or without further processing or pre-processing. In some cases, the recyclable apparel, gear, club, or ball may comprise 100% PET by weight or mass.

In some embodiments, the recyclable material may comprise a polymeric material. In some cases, the polymeric material may comprise a thermoplastic polymer material. In some cases, the polymeric material may comprise a polyester material. In some cases, the polymeric material may comprise a polyethylene terephthalate (PET) material.

In some embodiments, the recyclable golf shoe, apparel, gear, club, or ball may comprise one or more PET parts. In some cases, the one or more PET parts may include, for example, injected PET parts, molded PET parts, extruded PET parts, machined PET parts, and/or 3D printed PET parts.

In some embodiments, the various components, parts, sections, and/or layers of the recyclable shoe, apparel, gear, club, or ball may comprise one or more recyclable materials. In some cases, the one or more recyclable materials may comprise a same recyclable material. In other cases, the one or more recyclable materials may comprise a plurality or combination of different recyclable materials. In some cases, the plurality of different recyclable material may include two or more recyclable materials selected from a same class of materials. In some cases, the plurality of different recyclable material may include two or more recyclable materials selected from different classes of materials. In some cases, the two or more recyclable materials may have a same or similar set of material properties (e.g., hardness, stiffness, rigidity, tensile strength, etc.). In other cases, the two or more recyclable materials may have a different set of material properties.

In some embodiments, the recyclable articles (e.g., recyclable shoes, apparel, gear, clubs, and/or balls) of the present disclosure may comprise a plurality of components, parts, sections, and/or layers formed from the one or more recyclable materials. The one or more recyclable materials may be recycled using one or more recycling processes or procedures. In some cases, the plurality of components, parts, sections, and/or layers may be recyclable concurrently or simultaneously (e.g., in a same recycling process or procedure). In other cases, the plurality of components, parts, sections, and/or layers may be recyclable using a plurality of different recycling processes or procedures.

In some embodiments, the one or more recyclable materials may comprise a rigid or semi-rigid material. In some embodiments, the one or more recyclable materials may comprise a deformable or elastic material. In some embodiments, the one or more recyclable materials may be configured to bend or flex in response to a force exerted on the shoe, apparel, gear, club, or ball during a golf-related movement or action. In some embodiments, the one or more recyclable materials may be configured to resist bending or flexing in response to forces exerted on the shoe, apparel, gear, club, or ball during a golf-related action or movement.

In some embodiments, the one or more recyclable materials may comprise a selectively permeable material. In some cases, the selectively permeable material may be configured to permit a passage of fluids or vapors from the inside of the recyclable article (e.g., a recyclable shoe or a recyclable apparel piece) to an environment external to the recyclable shoe or the recyclable piece of apparel. In some cases, the selectively permeable material may be configured to control, restrict, or regulate a passage of fluids or vapors from an environment external to the recyclable article (e.g., a recyclable shoe, a recyclable piece of apparel, or a recyclable gear/equipment) to an inside portion or region of the recyclable shoe, the recyclable piece of apparel, or the recyclable gear/equipment.

In some cases, one or more components, parts, sections, and/or layers of the recyclable article (e.g., the recyclable shoe, the recyclable piece of apparel, the recyclable gear, etc.) may be water-resistant or waterproof. In some cases, the components, parts, sections, and/or layers of the recyclable article (e.g., the recyclable shoe or the recyclable piece of apparel) may be configured as breathable components. In some cases, the recyclable article (e.g., the recyclable shoe or the recyclable piece of apparel) may comprise one or more pieces, layers, or panels configured to allow a selective movement of moisture, vapor, and/or perspiration across or through the pieces, layers, or panels to regulate temperature and/or humidity without sacrificing or compromising water-resistance or water-proofness.

In some embodiments, the components, parts, sections, and/or layers of the recyclable article (e.g., recyclable shoe, apparel, gear, club, or ball) may have a uniform or substantially uniform set of material properties. In other embodiments, the components, parts, sections, and/or layers of the recyclable article (e.g., the recyclable shoe, apparel, gear, club, or ball) may have a plurality of regions with different material properties. In some embodiments, the different material properties may include, for example, a hardness, a softness, a stiffness (e.g., flexural stiffness or torsional stiffness), a rigidity, a tensile strength, or any of the other material properties described herein. In some embodiments, a hardness, stiffness, rigidity, or tensile strength of the components, parts, sections, and/or layers may gradually change or vary across different regions or sections of the recyclable article (e.g., the recyclable shoe, apparel, gear, club, ball, etc.).

Shoe Structures

In an aspect, the present disclosure provides a golf shoe. The golf shoe may comprise an article of footwear (e.g., a shoe) that can be worn by a subject to aid in a physical activity such as golf, or any other physical activity involving one or more actions or movements that can be used in the sport of golf.

In some cases, the golf shoe may comprise a high performance golf shoe. The high performance golf shoe may provide an optimal combination of support, control, stability, and flex characteristics. In some cases, the high performance golf shoe may be configured to provide a comfortable and stable support platform for golf-related actions or movements while retaining a desired stiffness and/or flex characteristic.

In some cases, the golf shoe may comprise a recyclable golf shoe. The recyclable golf shoe may be processed or recycled to yield a source material that is usable to form another article (e.g., another golf shoe, an article of apparel, golf-related equipment, etc.). The source material may comprise a recyclable material that can be processed or recycled one or more times to form additional articles that may also be recyclable.

The golf shoe may be worn by a subject. The subject may be, for example, an athlete or a golf player. When worn by the subject, the golf shoe may provide an optimal balance of comfort and control that allows the subject to focus on his or her game and maximize performance. The golf shoe may be sized, shaped, and configured to support the subject's foot and/or control a movement of the subject's foot during a golf-related movement to enhance (i) comfort, (ii) stability, and/or (iii) the subject's posture, stance, swing, stability, or overall performance (e.g., accuracy or precision).

FIG. 1 depicts an exemplary golf shoe 100, also referred to herein as a shoe. In some embodiments, the shoe 100 may comprise a shoe upper 110 and a sole assembly 120. In some cases, the upper 110 may include an insole. The insole may comprise an insole component such as an insole footbed and/or an insole board. In some cases, the sole assembly 120 may include a midsole and/or an outsole. In some embodiments, the sole assembly may be connected or attached to the upper. In some embodiments, a footbed may be positioned above an insole board of the shoe. In some embodiments, the insole board may be positioned between the footbed and the midsole of the shoe.

Upper

In some embodiments, the golf shoe 100 may comprise an upper 110. In some cases, the upper 110 may comprise a vamp for covering at least a forefoot region of a subject's foot. In some cases, the upper 110 may comprise a quarter for covering and/or supporting one or more side or rear portions of a subject's foot (e.g., the area adjacent to, surrounding, and/or below the Achilles tendon, the posterior of the heel, and/or the talus and calcaneus bones).

In some embodiments, the heel region of the shoe may comprise a heel cup. In some cases, the heel cup may comprise a molded heel cup. In some embodiments, at least a portion of the quarter may form a part of the molded heel cup. In some embodiments, the quarter may comprise a plurality of layers that can be molded together to form the heel cup.

In some embodiments, the heel region of the shoe may comprise a heel counter. In some cases, the heel counter may be an external heel counter. In other cases, the heel counter may be an internal heel counter.

In some embodiments, the vamp and the quarter may comprise separate pieces of material that are connected or fused to each other mechanically, chemically, thermally, or adhesively. In some cases, the upper material may comprise various materials that are stitched or bonded together to form the upper structure.

In some embodiments, the upper 110 may comprise a continuous piece of material for the vamp and quarter. In some cases, the continuous piece of material may comprise a single material comprising a plurality of regions each having different material properties. In other cases, the continuous piece of material may comprise a plurality of materials having different material properties. The material properties associated with the plurality of regions or the plurality of materials may include, for example, density, porosity, water absorbency/repellence, strength, flexibility, elasticity, softness, durability, chemical resistance, thermal conductivity, and the like. In some cases, the upper 110 may comprise, for example, one or more natural or synthetic materials that can be recycled or processed to produce a source material comprising at least one recycled or recyclable material. In some cases, the upper 110 may comprise a breathable mesh and/or synthetic textile fabrics made from materials such as nylons, polyesters, polyolefins, polyurethanes, rubbers, foams, or any of the recyclable materials described herein. The material of the upper 110 may be selected and/or optimized based on desired properties such as breathability, durability, flexibility, comfort, and/or water resistance.

In some embodiments, the shoe 100 may be waterproof. In some cases, at least a forefoot, midfoot, and/or rearfoot area of the upper may be constructed of one or more materials or layers (e.g., membranes) having water resistant or water repellent properties. Additional features (e.g., non-porous or semi-porous membranes that permit a selective movement or passage of moisture) may be applied when fabricating the shoe 100 to provide additional waterproofing capabilities.

In some embodiments, the upper 110 may comprise an instep region with an opening for receiving a subject's foot. In some cases, the instep region may include a tongue member. In some embodiments, the upper 110 may comprise a heel collar extending around at least a portion of the opening. The heel collar may be configured to enhance comfort and fit.

In some embodiments, the upper 110 may comprise an insole component (e.g., an insole footbed or an insole board). In some cases, the insole component may be designed to provide support for a subject's foot (e.g., as the subject exerts a force on the insole while walking, running, kneeling, squatting, or executing a swing). The insole component may be flexible, semi-rigid, or rigid. In some cases, the insole component may be a removable insert that can be positioned within the shoe 100. In some cases, the insole component can be worn inside the shoe 100 and may be designed to provide cushioning or support for the subject wearing the shoe 100.

In some embodiments, the forefoot region of the upper 110 may comprise an eye stay that can be attached to the vamp. In some cases, the eye stay may cover at least a portion of the tongue member. In some cases, the eye stay may comprise one or more eyelets through which one or more tightening devices or mechanisms can be threaded.

In any of the embodiments described herein, a variety of tightening systems or mechanisms can be used to secure the shoe 100 around the contour of the foot. In some cases, laces of various types of materials (e.g., natural or synthetic fibers, metal cables, recyclable materials, etc.) may be used to tighten the shoe and/or to secure the shoe in a desired position and/or orientation relative to the subject's foot. In some cases, the shoe 100 may include a cable-based tightening assembly comprising a dial, a spool, a housing, and a locking mechanism for locking the cable in place.

Sole Assembly

In some embodiments, the golf shoe 100 may comprise a sole assembly 120. The sole assembly 120 may comprise a midsole and/or an outsole. In some embodiments, the sole assembly 120 may be connected to the upper 110. In some cases, a portion of the upper 110 may be heated or melted and then fused with the sole assembly 120.

In some embodiments, the sole assembly 120 may comprise a midsole. In some cases, the midsole may comprise a relatively lightweight material configured to provide cushioning and/or support to the shoe 100.

In some embodiments, the midsole may be made from one or more midsole materials. The one or more midsole material may comprise a recyclable material as described elsewhere herein. In some cases, the one or more midsole materials may comprise a foam material. In some case, the foam material may comprise a material with a foam or foam-like structure. In some cases, the foam material may comprise an open cell foam comprising one or more open or partially open cells. In other cases, the foam material may comprise a closed cell foam comprising one or more closed or partially closed cells. In some non-limiting embodiments, the foam material may comprise an elastic foam. In other non-limiting embodiments, the foam material may comprise a viscous foam. In some alternate embodiments, the foam material may comprise a viscoelastic foam. The viscoelastic foam may have the elastic properties of an elastic foam and/or the viscous properties of a viscous foam. In some cases, the viscoelastic foam may comprise a memory foam or a memory foam-like material. In any of the embodiments described herein, the midsole may comprise one or more recyclable foam materials. The one or more recyclable foam materials may include, for example, a polyurethane foam composition or a polyethylene foam composition.

In some embodiments, the midsole or outsole may comprise one or more support sidewalls. In some cases, the one or more support sidewalls may be configured to extend along a medial side and/or a lateral side of the golf shoe. In some cases, the one or more support sidewalls may extend across or over the upper of the golf shoe. In some cases, the support sidewalls may comprise a recyclable material (e.g., a recyclable TPU or PET material as described elsewhere herein).

In some non-limiting embodiments, the midsole or outsole may have one or more material properties that vary along a dimension of the midsole or outsole. In some embodiments, the one or more material properties may include, for example, a hardness, a softness, a stiffness (e.g., flexural stiffness or torsional stiffness), a rigidity, or a tensile strength of the midsole or outsole material. In some embodiments, the midsole or outsole may have a variable hardness, softness, stiffness, rigidity, or tensile strength to provide different material properties and/or performance characteristics to different regions of the shoe.

In some embodiments, the sole assembly 120 may comprise an outsole. The outsole may be configured to provide support and traction for the shoe. In some embodiments, the outsole may be integrated with the midsole. For example, the midsole may be fused with the outsole, co-molded with the outsole, or otherwise attached to outsole (e.g., using an adhesive or as part of a manufacturing process for the midsole and/or the outsole). In some cases, the midsole can be molded as a separate piece and then joined to a top surface of the outsole using stitches, adhesives, or other suitable means. In some cases, the midsole can be heat-pressed and bonded to the top surface of the outsole. In some cases, the midsole and the outsole can be molded using a single shot or multi-shot molding method. In any of the embodiments described herein, the midsole may be positioned above the outsole such that at least a portion of the midsole is between a subject's foot and the outsole.

In some embodiments, the outsole may comprise an outsole material. In some cases, at least a portion of the outsole material may be configured to grip or otherwise engage a ground surface underneath the shoe (e.g., during a golf-related action or movement). In some embodiments, the outsole material may comprise a recyclable material. In some embodiments, the outsole material may include, for example, thermoplastics such as nylons, polyesters, polyethers, polyolefins, and/or polyurethanes. In some non-limiting embodiments, the outsole material may include polyurethane compositions such as, for example, Estane® TRX thermoplastic polyurethanes. In some embodiments, the outsole material may include a rubber material or a thermoplastic rubber material, such as polybutadiene, polyisoprene, ethylene-propylene rubber ("EPR"), ethylene-propylene-diene ("EPDM") rubber, and/or styrene-butadiene rubber. In some embodiments, the outsole material may comprise a plastic material, a thermoplastic material, a thermoset plastic material, or any combination thereof. In some non-limiting embodiments, the outsole material may comprise acrylic, polymethyl methacrylate (PMMA), polycarbonate (PC), polyethylene (PE), polypropylene (PP), polyethylene terephthalate (PET), polyvinyl chloride (PVC), or acrylonitrile-butadiene-styrene (ABS).

In some embodiments, a bottom surface of the outsole may include a plurality of traction members. The plurality of traction members may be configured to provide traction between the shoe 100 and the different surfaces of a golf course/range or other ground surfaces near a course/range. In some embodiments, the traction members may comprise a recyclable material. In some embodiments, the recyclable material may comprise thermoplastics such as nylons, polyesters, polyolefins, and/or polyurethanes. In some embodiments, the traction members may comprise thermoplastic polyurethane (TPU) or polyethylene terephthalate (PET). In some embodiments, the traction members may comprise one or more rubber materials and/or one or more plastic materials. In other embodiments, the traction members may comprise different polyamide compositions including, for example, polyamide copolymers and/or aramids. In some alternative embodiments, the traction members may comprise an elastomer formed from one or more block copolymers made of rigid polyamide blocks and/or soft polyether blocks.

In some embodiments, the plurality of traction members may comprise one or more spikes (e.g., hard spikes or soft spikes). In some cases, the one or more spikes may comprise a protrusion that is configured to at least partially penetrate or otherwise physically interface with or contact a ground surface. The one or more spikes may or may not be removable or detachable.

In some embodiments, the plurality of traction members may not or need not comprise any spikes. For example, the traction members may comprise a grooved or textured surface or material that is configured to reduce a lateral or translational movement of the shoe relative to a ground surface when a force is exerted on the sole assembly of the shoe. In some cases, the grooved or textured surface may have a higher coefficient of friction (static and/or dynamic frictional coefficient) than other portions of the outsole. In some embodiments, at least one of the plurality of traction members may be removable or detachable from the outsole. In other embodiments, at least one of the plurality of traction members may be permanently attached or coupled to the outsole or another portion of the sole assembly. In some alternative embodiments, the outsole may not or need not comprise any traction elements.

Foot Subregions

In any of the embodiments described herein, the upper, the sole assembly, and/or any components thereof (e.g., the insole footbed, the insole board, the midsole, and/or the outsole) may comprise a forefoot region, a midfoot region, and a rearfoot region. Each of the forefoot region, the midfoot region, and the rearfoot region may correspond to a respective forefoot, midfoot, and rearfoot anatomy of a subject's foot. In general, the anatomy of a human foot can be divided into three bony regions. The rearfoot region of the foot may include the ankle (talus) and heel (calcaneus) bones. The midfoot region of the foot may include the cuboid, cuneiform, and navicular bones that form the longitudinal arch of the foot. The forefoot region of the foot may include the metatarsals and the toes. The shoe, and accordingly, the components of the upper and/or the sole assembly, may comprise a rearfoot region corresponding to the rearfoot and/or heel area, a midfoot region that corresponds to the midfoot, and a forefoot region corresponding to the forefoot and/or toe area.

In some cases, the rearfoot region (including the heel area) can correspond to a posterior end of the shoe. In some cases, the forefoot area (including the toe area) can correspond to an anterior end of the shoe. In some cases, the midfoot area can correspond to a portion of the shoe that is between the anterior end and the posterior end of the shoe.

In addition to having a rearfoot region, a midfoot region, and a forefoot region, the recyclable high performance golf shoes described herein may have a medial side and a lateral side that are opposite one another. The medial side may generally correspond to an inside area of the wearer's foot and a surface that faces towards the wearer's other foot. The lateral side may generally correspond to an outside area of the wearer's foot and a surface that faces away from the wearer's other foot. The lateral side and the medial side may extend along each of the rearfoot area, the midfoot area, and the forefoot area. In some cases, the medial side and the lateral side may extend around the periphery or perimeter of the shoe.

Figure 2A:
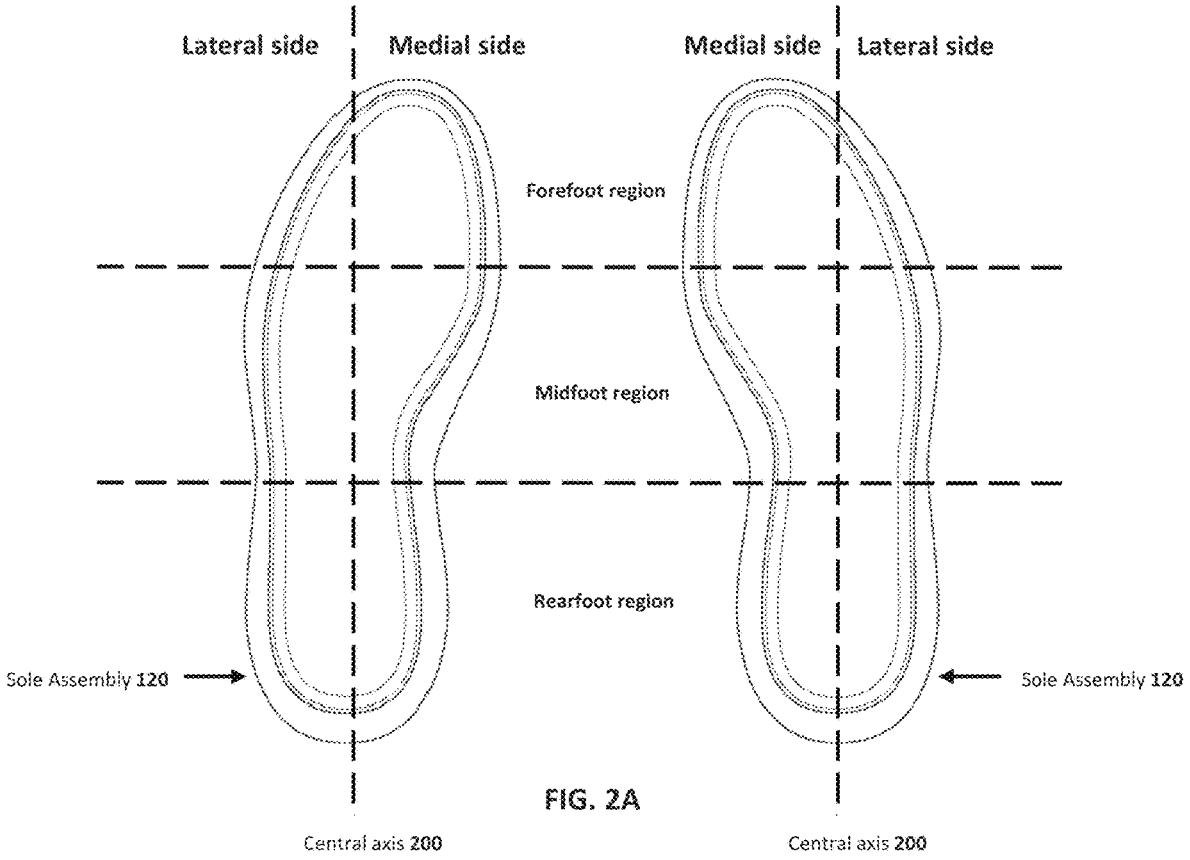
FIG. 2A schematically illustrates an exemplary golf shoe comprising a forefoot region, a midfoot region, and a rearfoot region, in accordance with some embodiments.

FIG. 2A illustrates the various regions of an exemplary left and right sole assembly 120. The sole assembly 120 may comprise a forefoot region, a midfoot region, and/or a rearfoot region. The forefoot, midfoot, and rearfoot regions may extend laterally along a first dimension (e.g., a width)

of the sole assembly 120. The forefoot, midfoot, and rearfoot regions may extend laterally between a medial side and a lateral side of the sole assembly, as described above. The forefoot, midfoot, and rearfoot regions may extend laterally along different portions or sections of a second dimension (e.g., a length) of the sole assembly 120. The forefoot, midfoot, and rearfoot regions may extend between a posterior end and an anterior end of the sole assembly 120, as described above.

Figure 2B:
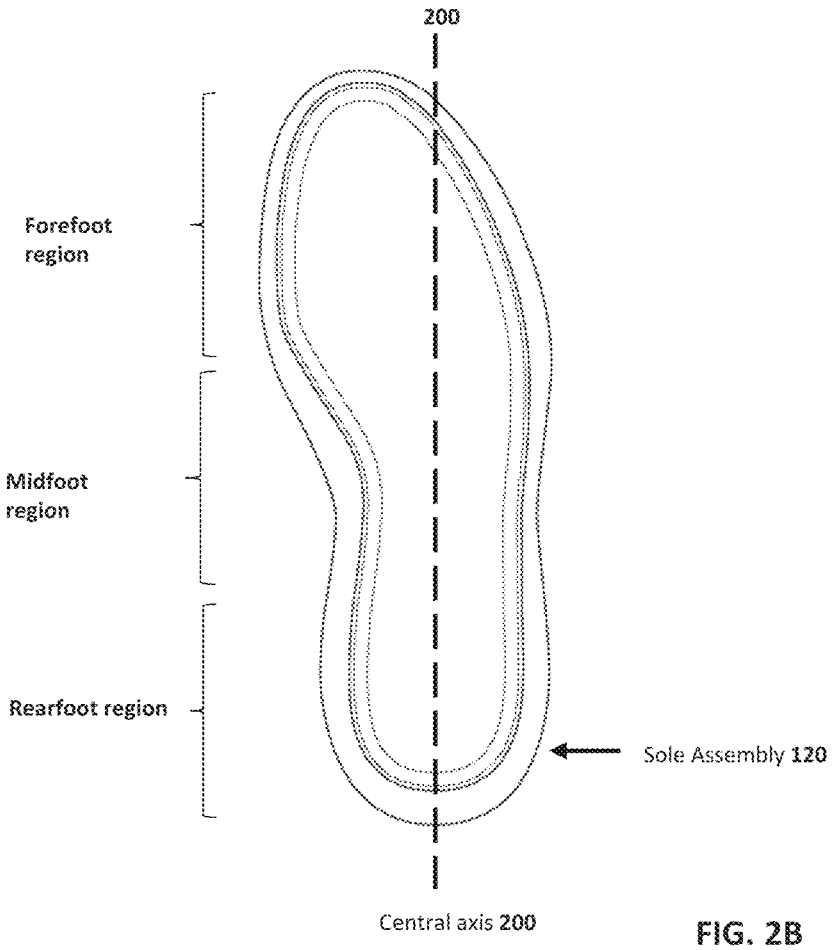
FIGS. 2B and 2C schematically illustrate a central axis extending through the forefoot, midfoot, and/or rearfoot regions of an exemplary golf shoe to divide the golf shoe into a medial side and a lateral side, in accordance with some embodiments.
Figure 2C:
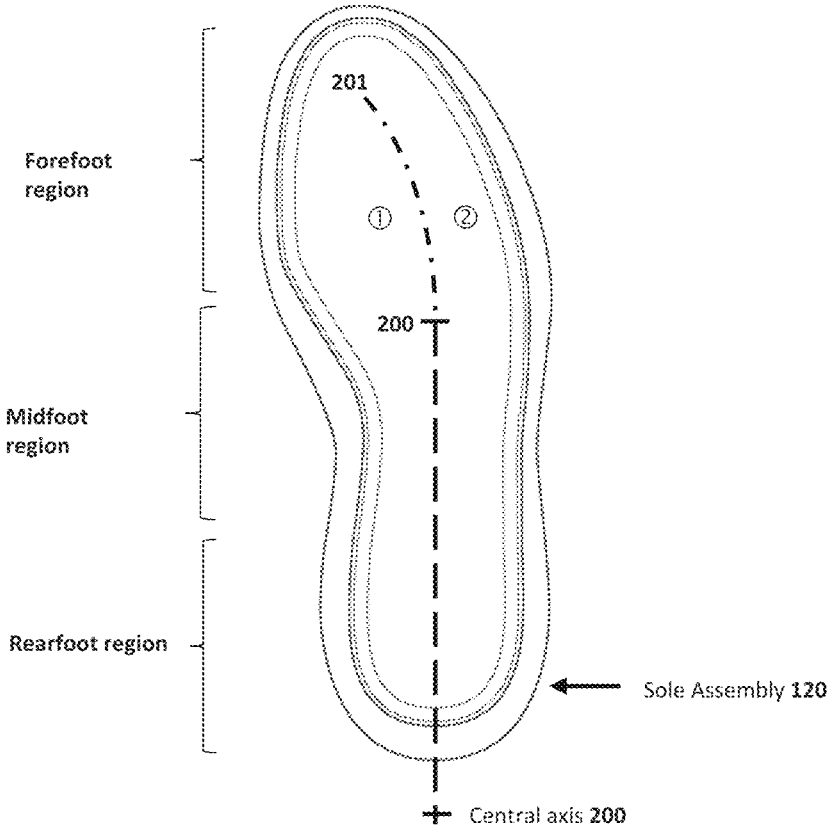

FIGS. 2A, 2B, and 2C schematically illustrate a central axis 200 of the sole assembly 120. The central axis 200 may extend from a rear most portion of the rearfoot region of the sole assembly 120 towards the midfoot and/or forefoot region of the sole assembly 120. In some embodiments, the central axis 200 may extend in a direction that is perpendicular or normal to an axis tangential to the rear most portion of the rearfoot region of the sole assembly 120.

Referring to FIG. 2B, in some embodiments, a portion of the central axis 200 (e.g., the portion extending through at least the rearfoot and/or midfoot region of the sole assembly 120) may divide or bisect the sole assembly 120 into a medial side and a lateral side. In some cases, a portion of the central axis 200 (e.g., the portion extending between the midfoot region of the sole assembly 120 and the forefoot region of the sole assembly 120) may not precisely divide or bisect the sole assembly 120 into a medial side and a lateral side. As shown in FIG. 2C, in some embodiments, the medial side 1 and the lateral side 2 of the forefoot region of the sole assembly may be divided along a curved axis 201 that deviates from the central axis 200. Any references herein to a medial side or a lateral side of a shoe or a component of a shoe may contemplate a delineation of the medial and lateral sides along the central axis 200 and/or along a curved axis 201 (e.g., as shown in FIGS. 2B and 2C).

Recycling Methods

Figure 3:
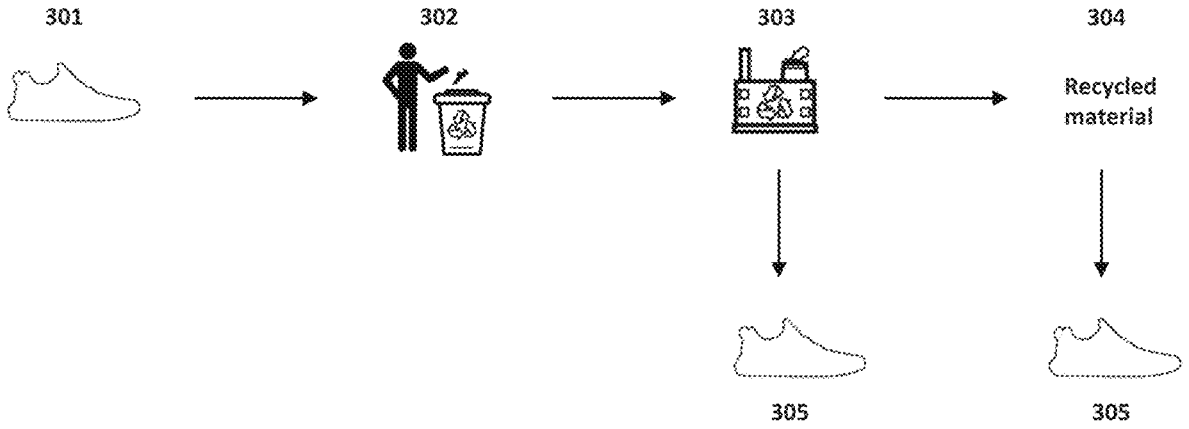
FIG. 3 schematically illustrates an exemplary method for recycling an article, in accordance with some embodiments.
Figure 4:
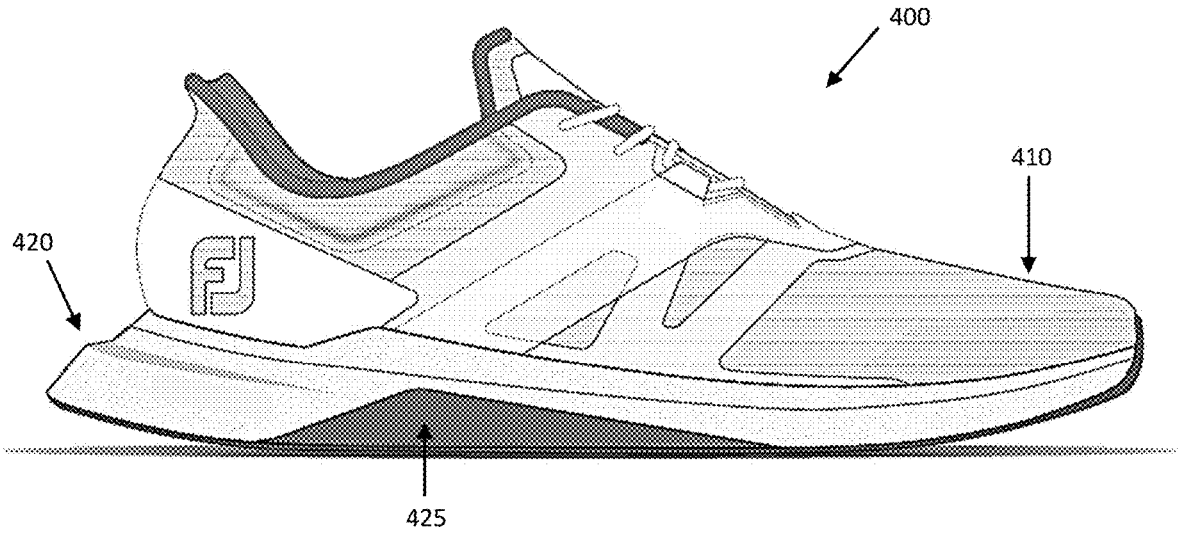
FIGS. 4, 5, and 6A-6B schematically illustrate examples of a recyclable high performance golf shoe, in accordance with some embodiments.

FIG. 3 schematically illustrates an exemplary method for recycling an article. The article may comprise any of the recyclable high performance golf shoes described herein. In some embodiments, a recyclable high performance golf shoe 301 may be recycled by an individual 302. The individual 302 may be, for example, a subject who has previously worn the recyclable high performance golf shoe 301 or taken possession of a recyclable high performance golf shoe 301. In some cases, the recycled high performance golf shoe 301 may be processed at a facility 303. In some cases, the facility 303 may comprise a shoe manufacturing or fabrication facility that can recycle the high performance golf shoe 301 and generate another recyclable article 305 from various source materials harvested from the recycled high performance golf shoe 301. In other cases, the facility 303 may comprise a recycling facility that harvests a recycled material 304 from the recyclable high performance golf shoe 301. In some cases, the recycled material 304 may be processed by another entity (e.g., another facility capable of manufacturing or fabricating article) to generate another recyclable article 305. The recyclable article 305 may comprise another shoe, an article of apparel, or any other golf-related equipment. The recyclable article 305 may comprise any of the recyclable materials described herein.

In one aspect, the present disclosure provides various examples and embodiments of recyclable golf shoes. The recyclable golf shoes may comprise a recyclable material as described elsewhere herein. In some cases, the recyclable material may include a TPU-based material or a PET-based material.

FIGS. 4, 5, and 6A-6B illustrate various examples of a recyclable high performance golf shoe 400 comprising a recyclable TPU-based material. In some embodiments, the recyclable high performance golf shoe 400 may comprise an upper 410 and a sole assembly 420. The upper 410 and the sole assembly 420 may comprise one or more recyclable TPU-based materials.

In some cases, the upper 410 of the recyclable high performance golf shoe 400 may comprise a mesh construction. In some cases, the mesh construction may comprise a recyclable mesh layer (e.g., a 100% TPU-based mono mesh layer). In some cases, the mesh construction may be directly exposed to an environment external to the shoe.

In some cases, the upper 410 of the recyclable high performance golf shoe 400 may comprise a membrane layer 440. In some cases, the membrane layer 440 may comprise a recyclable material (e.g., a TPU-based recyclable material). In some cases, the membrane layer 440 may be configured as a reinforcement or support layer for the recyclable high performance golf shoe 400. In some cases, the membrane layer 440 may be positioned between the mesh construction of the upper 410 and a foot of a subject wearing the golf shoe 400.

In some cases, the mesh construction and the membrane layer 440 may collectively form one or more layers of the upper 410. In some cases, the mesh construction and the membrane layer 440 may be shaped to accommodate a subject's foot.

In some embodiments, the recyclable golf shoe may further comprise an additional layer of material that is attached or coupled to a bottom portion of the upper. In some cases, the additional layer of material, the mesh construction of the upper 410, and the membrane layer 440 may form a partially enclosed interior region configured to receive a subject's foot. In some cases, the additional layer of material may form a Strobel construction. In some cases, a first side of the additional layer of material may comprise a fabric layer that can be attached to the upper (or one or more components or layers forming the upper) to create a sock-like construction. In some cases, a second side of the additional layer of material may provide a surface or support to which a portion of the sole assembly can be attached or coupled.

In some embodiments, the sole assembly 420 may comprise a midsole. In some cases, the midsole may comprise a recyclable TPU-based foam. In some cases, the recyclable TPU-based foam may comprise a nitrogen infused TPU foam.

In some embodiments, the midsole or outsole may comprise one or more support sidewalls. In some cases, the one or more support sidewalls may be configured to extend along a medial side and/or a lateral side of the golf shoe. In some cases, the one or more support sidewalls may extend across or over the upper of the golf shoe. In some cases, the support sidewalls may comprise a recyclable material (e.g., a recyclable TPU material as described elsewhere herein).

In some embodiments, the sole assembly 420 may comprise an outsole. In some cases, the outsole may comprise one or more support structures 425 for supporting the midfoot region and/or the heel region of the shoe. In some cases, the one or more support structures 425 may include a supportive sidewall.

In some cases, the one or more support structures 425 may comprise one or more members extending along the medial and/or lateral sides of the golf shoe. In some cases, the one or more members may comprise a plurality of members that converge to form a truss-like structure. In some cases, the truss-like structure may comprise three or more sides. In some cases, the truss-like structure may comprise an opening configured to expose the underlying midsole material.

Figure 5:
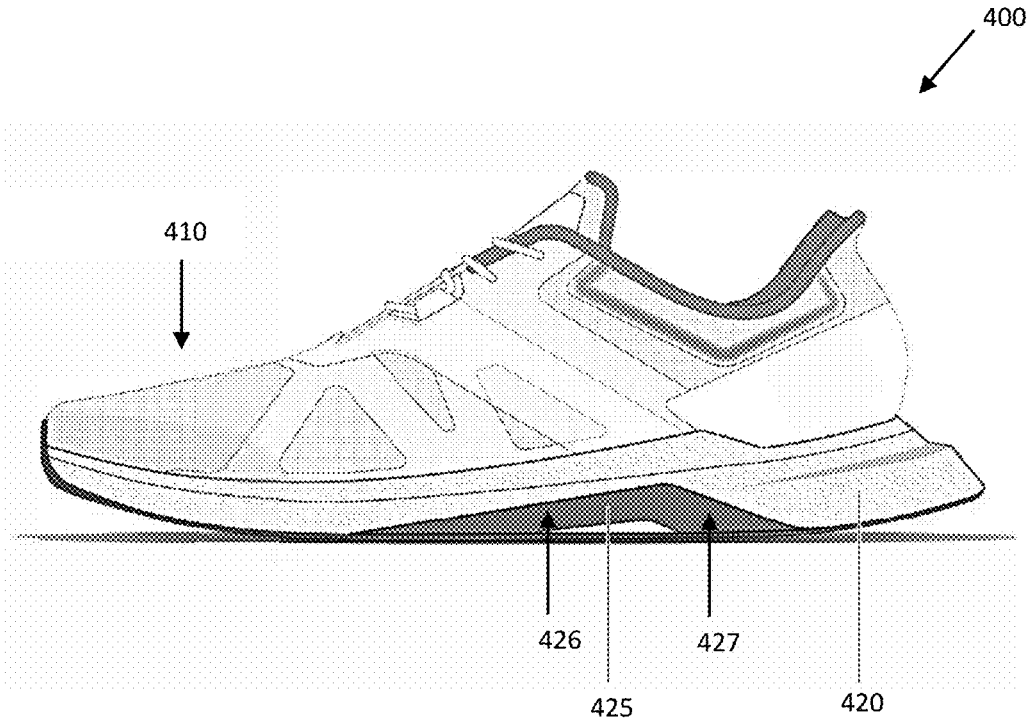

Referring to FIG. 5, in some cases, the plurality of members may comprise a first member 426 and a second member 427. The first member 426 and the second member 427 may be configured to extend in different directions or angular orientations. In some cases, the first member 426 and the second member 427 may intersect at an angle. In some cases, the angle may range from about 30 degrees to about 150 degrees.

Figure 6A:
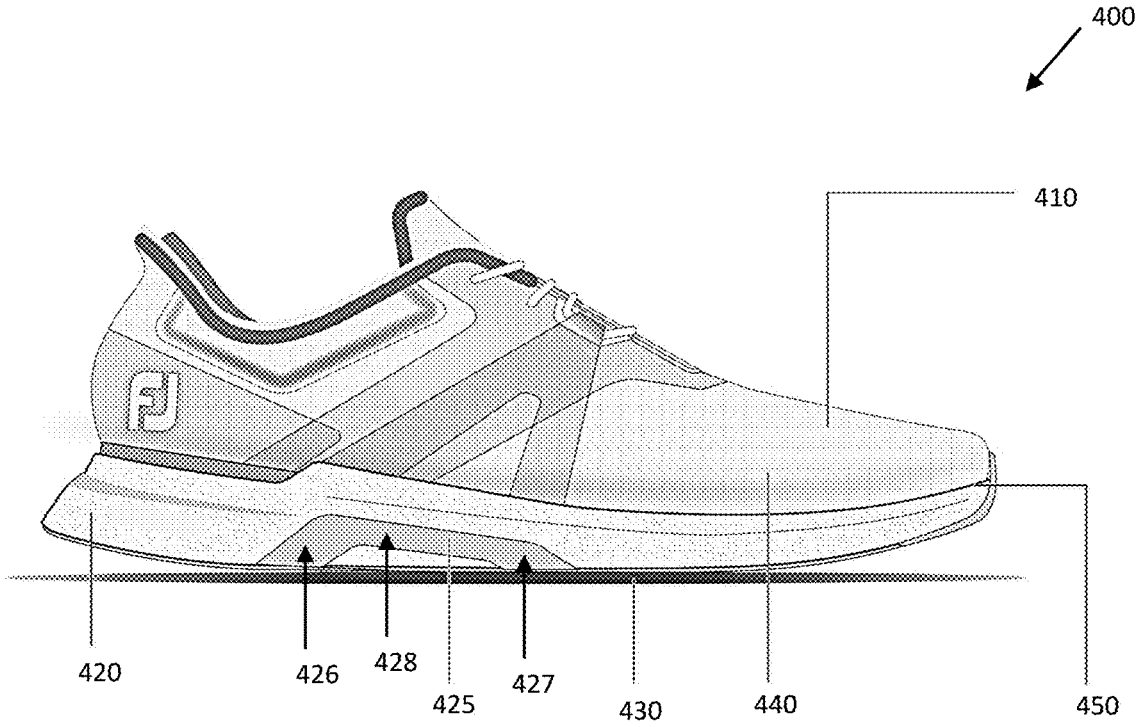

Referring to FIG. 6A, in some cases, the plurality of members may comprise a first member 426, a second member 427, and a third member 428. The first member 426, the second member 427, and the third member 428 may be configured to extend in different directions or angular orientations. In some cases, the third member 428 may extend between the first member 426 and the second member 427. In some cases, the first member 426 and the third member 428 may converge at a first convergence point. In some cases, the second member 427 and the third member 428 may converge at a second convergence point. In some cases, the first convergence point and the second convergence point may be disposed at different heights. In some cases, the third member 428 may be angled or sloped such that the third member 428 extends or slopes upwards and/or downwards between the first and second convergence points.

In some embodiments, the outsole may comprise one or more traction elements 430 as described elsewhere herein. In some cases, the one or more traction elements 430 may comprise a TPU-based recyclable material.

Figure 6B:
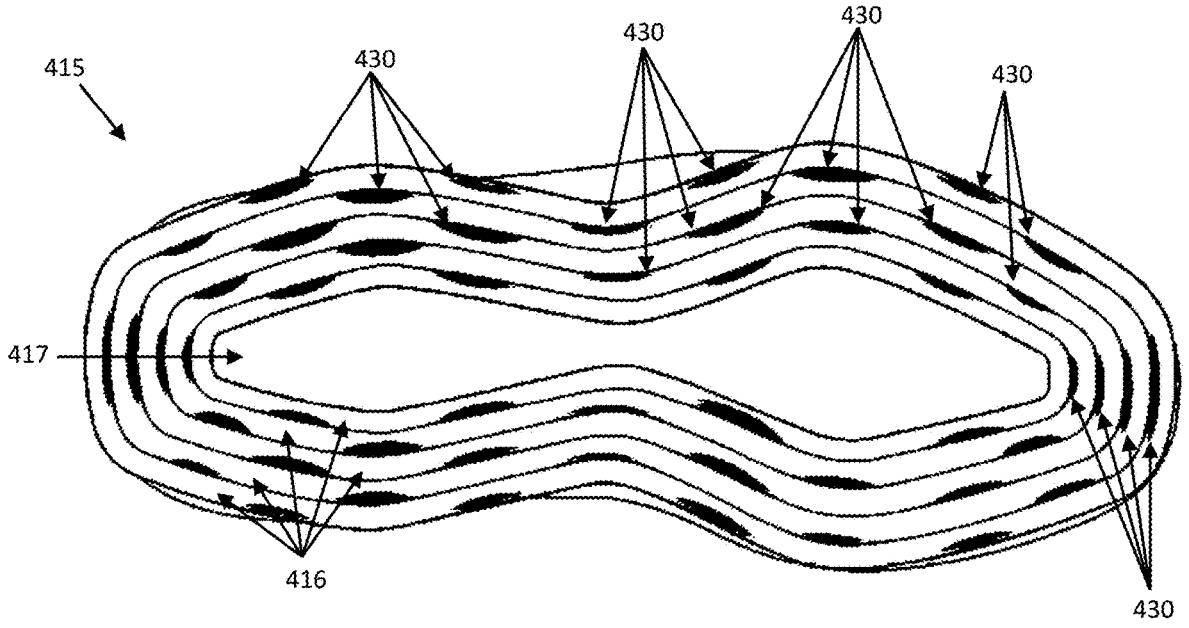

FIG. 6B illustrates an example of an outsole 415 that can be used for a recyclable high performance golf shoe. In some embodiments, the outsole 415 may comprise a plurality of tracks 416 extending around a central region 417 of the outsole. In some embodiments, the traction elements 430 may be spaced apart and arranged along the plurality of tracks 416 (e.g., in a staggered, non-channeling, and/or non-trenching configuration). The recyclable golf shoes of the present disclosure may utilize various different types of outsoles and traction configurations in combination with the other structures and components described herein, and may optionally include one or more characteristics or features of the outsoles and traction configurations shown and described in U.S. patent application Ser. No. 18/133,841 and U.S. patent application Ser. No. 18/133,857, each of which is incorporated herein by reference in its entirety for all purposes.

In some embodiments, the outsole 415 may comprise a plurality of traction elements 430 positioned around a central region 417 of the outsole 415. In some embodiments, the plurality of traction elements 430 may comprise (i) a first set of traction elements arranged along a perimeter or edge of the outsole 415 in a first spatial configuration corresponding to a shape or profile of the perimeter or edge of the outsole 415, and (ii) a second set of traction elements nested between the first set of traction elements and a third set of traction elements. In some embodiments, the second set of traction elements may be arranged in a second spatial configuration corresponding to a shape or profile of the first spatial configuration.

In some embodiments, the first spatial configuration may define a first enclosed shape around the central region 417 of the outsole 415, and the second spatial configuration may define a second enclosed shape around the central region 417 of the outsole 415. In some embodiments, the second enclosed shape may be nested within the first enclosed shape.

In some embodiments, the first and second sets of traction elements may comprise (i) one or more directional traction elements and (ii) one or more omni-directional traction elements. In some embodiments, the one or more directional traction elements can be positioned on a medial side or a lateral side of the outsole 415. In some embodiments, the one or more omni-directional traction elements can be positioned on an anterior end or a posterior end of the outsole 415. In some embodiments, the one or more omni-directional traction elements may comprise a set of directional traction elements that collectively provide the article of footwear with an omni-directional traction property or response.

In some embodiments, the first and second sets of traction elements may include (i) one or more traction elements arranged along an anterior end and a posterior end of the outsole 415 and (ii) one or more traction elements arranged along a medial side and a lateral side of the outsole 415. In some embodiments, the anterior or posterior end of the outsole 415 may have a greater traction element density (i.e., a greater number of traction elements per unit area of the outsole) than the medial or lateral side of the outsole 415.

In some embodiments, the first set of traction elements and the second set of traction elements may each comprise a series of spaced apart traction elements respectively arranged in the first or second spatial configuration. In some embodiments, the first and second sets of traction elements may be staggered relative to each other in a non-channeling and/or non-trenching configuration in order to enhance traction.

In some embodiments, the plurality of traction elements 430 may comprise two or more traction elements having different sizes and/or different shapes. In some embodiments, the plurality of traction elements 430 may comprise two or more traction elements oriented in different directions. In some embodiments, a size, a shape, an orientation, or a directional bias of the plurality of traction elements can change or vary along a medial or lateral side of the shoe. In some embodiments, a size, a shape, an orientation, or a directional bias of the plurality of traction elements 430 can gradually change or vary between (i) a medial or lateral side of the shoe and (ii) an anterior or posterior end of the shoe.

In some non-limiting embodiments, the plurality of traction elements 430 may have at least one flat or substantially flat surface and/or at least one curved surface. In some non-limiting embodiments, the plurality of traction elements 430 may have an ellipsoidal shape or profile. In some non-limiting embodiments, the plurality of traction elements 430 may have a half moon shape or a fanged profile.

In some embodiments, the plurality of traction elements 430 can be arranged around the central region 417 of the outsole 415 to expose an interior region or component of the sole assembly. In some embodiments, the interior region or component of the sole assembly may comprise a midsole of the golf shoe. In some embodiments, the interior region or component of the sole assembly may comprise a functional insert that is positioned (i) within the midsole or (ii) between the midsole and the outsole.

In some embodiments, the components of the recyclable high performance golf shoe 400 may be attached or coupled to each other using an adhesive 450. In some cases, the adhesive 450 may include a recyclable cement or primer. In some cases, the recyclable cement or primer may comprise a TPU-based cement or a PET-based cement. In some cases, the adhesive 450 may comprise a water-based or solvent-based cement or primer. In some cases, the adhesive 450 may comprise a hot melt cement. Additional examples of primers are described in greater detail elsewhere herein.

FIGS. 7A-7D schematically illustrate another example of a recyclable golf shoe 700. In some cases, the recyclable golf shoe 700 may comprise an upper 710. In some cases, the upper 710 may comprise a mesh layer. In some cases, the mesh layer may comprise a recyclable mesh layer (e.g., a 100% TPU-based mono mesh layer).

In some cases, the recyclable golf shoe 700 may include a sole assembly 720 comprising a midsole. In some cases, the midsole may comprise a recyclable material. In some cases, the recyclable material may include a recyclable foam material. In some cases, the recyclable foam material may comprise a TPU-based foam.

In some optional embodiments, the recyclable golf shoe 700 may comprise a window provided in or near a heel region of the shoe. In some cases, the window may comprise a transparent material revealing a select material or a feature of the shoe. In some cases, the select material may include a layer or a section of the upper. In some cases, the select feature may include a logo. In some embodiments, a logo may be cut out from the window. In other embodiments, a logo may be cut into the window.

In some optional embodiments, the recyclable golf shoe 700 may comprise a hot melt border. In some cases, the hot melt border may line or extend around an opening of the golf shoe. In some cases, the hot melt border may form a portion of the heel collar of the shoe. In some embodiments, the recyclable golf shoe may comprise or utilize a hotmelt tape to create one or more aesthetic details or functional structures. In other embodiments, the aesthetic details or functional structures may be formed using one or more pieces that are die cut from a hotmelt sheet or layer. In some cases, the aesthetic details may correspond to lines, surfaces, shapes, profiles, colors, or other visual characteristics of the recyclable golf shoes disclosed herein. In some cases, the functional structures may correspond to any structural portion, component, piece, layer, or material of the recyclable golf shoes disclosed herein.

In some optional embodiments, the recyclable golf shoe 700 may comprise a TPU padding. In some case, the TPU padding may be formed from a mono mesh material. In some cases, the TPU padding may be formed from a recyclable foam material (e.g., a recyclable TPU foam as described elsewhere herein). In some cases, the TPU padding may comprise a same or similar material as the mesh layer of the upper 710. In other cases, the TPU padding and the upper 710 may comprise different materials.

Figure 7A:
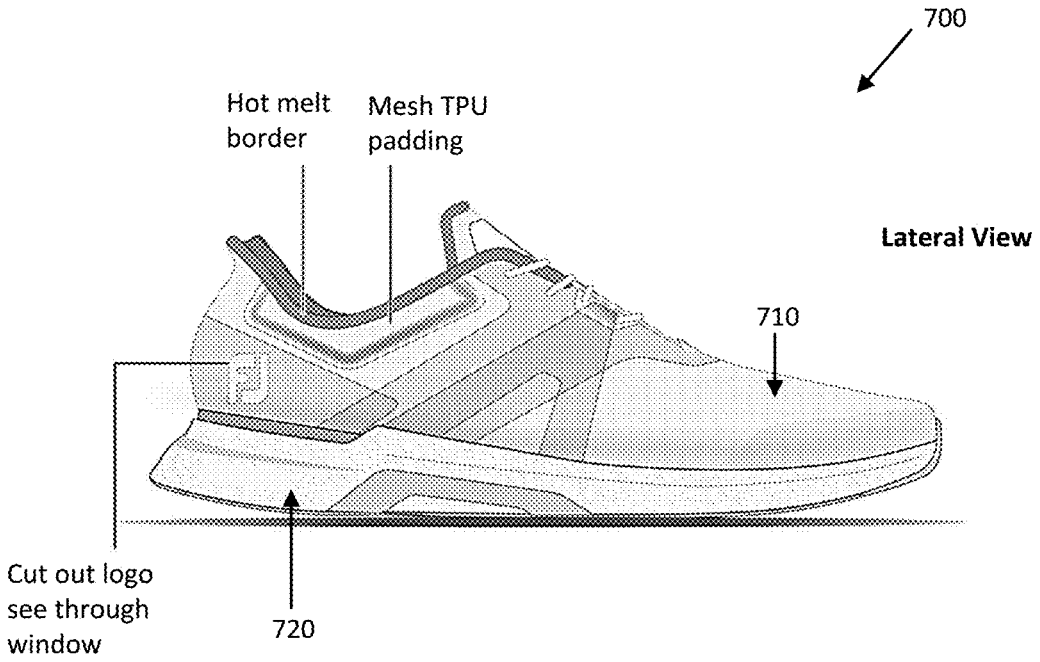
FIGS. 7A-7D schematically illustrate various views of a recyclable high performance golf shoe, in accordance with some embodiments.
Figure 7B:
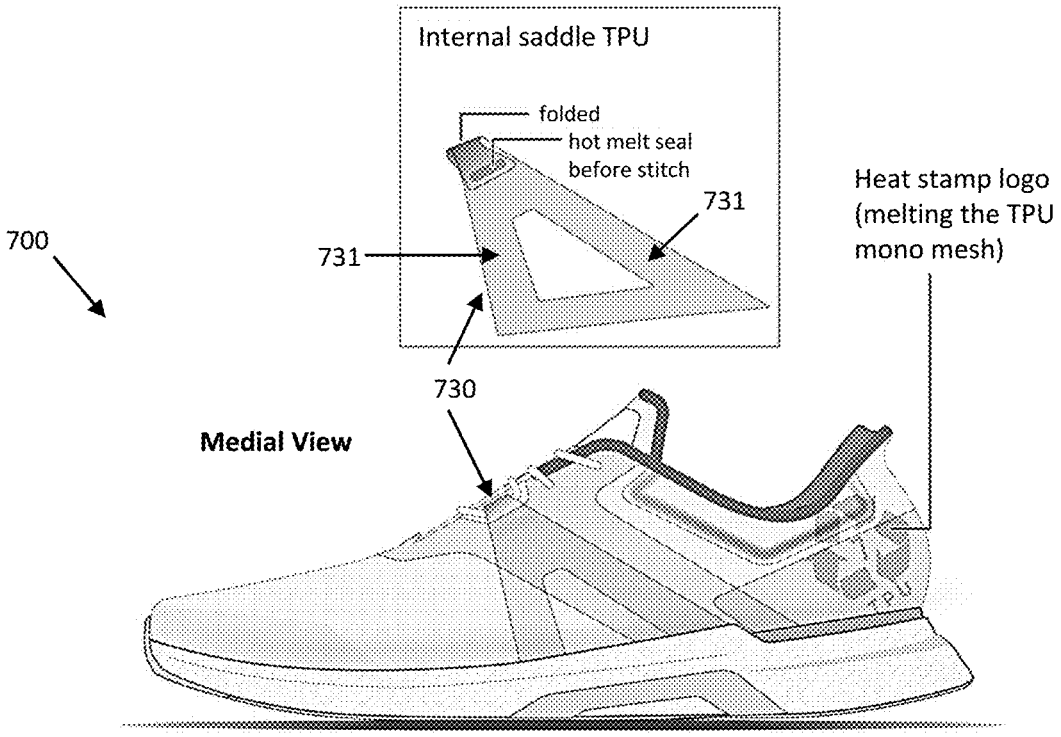

Referring to FIG. 7B, in some embodiments, the golf shoe 700 may comprise a saddle 730. In some cases, the saddle 730 may comprise an internal saddle or an external saddle. In some cases, the saddle 730 may comprise a recyclable material as described elsewhere herein.

In some cases, the saddle 730 may comprise two or more segments 731 that extend upwards from a bite line region of the shoe and converge towards the throat region or eyelet region of the shoe. In some cases, the two or more segments 731 may converge to form an end portion of the saddle 730. In some cases, the end portion of the saddle 730 may be folded and wrapped around the laces of the golf shoe. In some cases, the end portion of the saddle 730 may be hot melted to another portion of the saddle 730 to secure the end portion of the saddle 730 around the laces of the golf shoe. In some cases, when the laces are tightened, the tension in the laces may draw the segments 731 of the saddle 730 upwards to secure the saddle 730 and the medial and/or lateral sides of the upper around a subject's foot.

Figure 7C:
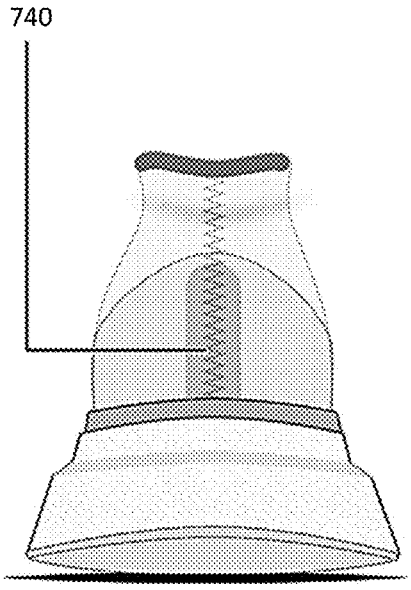

FIG. 7C illustrates a rear view of a heel portion of the recyclable golf shoe 700. In some embodiments, the heel portion of the golf shoe may include a stitch (e.g., a zigzag stitch) that runs vertically along the upper. In some embodiments, the golf shoe may comprise an adhesive component 740 that is placed over the stitch. In some cases, the adhesive component 740 may be configured to conceal the stitch. In other cases, the adhesive component 740 may be configured as a protective barrier for the stitch. In some alternative cases, the adhesive component 740 may be configured to provide additional structural support for the heel portion of the golf shoe. In some embodiments, the adhesive component 740 may comprise a heat-activated tape that can be thermally activated and adhered to the upper material.

Figure 7D:
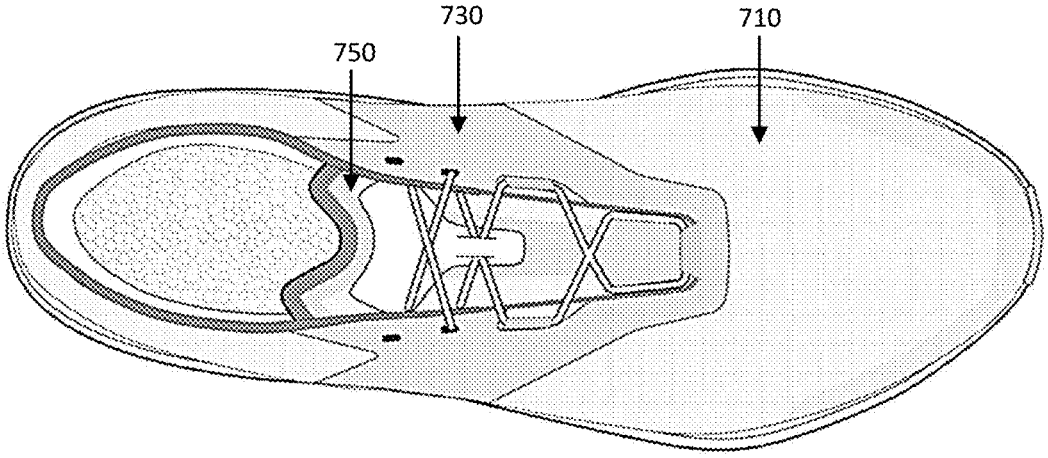

FIG. 7D illustrates a top view of a recyclable golf shoe. As described elsewhere herein, the recyclable golf shoe may comprise an upper 710 comprising a mesh material. The mesh material may comprise a recyclable mesh material. In some embodiments, the recyclable golf shoe may also comprise a saddle 730 that can be tensioned or tightened around a subject's foot when the shoe is laced. As described above, in some cases, the saddle 730 may be configured to interface with the laces of the shoe. In some cases, the saddle 730 may be configured to couple to the laces of the shoe so that the saddle 730 can be secured around a subject's foot when the laces are tightened. In some cases, the saddle 730 may also be configured to manage or control the direction in which the laces are routed across the tongue 750 of the shoe.

Figure 8:
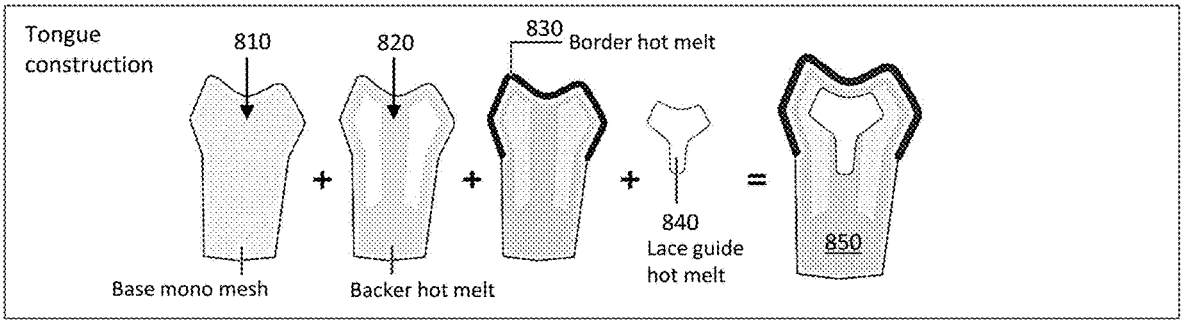
FIG. 8 schematically illustrates a tongue assembly for a recyclable golf shoe, in accordance with some embodiments.

FIG. 8 illustrates a detailed view of a tongue 850 that can be incorporated with the recyclable golf shoe. In some cases, the tongue 850 may comprise a base mono mesh layer 810. In some cases, the base mono mesh layer 810 may be attached or coupled to a backer layer 820. In some cases, the base mono mesh layer 810 and the backer layer 820 may be attached or coupled by way of a hot melt process. In some cases, the base mono mesh layer 810 and the backer layer 820 may be hot melted together.

In some embodiments, a hot melt border 830 may be arranged or provided along an edge portion of the base mono mesh layer 810 and/or the backer layer 820. In some cases, the hot melt border 830 may extend along an entire perimeter of the base mono mesh layer 810 and/or the backer layer 820. In other cases, the hot melt border 830 may extend around only a select portion or section of the perimeter of the base mono mesh layer 810 and/or the backer layer 820.

In some embodiments, a lace guide component 840 may be provided on or attached to the base mono mesh layer 810 and/or the backer layer 820. In some cases, the lace guide component 840 may be configured to route or organize one or more laces extending across the tongue 850 of the shoe.

In some embodiments, the tongue 850 may be formed by attaching or coupling together the base mono mesh layer 810, the backer layer 820, the hot melt border 830, and/or the lace guide component 840. In some cases, the base mono mesh layer 810, the backer layer 820, the hot melt border 830, and/or the lace guide component 840 may be hot melted together to form the tongue 850.

In some cases, the tongue 850 may comprise a symmetric shape or profile about a longitudinal axis extending from the heel region of the shoe to the toe region of the shoe. In some cases, the various components or layers of the tongue 850 may comprise a symmetric shape or profile. For example, the base mono mesh layer 810, the backer layer 820, and/or the hot melt border 830 may comprise a symmetric shape or profile.

In other cases, the tongue 850 may comprise an asymmetric shape or profile about a longitudinal axis extending from the heel region of the shoe to the toe region of the shoe. In some cases, the various components or layers of the tongue 850 may comprise an asymmetric shape or profile. For example, the base mono mesh layer 810, the backer layer 820, and/or the hot melt border 830 may comprise an asymmetric shape or profile.

Shoe Construction

In another aspect, the present disclosure provides a golf shoe comprising an upper and a sole assembly connected to the upper. In some embodiments, the upper may comprise a membrane layer, a frame structure, a mesh layer, and/or a saddle as described elsewhere herein. In some embodiments, the sole assembly may comprise a midsole and/or an outsole as described in further detail elsewhere herein.

Figure 9:
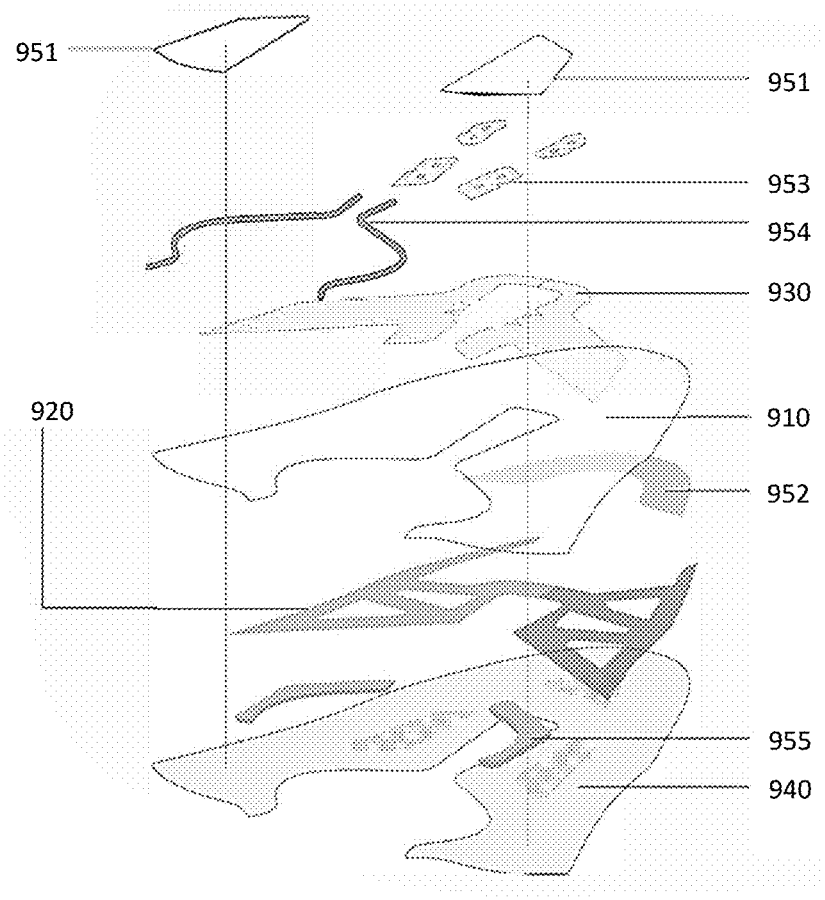
FIG. 9 schematically illustrates various components and layers of a recyclable golf shoe, in accordance with some embodiments.
Figure 10:
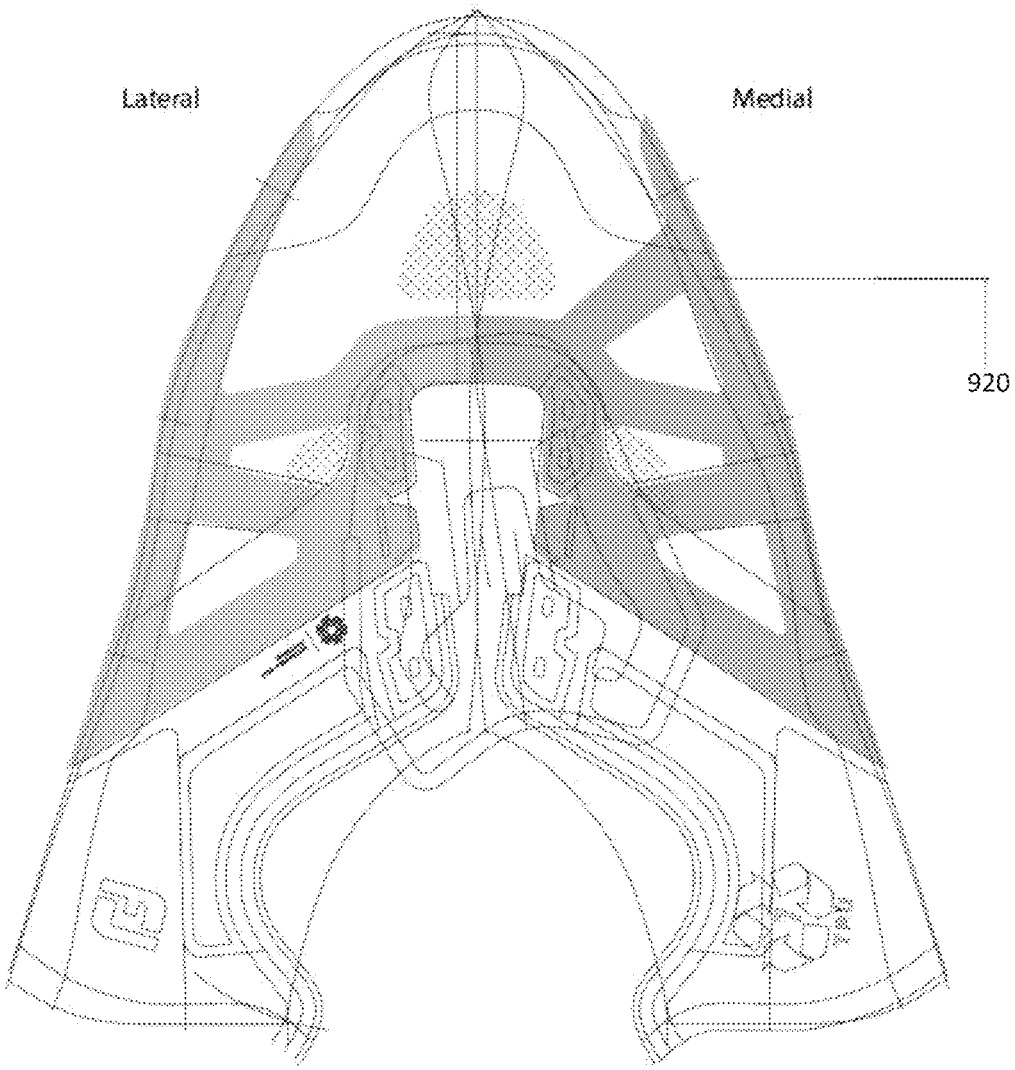
FIG. 10 schematically illustrates a frame structure for supporting an upper of a recyclable golf shoe, in accordance with some embodiments.

FIG. 9 illustrates an example of a recyclable golf shoe. In some embodiments, the recyclable golf shoe may comprise a TPU mono mesh layer 910. The TPU mono mesh layer 910 may be directly exposed to an environment external to the shoe. In some embodiments, the recyclable golf shoe may comprise an internal frame structure 920. In some cases, the internal frame structure 920 may be configured to provide additional structural support to the upper. A detailed view of the internal frame structure 920 is shown in FIG. 10. In some embodiments, the recyclable golf shoe may comprise a saddle 930. As described elsewhere herein, the saddle 930 may be configured to interface with one or more laces of the shoe. In some cases, the saddle may be secured around a subject's foot when the laces of the shoe are tightened. In some cases, the recyclable golf shoe may comprise a membrane layer 940. In some cases, the membrane layer 940 may comprise a base layer to which other components or layers of the shoe can be attached or coupled. In some cases, the membrane layer 940 may comprise a TPU hotmelt membrane layer.

Membrane Layer

In some embodiments, the upper of the golf shoe may comprise a membrane layer 940. The membrane layer 940 may be configured to at least partially surround or enclose a foot of a subject wearing the golf shoe. In some cases, the membrane layer 940 may be positioned adjacent to the subject's foot. In some cases, the membrane layer 940 may be configured to directly contact a subject's foot. In some cases, the membrane layer 940 may correspond to a layer of the upper that is positioned closest to the subject's foot.

Breathable Membrane

In some embodiments, the membrane layer 940 may be a breathable membrane comprising one or more regions with one or more surface features or perforations. In some cases, the one or more surface features or perforations may be configured to facilitate a movement of a fluid or vapor through or across the membrane layer. In some cases, the one or more regions having the one or more surface features or perforations can be physically decoupled or detached from other adjacent components or layers of the shoe (e.g., the mesh layer 910) to enhance breathability.

In some cases, the one or more surface features or perforations may comprise one or more openings through which a fluid or vapor can be transported. In some cases, the one or more openings may have a size (e.g., a width) ranging from about 0.001 millimeters (mm) to about 0.002 mm. In some cases, the size or width of the openings may be greater than about 0.002 mm. In other cases, the size or width of the openings may be less than about 0.001 mm.

In some cases, the one or more surface features or perforations may comprise a plurality of openings through which a fluid or vapor can be transported. In some cases, adjacent or neighboring openings may be remotely spaced by a pre-determined separation distance. In some cases, the pre-determined separation distance may range from about 0.005 mm to about 0.006 mm. In some cases, the pre-determined separation distance may be greater than about 0.006 mm. In other cases, the pre-determined separation distance may be less than about 0.005 mm.

Example 1

In some embodiments, the golf shoe may comprise a membrane with one or more micropores. In some cases, the micropores may be created on the membrane prior to a lamination or hot press process which seals materials together to create a composite structure. To avoid losing the micropores and related breathability features during the lamination or hot press process, a non-stick material may be applied or provided to leave one or more predetermined zones of the membrane as non-laminated regions that can preserve their micropore characteristics. In some cases, the non-stick material may create or preserve one or more air pockets between the layers of the shoe, to prevent the layers from sticking in the predetermined zones so that the membrane can retain one or more micropores for breathability within the predetermined zones.

Figure 11A:
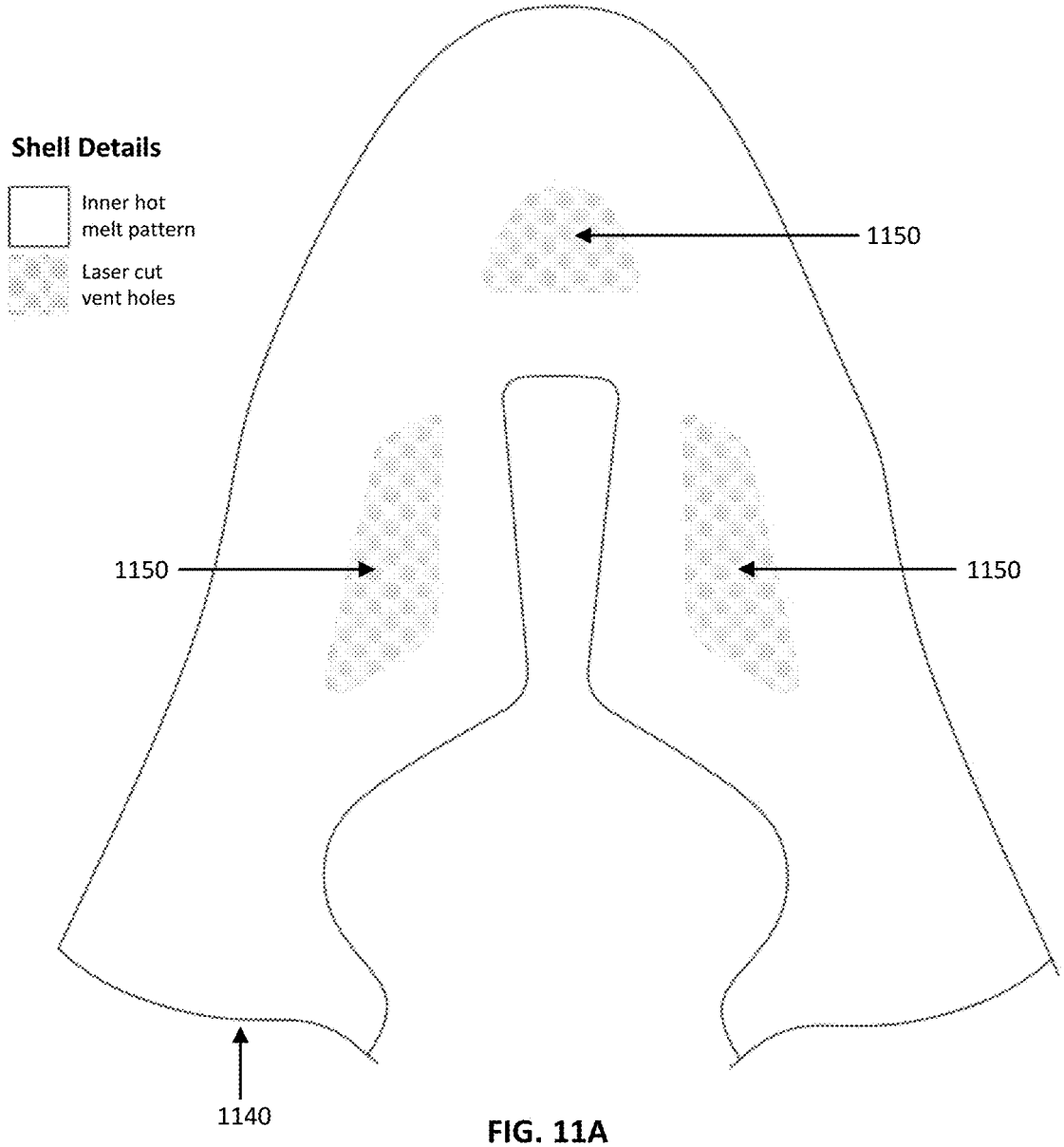
FIGS. 11A and 11B schematically illustrate one or more surface features that can be integrated into a layer of a golf shoe to enhance breathability, in accordance with some embodiments.
Figure 11B:
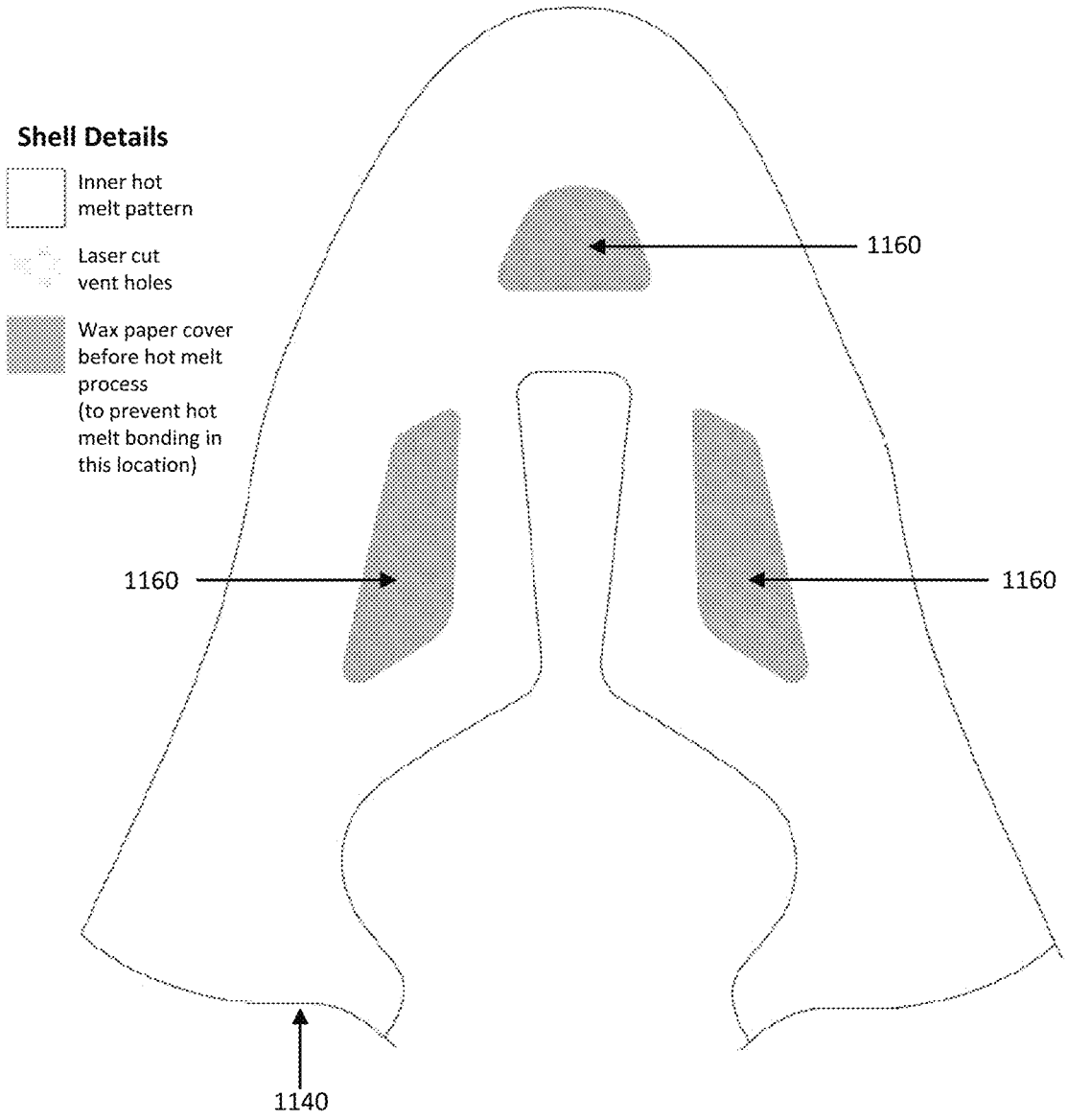

FIGS. 11A and 11B show an exemplary membrane layer 1140 with one or more perforated regions 1150. As shown in FIG. 11A, the one or more perforated regions 1150 may include one or more perforations or micropores for controlling a movement of a fluid or a vapor across or through the membrane layer 1140. In some cases, the exemplary membrane layer 1140 may include a plurality of perforated regions 1150. In some cases, the plurality of perforated regions 1150 may include a perforated region in a forefoot region of the exemplary membrane layer 1140. In some cases, the plurality of perforated regions 1150 may include a perforated region on the medial side and/or the lateral side of the membrane layer 1140. As shown in FIG. 11B, in some cases, a non-adhesive material 1160 may be applied to cover the membrane layer 1140 before the membrane layer 1140 undergoes a hotmelt process (e.g., a hotmelt process to join one or more other layers or components of the shoe to the membrane layer 1140). The non-adhesive material 1160 may be configured to prevent hotmelt bonding in one or more select regions (e.g., the perforated regions shown in FIG. 11A). In some cases, the non-adhesive material 1160 may include, for example, a wax paper material.

Example 2

In some embodiments, a regular hotmelt film may be used as the backer instead of a traditional membrane. In some cases, one or more micropores may be provided on the hotmelt film and/or the backer.

In some cases, the pores may be created on the backer hotmelt layer (e.g., by mechanical or laser perforation) before a lamination or hotmelt process. In some cases, when the perforations are created on the backer pre-lamination, one or more non-stick materials such as wax paper can be used to preserve the holes/breathability feature through the lamination or hotmelt process.

In some alternative cases, the pores may be created on the backer hotmelt layer after a lamination or hot melt process. In such cases, the pores may be created by mechanical or laser perforation through multiple layers of a laminated and hot melted construction comprising the backer hotmelt layer.

Example 3

In some embodiments, the membrane of the golf shoe may comprise a microporous membrane. In some cases, the microporous membrane may form a portion or a layer of an internal bootie system or assembly of the golf shoe. In some cases, the microporous membrane may be configured as an internal bootie system or assembly. In some cases, the internal bootie system or assembly may be configured to float inside the shoe. In some cases, the internal bootie system or assembly may not or need not be laminated with or hot melted to other layers of the shoe. In some cases, the internal bootie system or assembly may provide a softer upper build compared to other golf shoe embodiments which utilize laminated or hot melted layers to enhance stiffness.

Figure 11C:
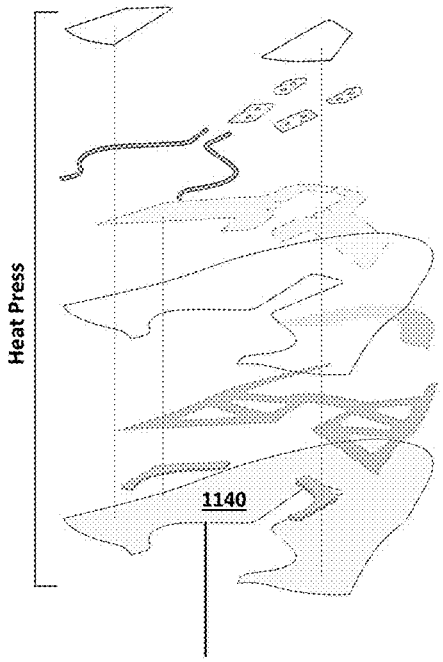
FIGS. 11C-11G schematically illustrate various examples of a waterproof and/or breathable construction for a recyclable golf shoe, in accordance with some embodiments.

FIGS. 11C-11G schematically illustrate various examples of a waterproof and/or breathable construction for a recyclable golf shoe. As shown in FIG. 11C, in some embodiments, the recyclable golf shoe may comprise a membrane layer 1140 comprising a TPU hotmelt base. In some cases, the TPU hotmelt base may not or need not comprise any perforations or micropores. In some cases, the TPU hotmelt base may be waterproof or water resistant. In some cases, the TPU hotmelt base may have limited or restricted breathability. In some cases, the TPU hotmelt base may not or need not be breathable.

Figure 11D:
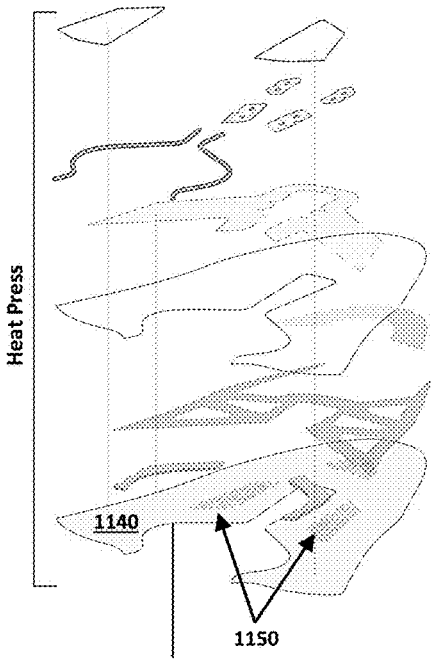

Referring to FIG. 11D, in some alternative embodiments, the recyclable golf shoe may comprise a membrane layer 1140 comprising a TPU hotmelt base with one or more perforations. In some cases, the one or more perforations may be localized in or near one or more select locations on the TPU hotmelt base. The one or more select locations may include, for example, a medial and/or lateral side of a midfoot portion of the TPU hotmelt base. In some cases, the one or more select locations may include a toe portion of the TPU hotmelt base. In some embodiments, the one or more perforations may include one or more mechanical perforations. In other embodiments, the one or more perforations may include one or more laser perforations. In some embodiments, the membrane layer 1140 may be waterproof or water resistant. In some embodiments, the membrane layer 1140 may be breathable at least in part due to the one or more perforations. In some embodiments, the one or more perforations may be configured to enhance or control a breathability of the membrane layer 1140.

As described elsewhere herein, in some cases, the one or more perforations may be preserved during a hot melt or heat press process by providing a barrier material that prevents the removal or destruction of the perforations during the hot melt or heat press process. In some cases, the barrier material may comprise a wax-based material or a silicone-based material. In some cases, the barrier material may be removable after the hot melt or heat press process.

Figure 11E:
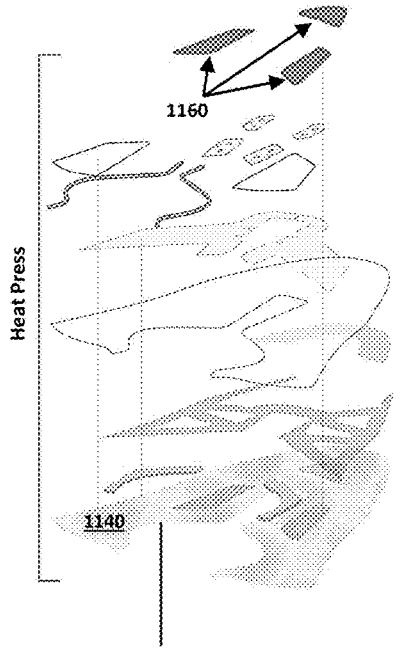

Referring to FIG. 11E, in some non-limiting embodiments, the recyclable golf shoe may comprise a membrane layer 1140 comprising a microporous TPU membrane base. In some embodiments, wax paper or silicone patches can be temporarily placed adjacent to or over select regions of the membrane layer 1140 to preserve the micropores in the select regions during a hot melt or heat press process. In some cases, the wax paper or the silicone patches can be removed after the hot melt or heat press process to yield a membrane layer 1140 with micropores in the select regions. The micropores may be configured to enhance or control the breathability of the membrane layer 1140 in the select regions.

Figure 11F:
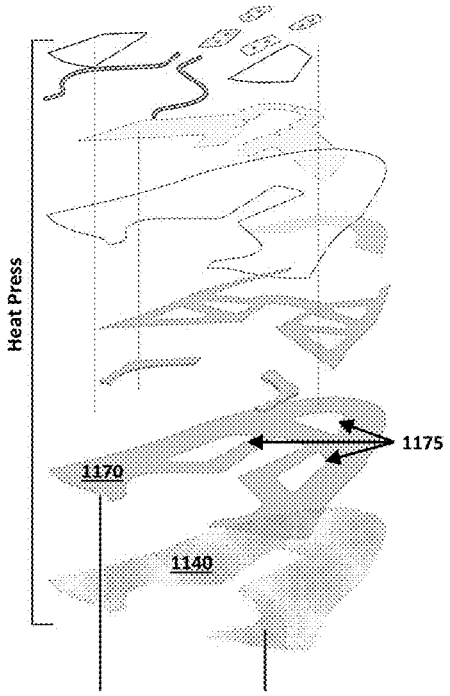

Referring to FIG. 11F, in some non-limiting embodiments, the recyclable golf shoe may comprise a membrane layer 1140 comprising a microporous TPU membrane base. In some embodiments, a hotmelt layer 1170 may be layered over or overlaid on the microporous TPU membrane base. In some cases, the hotmelt layer 1170 may be positioned between (i) the membrane layer 1140 and (ii) a mesh layer, a frame structure, and/or a saddle component of the recyclable golf shoe (e.g., as shown in FIG. 9). In some cases, the hotmelt layer 1170 may comprise one or more apertures or windows 1175. In some cases, the one or more apertures or windows 1175 may be positioned directly adjacent to one or more select regions of the membrane layer 1140. The one or more select regions may correspond to regions of the membrane layer 1140 with micropores that can or should be preserved to enhance or control the breathability of the membrane layer 1140. In some cases, the placement of the one or more apertures or windows 1175 directly adjacent to the select regions may provide a physical clearance between the select regions and other layers or components of the shoe, so that the select regions do not adhere to the other layers or components during a hot melt or heat press process. In some cases, the one or more apertures or windows 1175 may be positioned in a medial and/or lateral side of a midfoot portion of the hotmelt layer 1170. In some cases, the one or more select locations may include a toe portion of the hotmelt layer 1170.

Figure 11G:
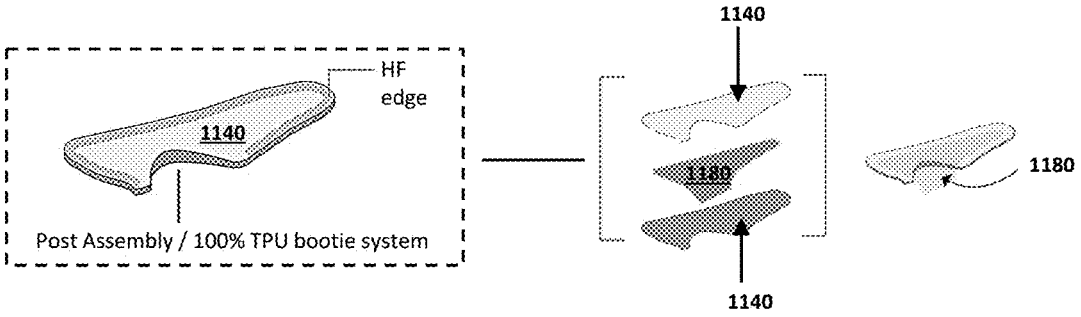

Referring now to FIG. 11G, in some non-limiting embodiments, the recyclable golf shoe may comprise a bootie system comprising a recyclable TPU material. The bootie system may be waterproof and/or breathable. In some cases, the bootie system may comprise two or more membrane layers 1140 that are attached together along a perimeter or edge of the membrane layers. In some cases, the membrane layers 1140 may comprise a microporous membrane. In some cases, the two or more microporous membranes may be attached by way of a heat press process that seals the respective perimeters or edges of the membrane layers together. In some cases, the two or more microporous membranes may be welded at the respective perimeters or edges of the membrane layers (e.g., by way of high frequency welding or other TPU welding techniques). In some cases, a portion of the respective perimeters or edges of the microporous membrane layers may not or need not be attached (e.g., to create or provide a throat opening configured to receive a subject's foot). In some cases, the two or more microporous membranes may not or need not be laminated to a separate backer panel or layer.

Referring still to FIG. 11G, in some embodiments, the recyclable golf shoe may comprise a bootie system comprising two or more membrane layers 1140 that are attached together along a perimeter or edge of the microporous membranes. In some cases, a barrier material 1180 may be provided between the two or more membrane layers 1140 (e.g., during a hot melt, HF welding, or heat press process) to prevent the microporous membrane layers from adhering to each other and effectively removing or destroying the micropore structures in the microporous membranes. In some cases, the barrier material 1180 may be applied before a hot melt, HF welding, or heat press process. In some cases, after the hot melt, HF welding, or heat press process is completed (and the perimeters or edges of the membrane layers 1140 are sealed or fused together), the barrier material 1180 may be removed via the throat opening to yield a waterproof and/or breathable bootie system with a microporous membrane structure. In some non-limiting embodiments, the barrier material 1180 may comprise a wax paper or a silicone piece/patch as described elsewhere herein.

Hotmelt Construction

In some embodiments, the membrane layer of the recyclable golf shoe may be configured as a hotmelt backer for the mesh layer of the recyclable golf shoe. In some cases, the hotmelt backer may be configured as a substrate or a support to which other layers of the shoe can be attached or coupled (e.g., by way of a thermal treatment such as a hot melt procedure or a heat press method).

In some embodiments, a hotmelt film may be used as the backer, instead of or in addition to a traditional membrane. In some cases, the hotmelt film may have a lower melting point than the upper material and/or the midsole material so that the hotmelt film can be activated without subjecting the upper and/or midsole to elevated temperatures that can (i) shrink or deform the upper and/or midsole or (ii) damage or otherwise compromise the structural integrity of the upper and/or midsole or any other components of the shoe (e.g., the Strobel threads of the shoe). In some cases, the hotmelt film can be activated in a negative pressure space (e.g., a vacuum environment).

Optical Properties

In some embodiments, the membrane layer may be fully transparent (i.e., all light passes through the membrane layer). In some cases, the membrane layer may be translucent (i.e., some light passes through the membrane layer). In some cases, the membrane layer may be fully opaque (i.e., no light passes through the membrane layer). The transparency, translucence, and/or opacity of the membrane layer may be adjusted depending on a subject's preference, for aesthetic reasons, and/or for various performance benefits (e.g., to reduce or prevent discoloration or wear, to regulate a movement of fluids, vapors, or gases through or across the membrane layer, or to regulate a transfer of thermal energy across the membrane layer).

In some embodiments, the membrane layer may have a different transparency, translucence, and/or opacity than other layers of the shoe. For example, the membrane layer and the mesh layer may have different transparencies, translucencies, and/or opacities. The different transparencies, translucencies, and/or opacities can collectively provide a desired aesthetic appearance and/or one or more desirable performance benefits. In some cases, the one or more desirable performance benefits may include resistance to wear or discoloration due to exposure to sunlight or UV rays. In some cases, the one or more desirable performance benefits may include an ability to regulate a movement of fluids, vapors, or gases through or across the membrane or mesh layer. In some cases, the performance benefits may include an ability to regulate a transfer of thermal energy across the membrane or mesh layer.

Internal Frame

In some embodiments, the recyclable golf shoes of the present disclosure may comprise a frame structure. FIGS. 9 and 10 illustrate an example of a frame structure 920 that can be used to structure the upper of the golf shoe. In some cases, the frame structure 920 may comprise an internal frame structure attached or coupled to the membrane layer, the mesh layer, and/or the saddle of the shoe to structurally support or stiffen the upper. In some non-limiting embodiments, the internal frame structure 920 may comprise an A-shaped support frame.

In some embodiments, the A-shaped support frame may comprise a plurality of members that converge and/or diverge with respect to one another to form a truss-like configuration. The truss-like configuration may comprise supporting members configured to support loads in two or more directions. In some cases, the supporting members may be linked together and arranged to form one or more windows or openings. In some cases, the one or more windows or openings may expose a portion of the membrane layer or the mesh layer and allow the membrane layer and the mesh layer to directly contact each other.

In some embodiments, the frame structure 920 may support or stiffen multiple portions or components of the upper. In some cases, the frame structure 920 may be attached to one or more other layers of the shoe to provide structure to the upper and/or to stiffen the upper. In some cases, the frame structure 920 may be attached to the other layers of the shoe by way of a hot melt process or a heat press procedure. In some cases, the frame structure 920 may be laminated with or to one or more other layers of the shoe.

In some embodiments, the frame structure 920 may be configured to stiffen a lateral side and/or a medial side of the upper. In some embodiments, the frame structure 920 may be configured to stiffen a forefoot region, a midfoot region, and/or a rearfoot region of the upper.

In some cases, the frame structure 920 may be positioned between (i) the membrane layer 940 and (ii) the mesh layer 910 of the shoe. In some cases, the frame structure 920 may be positioned between (i) the membrane layer 940 and (ii) the saddle 930 of the shoe.

In some embodiments, the frame structure 920 may be configured to extend from a rearfoot region of the shoe to a midfoot region of the shoe. In some embodiments, the frame structure 920 may be configured to extend from a rearfoot region of the shoe to a forefoot region of the shoe. In some embodiments, the frame structure 920 may be configured to extend from a midfoot region of the shoe to a forefoot region of the shoe.

In some embodiments, the frame structure 920 may be configured to extend along the medial side of the shoe. In some embodiments, the frame structure 920 may be configured to extend along the lateral side of the shoe.

In some embodiments, the frame structure 920 may be configured to extend around or along a toe region of the shoe. In other embodiments, the frame structure 920 may not or need not extend around or along the toe region of the shoe.

In some embodiments, the frame structure 920 may be configured to extend around or along a heel region of the shoe. In other embodiments, the frame structure 920 may not or need not extend around or along the heel region of the shoe.

Truss Structure

In some embodiments, the internal A-shaped frame structure 920 may comprise one or more truss-like structures. The one or more truss-like structures may comprise a plurality of support members that are mechanically coupled or integrally formed. The plurality of support members may converge and/or diverge to form one or more windows or openings between the support members. In some cases, the one or more truss-like structures may be configured to bear one or more loads that are exerted on the support members of the truss-like structures. In some cases, the one or more truss-like structures may provide structural support for the layers of the shoe (e.g., to limit an amount of stretching or deformation of the various layers of the shoe in response to one or more forces exerted on the shoe during a golf-related action or movement).

In some embodiments, the one or more truss-like structures may extend between (i) a rearfoot region of the golf shoe and (ii) a midfoot region of the golf shoe. In some embodiments, the one or more truss-like structures may extend between (i) a rearfoot region of the golf shoe and (ii) a forefoot region of the golf shoe. In some embodiments, the one or more truss-like structures may extend between (i) a midfoot region of the golf shoe and (ii) a forefoot region of the golf shoe.

In some embodiments, the frame structure 920 may be symmetric (i.e., the size and/or shape of the frame structure on the medial and lateral sides of the shoe may be the same or similar). In other embodiments (e.g., as shown in FIGS. 9 and 10), the frame structure 920 may be asymmetric. For example, the frame structure 920 may have different frame configurations on a medial side and a lateral side of the golf shoe. In some cases, the lateral portion of the frame structure 920 and the medial portion of the frame structure 920 may comprise a different number of truss-like structures, a different number of openings or windows, and/or different structural configurations. In some cases, the lateral portion of the frame structure 920 and the medial portion of the frame structure 920 may have different sizes, shapes, and/or dimensions. In some cases, the lateral portion of the frame structure 920 and the medial portion of the frame structure 920 may extend across or cover different regions of the upper.

Lightweight Frame

In some embodiments, the frame structure 920 may comprise a lightweight frame structure. In some cases, the lightweight frame structure may be at most about 250 grams (g). In some cases, the lightweight frame structure may be at most about 200 grams (g). In some cases, the lightweight frame structure may be at most about 150 grams (g). In some cases, the lightweight frame structure may be at most about 100 grams (g) or less.

Mesh Layer

In some cases, the golf shoe may comprise a mesh layer 910 comprising a first side and a second side. In some cases, a portion of the mesh layer 910 may correspond to or form a vamp piece, a quarter panel, a toe cover, or a heel counter of the golf shoe. In some cases, the mesh layer 910 may comprise a layer of the shoe that is directly exposed to an environment external to the shoe.

In some cases, the first side of the mesh layer 910 may be attached or coupled to the membrane layer 940 and/or the frame structure 920 of the shoe. In some cases, the second side of the mesh layer 910 may be connected to the saddle 930 of the golf shoe.

In some embodiments, the mesh layer 910 can be positioned between (i) the saddle 930 of the golf shoe and (ii) the internal frame structure 920 or the membrane layer 940. In some embodiments, the mesh layer 910 and the internal frame structure 920 can be positioned between (i) the membrane layer 940 and (ii) the saddle 930 of the golf shoe.

Optical Properties

In some embodiments, at least a portion of the mesh layer may be fully transparent (i.e., all light may pass through the layers). In some cases, the mesh layer may be translucent (i.e., some light may pass through the layers). In some cases, the mesh layer may be fully opaque (i.e., no light can pass through the layers). In some embodiments, the transparency, translucence, and/or opacity of the mesh layer may be adjusted depending on a subject's preference, for aesthetic reasons, and/or for performance benefits. In some cases, the performance benefits may include reducing or preventing discoloration or wear. In some cases, the performance benefits may include regulating a movement of fluids, vapors, or gases through or across the mesh layer. In some cases, the performance benefits may include regulating a transfer of thermal energy across the mesh layer.

In some embodiments, the mesh layer may have a different transparency, translucence, and/or opacity than other layers of the shoe. For example, the mesh layer and the membrane layer may have different transparencies, translucencies, and/or opacities. The different transparencies, translucencies, and/or opacities can collectively provide a desired aesthetic appearance and/or one or more desirable performance benefits. In some cases, the one or more desirable performance benefits may include resistance to wear or discoloration due to exposure to sunlight or UV rays. In some cases, the one or more desirable performance benefits may include an ability to regulate a movement of fluids, vapors, or gases through or across the mesh or membrane layer. In some cases, the performance benefits may include an ability to regulate a transfer of thermal energy across the mesh or membrane layer.

Saddle

In some cases, the golf shoe may comprise a saddle 930 connected to the second side of the mesh layer. In some cases, the saddle 930 may comprise one or more panels, pieces, or layers of material extending across the upper. In some cases, the one or more panels, pieces, or layers of material may extend across at least a midfoot portion of the upper. In some cases, a first portion of the saddle 930 may extend along a lateral side of the upper, and a second portion of the saddle 930 may extend along a medial side of the upper. In some cases, the first and second portions of the saddle 930 may be attached at or near a toe region of the upper. In some cases, the first and second portions of the saddle 930 may not or need not be attached at or near the heel region of the upper.

In some embodiments, the saddle 930 may be configured to interface with the laces of the shoe. In some cases, the saddle 930 may be configured to couple to the laces of the shoe so that the saddle 930 can be secured around a subject's foot when the laces are tightened. In some cases, the saddle 930 may be configured to manage or control the direction in which the laces are routed across the upper of the shoe.

Ankle Pads

In some embodiments, the golf shoe may further comprise one or more TPU foam ankle pads 955 attached or coupled to the membrane layer 940. The one or more TPU foam ankle pads 955 may be configured to cushion or support an ankle region of the subject's foot.

In other embodiments, the golf shoe may not or need not comprise any TPU foam ankle pads. For example, in some alternative embodiments, the golf shoe may comprise an air pocket or an air bladder that supports or cushions an ankle region of the subject's foot (in lieu of any foam components). In some cases, the air pocket or air bladder may be formed between two or more layers of the golf shoe. In some cases, the two or more layers may include the membrane layer, the mesh layer, the frame structure, and/or the saddle of the golf shoe.

Heel Components

In some embodiments, the golf shoe may further comprise one or more TPU heel components 951 attached to the membrane layer 940. In some cases, the TPU heel components 951 may be hot melted to the membrane layer 940. In some cases, the TPU heel components 951 may comprise a piece, layer, or panel of recyclable material configured to structure or support the heel region of the shoe.

Toe Component

In some embodiments, the golf shoe may further comprise one or more TPU toe components 952 attached to a forefoot region of the mesh layer or the membrane layer. In some cases, the one or more TPU toe components 952 may be hot melted to the mesh layer 910 (e.g., the first or second side of the mesh layer 910). In some cases, the one or more TPU toe components 952 may be hot melted to the membrane layer 940. In some cases, the one or more TPU toe components 952 may comprise a piece, layer, or panel of recyclable material configured to structure or support the toe region of the shoe.

Collar

In some embodiments, the golf shoe may further comprise a TPU collar material 954 attached to the upper. In some cases, the TPU collar material 954 may be hot melted to the upper. In some cases, the TPU collar material 954 may form, shape, structure, or line a portion of the collar of the shoe.

Eyelets

In some embodiments, the golf shoe may further comprise one or more eyelets 953. In some cases, the one or more eyelets 953 may comprise a recyclable component configured to receive or interface with one or more fastening mechanisms. The fastening mechanisms may include, for example, laces, cables, fiber, or other elongated structures that can flexibly couple two or more pieces, layers, or panels of the shoe. In some embodiments, the eyelets 953 may be attached to the saddle 930 of the shoe. In some embodiments, the eyelets 953 may be hot melted to the saddle 930. In some embodiments, the eyelets 953 may be hot melted to another layer of material forming the upper or a portion thereof.

Laces

In some embodiments, the golf shoe may comprise one or more laces threaded through the one or more eyelets. The one or more laces may comprise a recyclable material as described elsewhere herein. In some cases, the one or more laces may comprise a plurality of welded layers of a TPU material. The plurality of welded layers may collectively enhance the tensile strength of the laces.

In some cases, the one or more laces have a tensile strength ranging from about 1 kilopascal (kPa) to about 1 megapascal (MPa). In some cases, the tensile strength of the laces may be less than 1 kPa. In some cases, the tensile strength of the laces may be greater than 1 MPa.

Figure 12:
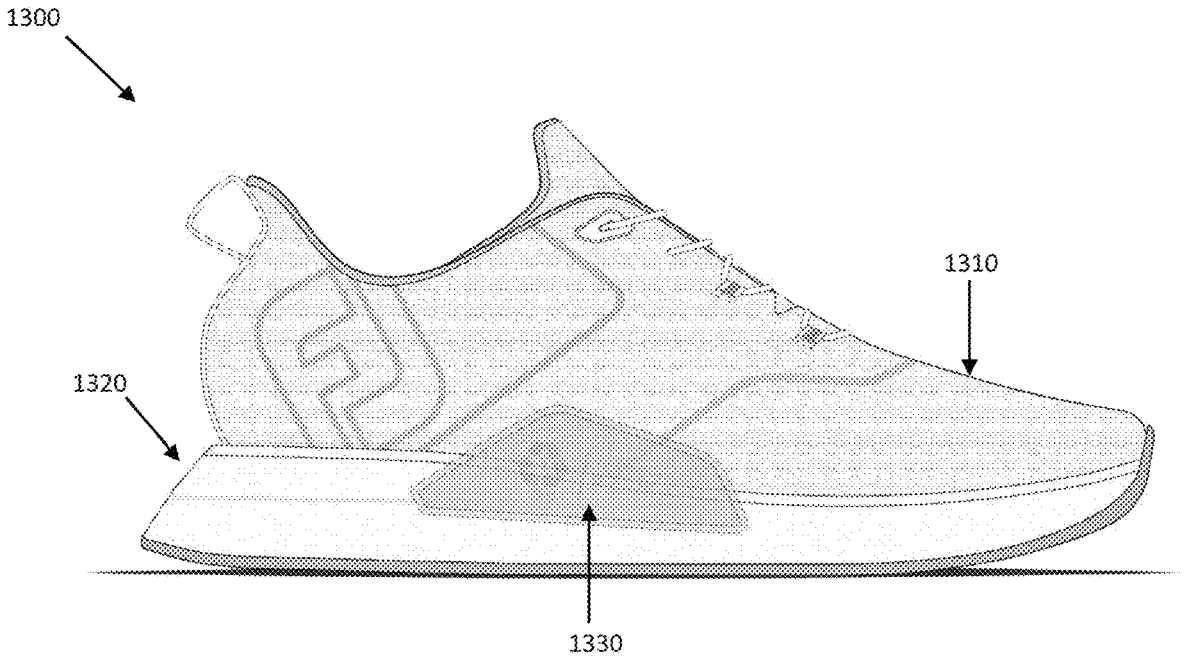
FIGS. 12 and 13 schematically illustrate various additional examples of a recyclable golf shoe, in accordance with some embodiments.
Figure 13:
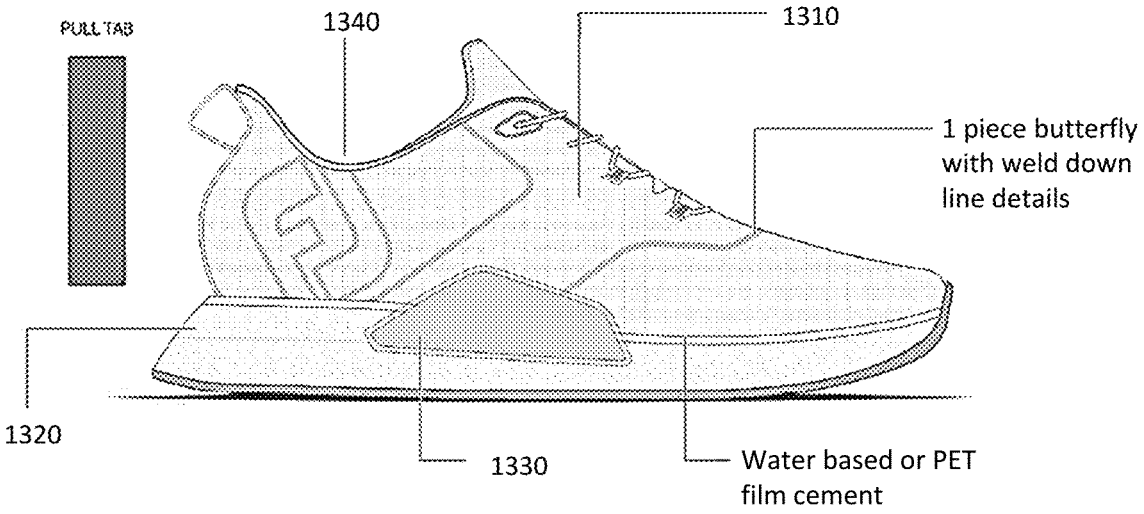

FIGS. 12 and 13 schematically illustrate another example of a recyclable golf shoe 1300 comprising a recyclable material. In some cases, the recyclable material may include a TPU-based recyclable material as described elsewhere herein. In some embodiments, the recyclable golf shoe 1300 may comprise an upper 1310 comprising a TPU mesh material. In some embodiments, the recyclable golf shoe 1300 may comprise a sole assembly 1320 comprising a TPU foam material. In some non-limiting embodiments, the sole assembly 1320 may comprise a die cut wedge sole formed from a TPU sheet foam material.

In some non-limiting embodiments, the recyclable golf shoe 1300 may comprise a mesh liner 1340 extending around an opening of the shoe. In some case, the mesh liner 1340 may comprise a recyclable material (e.g., a TPU-based recyclable material).

In some non-limiting embodiments, the recyclable golf shoe 1300 may comprise a weld down line detail. In some cases, the weld down line detail may extend across the upper of the shoe (e.g., from a medial side to a lateral side of the shoe). In some cases, the weld down line detail may extend from a forefoot region of the shoe to a midfoot region of the shoe. In some cases, the weld down line detail may extend from a midfoot region of the shoe to a rearfoot region of the shoe. In some cases, the weld down line detail may extend between the forefoot region and the rearfoot region of the shoe.

Footbed

In some embodiments, the recyclable golf shoe may comprise a footbed for supporting the subject's foot. The footbed may be insertable into and/or removable from the interior region of the shoe. In some cases, the footbed may comprise a die cut TPU sheet foam. In other cases, the footbed may comprise a molded footbed. In some cases, the footbed may be molded using the same molding process and/or the same source materials as the midsole.

Stability Clip

In some embodiments, the recyclable golf shoe 1300 may comprise a stability clip 1330. In some cases, the stability clip 1330 may be provided on a medial side and/or a lateral side of the golf shoe 1300. In some embodiments, the stability clip 1330 may comprise a recyclable material as described elsewhere herein. In some non-limiting embodiments, the stability clip 1330 may comprise an injected TPU stability clip comprising a recyclable TPU-based material.

Figure 14:
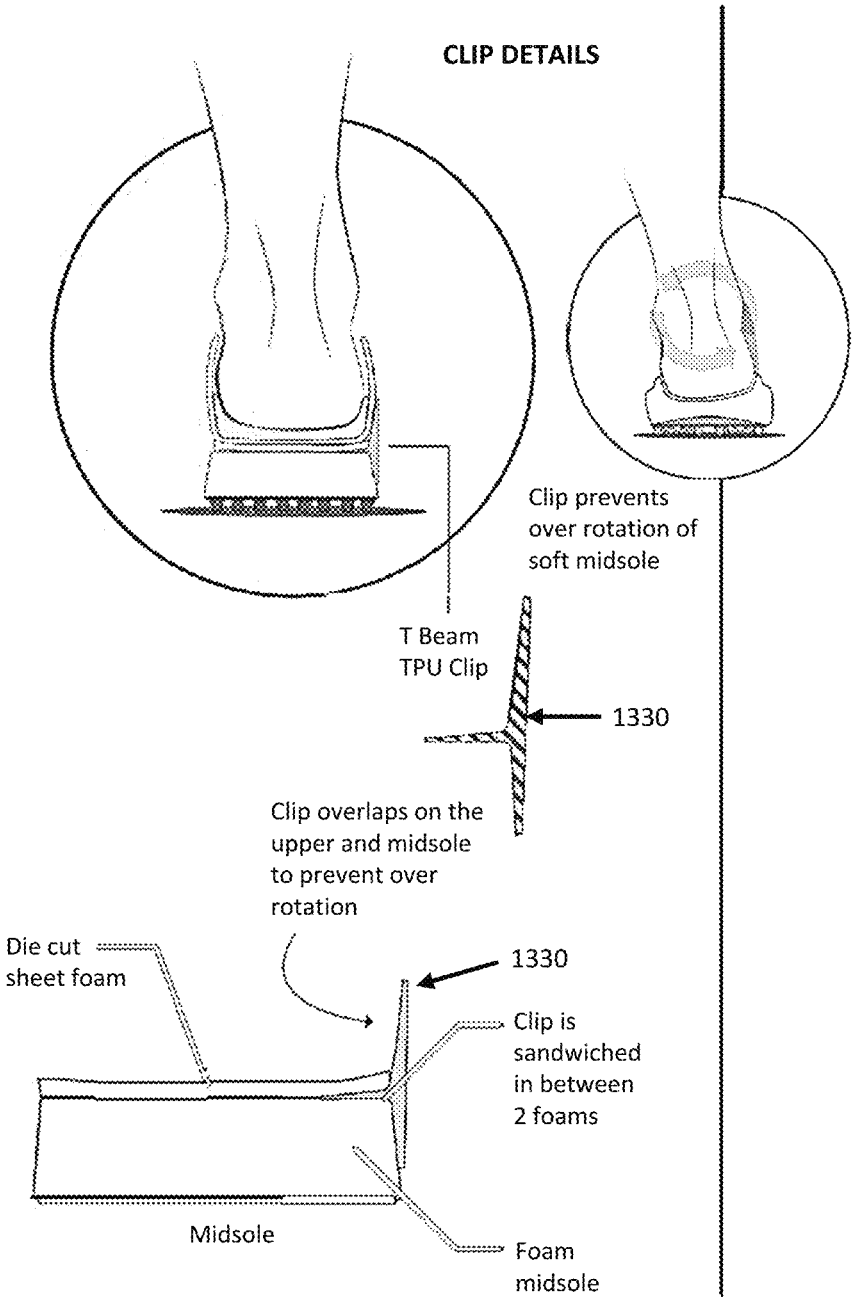
FIG. 14 schematically illustrates an example of a stability clip for a high performance recyclable golf shoe, in accordance with some embodiments.

FIG. 14 schematically illustrates an exemplary stability clip 1330 that can be used with the recyclable golf shoes of the present disclosure. In some embodiments, the stability clip 1330 may comprise a sidewall and a beam extending laterally from the sidewall. In some embodiments, the beam and the sidewall may collectively form a T-shape. In some embodiments, the beam may comprise a tapered end or a pointed edge.

In some embodiments, the stability clip 1330 may be insertable between the footbed of the shoe and a midsole portion of the sole assembly to control a movement or a deformation of the midsole portion in response to one or more forces exerted on the golf shoe. In some cases, the stability clip 1330 may be configured as a support structure that extends over the midsole and under the footbed to prevent over rotation (e.g., due to a deformation of the relatively soft material of the midsole during a golf-related action or movement).

Figure 15:
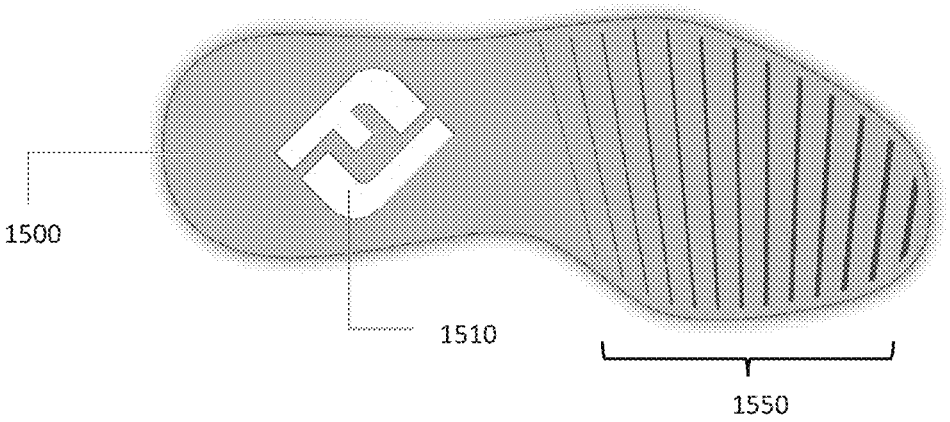
FIG. 15 schematically illustrates an alternative exemplary outsole for a casual recyclable golf shoe, in accordance with some embodiments.

FIG. 15 illustrates an example of an outsole 1500 that can be utilized with the recyclable shoes of the present disclosure. In some embodiments, the outsole 1500 may be configured for a casual golf shoe. In some embodiments, the outsole 1500 may be integrated with a sole assembly of a casual golf shoe. In some embodiments, the outsole 1500 may comprise a recyclable material. In some cases, the recyclable material may comprise, for example, a TPU sheet foam material. In some embodiments, the outsole 1500 may comprise a die cut slab.

In some non-limiting embodiments, the outsole 1500 may comprise a window 1510. In some embodiments, the window 1510 may comprise a die cut open window. In some embodiments, the window 1510 may comprise an opening or a transparent material that reveals an underlying outsole or midsole material of the shoe.

In some cases, a logo may be cut into the outsole. In other cases, a portion of the outsole material may be cut, excised, or removed to form a window in the shape of a desired logo.

In some embodiments, the outsole 1500 may comprise one or more traction elements 1550. In some cases, the one or more traction elements 1550 may comprise one or more grooves or ridges extending between the medial side and the lateral side of the shoe. In some cases, the one or more traction elements 1550 may comprise one or more traction members extending from the outsole 1500 towards a ground surface under the outsole 1500. In some cases, the one or more traction members may comprise a plurality of protrusions or projections extending across the outsole 1500. In some cases, the plurality of protrusions or projections may have different sizes, shapes, and/or angular orientations. Other types of outsole configurations and/or traction elements may be used without departing from the spirit and scope of the present disclosure, such as, for example, the outsoles and traction elements described in U.S. Patent Publication No. 2022/0175080 A1, U.S. Pat. No. 11,490,689 B2, U.S. Pat. No. 11,497,272 B2, U.S. Pat. No. 11,490,677 B2, and U.S. Pat. No. 11,019,874 B2; U.S. Pat. No. 11,425,959 B2, U.S. Pat. No. 11,425,958 B2, and U.S. patent application Ser. No. 17/360,583; U.S. Pat. No. 9,999,275 B2, U.S. Pat. No. 10,595,585 B2, and U.S. Pat. No. 10,856,613 B2; U.S. Design patent application Ser. No. 29/796,891; U.S. Patent Publication No. 2022/0408879 A1, U.S. Patent Publication No. 2022/0007792 A1, U.S. Patent Publication No. 2022/0007793 A1, and U.S. Design patent application Ser. No. 29/778,886; U.S. patent application Ser. No. 17/821,996, U.S. patent application Ser. No. 17/686,146, U.S. Design patent application Ser. No. 29/845,372, U.S. Design patent application Ser. No. 29/842,673, and U.S. Design Pat. No. D815,413 S1; U.S. Patent Publication No. 2022/0079295 A1; U.S. Pat. Nos. 5,979,083; 5,932,336 and 5,987,783; U.S. Patent Publication No. 2018/0084862 A1; U.S. Pat. No. 6,708,426 B2 and U.S. Pat. No. 7,143,529 B2; U.S. Pat. No. 7,905,034 B2, U.S. Pat. No. 7,673,400 B2, and U.S. Pat. No. 8,677,657 B2; U.S. Patent Publication No. 2015/0096195 A1; and U.S. Design Patent No. D934,542 S1, the disclosures of which are incorporated herein by reference.

Removable Component

Figure 15A:
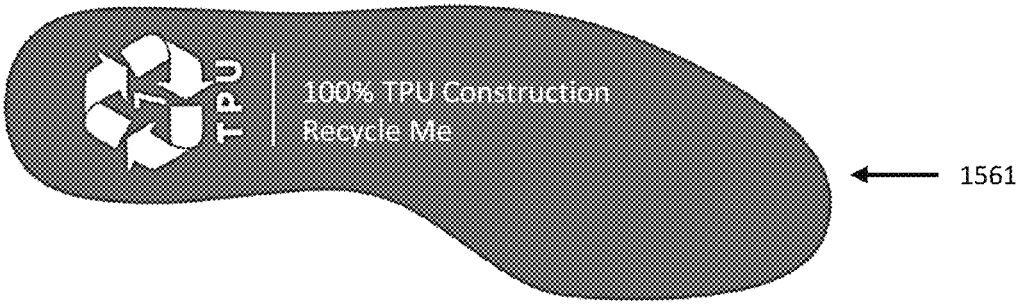
FIGS. 15A and 15B schematically illustrate various examples of a component that can be detachably coupled to or removably integrated with the recyclable golf shoes of the present disclosure.
Figure 15B:
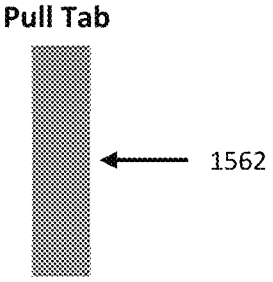

In some embodiments, the recyclable golf shoe may comprise a removable component. FIGS. 15A and 15B schematically illustrate various examples of a component that can be detachably coupled to or removably integrated with the recyclable golf shoes of the present disclosure. In some cases, the removable component may comprise a removable insole 1561 or a removable tag 1562 that can be detachably coupled to the upper or the sole assembly. In some cases, the removable component may comprise recycling instructions for the golf shoe. In some embodiments, the removable component may comprise a same or similar material as the upper or the sole assembly. In some embodiments, the removable component may comprise a different material than the upper or the sole assembly. In some embodiments, the removable component may be recyclable. In other embodiments, the removable component may not or need not be recyclable. In some alternative embodiments, a portion of the removable component may be recyclable.

In some cases, the removable component of the recyclable golf shoe may comprise a pull tab with instructions to recycle the shoe. In some cases, the pull tab may be removed before recycling the shoe. In other cases, the pull tab may not or need not be removed before recycling the shoe.

In any of the embodiments described herein, the removable component of the recyclable golf shoe may be detachably coupled to or removably integrated with the shoe. In some embodiments, the removable component may be coupled to or integrated with an upper of the shoe. In some cases, the removable component may be coupled to or integrated with a heel region of the upper. In other embodiments, the removable component may be coupled to or integrated with the sole assembly of the shoe. In some cases, the removable component may be inserted into an opening of the shoe and secured within the interior region of the shoe, between the medial and lateral sides of the shoe and/or between the anterior and posterior ends of the shoe.

Adhesives

In some embodiments, the various components or layers of the recyclable golf shoe may be attached or coupled together using a cement or an adhesive. As described elsewhere herein, the cement or adhesive may include, for example, a water-based cement or primer, a solvent-based cement or primer, or a cement or primer that is based on a recyclable material. In some cases, a TPU-based film cement may be applied to attach or couple two or more components or layers of the recyclable golf shoe.

In some embodiments, the recyclable golf shoe may comprise one or more adhesives configured to attach or couple two or more components, layers, or materials of the recyclable golf shoe. In some cases, the one or more adhesives may comprise a plurality of adhesives. In some cases, the plurality of adhesives may include water-based or solvent-based adhesives, cements, and/or primers. In some cases, the one or more adhesives may include a thermally activated adhesive, cement, or primer.

In some embodiments, the golf shoe may comprise a first cement or adhesive that is applied to or placed in contact with the sole assembly. In some cases, the first cement or adhesive may comprise a solvent cement, a solvent primer, or a hotmelt cement. In some cases, the first cement or adhesive may comprise a water based cement or a water based primer. In some cases, the first cement or adhesive may comprise a TPU-based cement, primer, or adhesive.

In some embodiments, the golf shoe may comprise a second cement or adhesive that is applied to or placed in contact with a component, a layer, or a material of the upper. In some cases, the second cement or adhesive may comprise a solvent cement, a solvent primer, a hotmelt cement, a water based cement, or a water based primer. In some cases, the second cement or adhesive may comprise a TPU-based cement, primer, or adhesive.

In some cases, the first cement or adhesive and/or the second cement or adhesive may be configured to evaporate during a chemical recycling process that yields at least one recycled or recyclable material from a recycled article. In other cases, the first cement or adhesive and/or the second cement or adhesive may be recyclable and may not or need not evaporate during a chemical recycling process that yields at least one recycled or recyclable material.

In another aspect, the present disclosure provides a recyclable golf shoe comprising an upper and a sole assembly connected to the upper. The upper and/or the sole assembly may comprise a recyclable material as described elsewhere herein. In some cases, the recyclable material may comprise polyethylene terephthalate (PET) and/or any analogues or derivatives thereof. In some cases, the recyclable material may comprise a polyester-based material.

Figure 16:
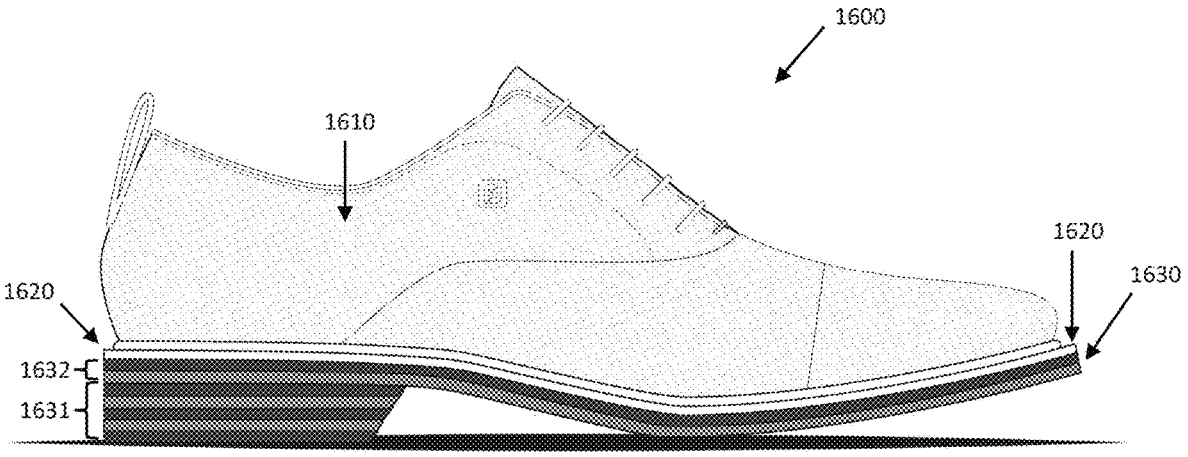
FIGS. 16 and 17 schematically illustrate various alternative embodiments of a recyclable golf shoe, in accordance with some embodiments.
Figure 17:
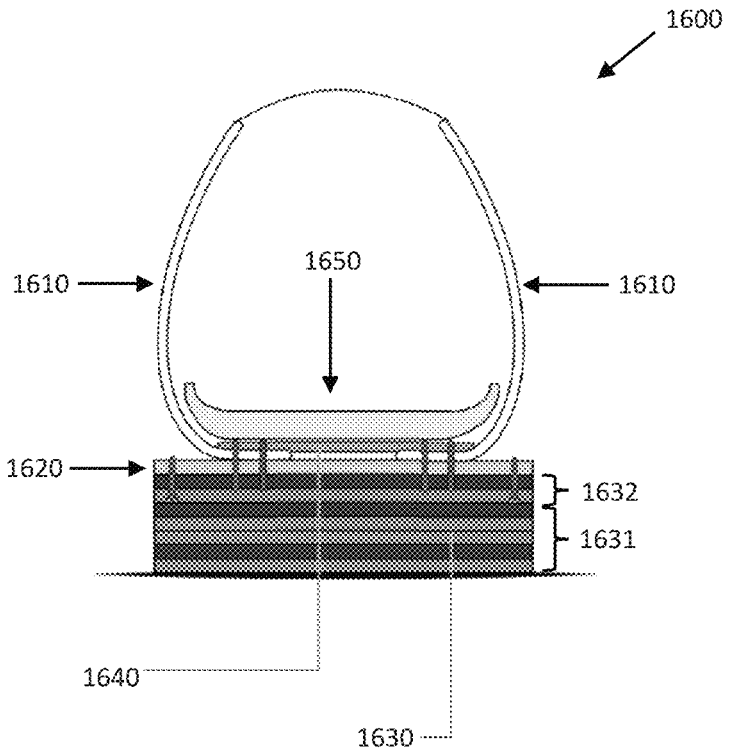

FIGS. 16 and 17 illustrate various examples of a recyclable golf shoe 1600 comprising a recyclable material. In some cases, the recyclable material may comprise a PET-based recyclable material. In some cases, the PET-based recyclable material may comprise a foamed PET material. In some cases, the foamed PET material may comprise a mechanically foamed PET material. In some cases, the recyclable golf shoe 1600 may comprise 100% PET by weight or mass.

In some embodiments, the PET-based recyclable material may comprise a material derived from a recycled article comprising at least one recyclable PET material. In some embodiments, the PET-based recyclable material may be processable into one or more articles comprising the at least one recyclable PET material. The one or more articles may include, for example, an article of footwear, an article of apparel, and/or golf-related equipment.

Shoe Structure

In some embodiments, the upper of the recyclable golf shoe 1600 may comprise a mesh layer 1610. In some embodiments, the recyclable golf shoe 1600 may comprise a support or a support plate. In some cases, the support or support plate may comprise a moderator plate 1620 that can be attached or coupled to the mesh layer 1610. In some embodiments, the recyclable golf shoe 1600 may comprise one or more foam layers 1630 extending under the moderator plate 1620. In some embodiments, the recyclable golf shoe 1600 may comprise an insole board 1640 and/or a footbed 1650 configured to support a foot of a subject wearing the recyclable golf shoe 1600.

Mesh Layer

In some embodiments, the upper may comprise a mesh layer 1610. The mesh layer 1610 may comprise one or more recyclable PET materials as described elsewhere herein. In some cases, the mesh layer 1610 may be configured to extend around the subject's foot. In some cases, the mesh layer 1610 may extend from the rearfoot region to the forefoot region of the shoe. In some cases, the mesh layer 1610 may extend along the lateral side and/or the medial side of the shoe. In some cases, the mesh layer 1610 may extend around or across a toe region of the shoe. In some cases, the mesh layer 1610 may extend around or across a heel region of the shoe. In some cases, at least a portion of the mesh layer 1610 may correspond to or form a vamp piece, a quarter panel, a toe cover, or a heel counter of the shoe.

Moderator Plate

In some embodiments, the recyclable golf shoe 1600 may comprise a moderator plate 1620. The moderator plate may comprise one or more recyclable PET materials as described elsewhere herein. The moderator plate 1620 may comprise a structural support extending under and along a bottom portion of the mesh layer 1610. In some embodiments, the moderator plate 1620 may comprise a sheet or layer of recyclable material. In some cases, the moderator plate 1620 may comprise a die cut sheet made of a recyclable material.

In some embodiments, the moderator plate 1620 may be more rigid, stiffer, stronger, and/or harder than the foam layers 1630 extending under the moderator plate 1620. In some embodiments, the moderator plate 1620 may be more rigid, stiffer, stronger, and/or harder than the mesh layer 1610 forming the upper of the recyclable golf shoe 1600.

In some embodiments, the moderator plate 1620 may comprise a flat or substantially flat surface. In other embodiments, the moderator plate 1620 may comprise a curved or sloped surface. In some alternative embodiments, the moderator plate 1620 may comprise a plurality of flat, curved, angled, and/or sloped surfaces or segments.

In some embodiments, the moderator plate 1620 may comprise a plurality of sections extending between the anterior end and the posterior end of the shoe. In some cases, the plurality of sections may have different slopes or curvatures. In some cases, the plurality of sections may include a section that is flat or substantially flat, a section that is angled or sloped, and/or a section that is curved upwards or downwards. In some cases, the plurality of sections may be configured to conform to the shape or profile of a subject's foot to enhance comfort and stability.

In some non-limiting embodiments, the moderator plate 1620 may be sloped and curved in a midfoot and/or a forefoot region of the shoe. In some cases, the moderator plate 1620 may be configured to (i) slope or curve downwards in the midfoot region of the shoe and (ii) slope or curve upwards in the forefoot region of the shoe. In some non-limiting embodiments, the moderator plate 1620 may be flat or substantially flat in a rearfoot region of the shoe.

Foam Layers

In some embodiments, the recyclable golf shoe 1600 may include a sole assembly comprising one or more foam layers. The one or more foam layers may comprise one or more recyclable PET materials as described elsewhere herein. In some cases, the one or more foam layers may comprise a plurality of foam layers 1630.

In some cases, the plurality of foam layers 1630 may comprise a first plurality of foam layers 1631 in a rearfoot region of the golf shoe. In some cases, the plurality of foam layers 1630 may comprise a second plurality of foam layers 1632 extending between the rearfoot region of the golf shoe and a forefoot region of the golf shoe. In some embodiments, the second plurality of foam layers 1632 may be positioned between the first plurality of foam layers 1631 and a moderator plate 1620 of the recyclable golf shoe. In some embodiments, the moderator plate 1620 may be positioned adjacent to the second plurality of foam layers 1632.

In some embodiments, the plurality of foam layers may comprise a plurality of stacked foam layers. In some cases, the plurality of stacked foam layers may be die cut from one or more sheets of foam and assembled together to form the sole assembly. In other embodiments, the plurality of foam layers may comprise a foamed material (e.g., a foamed PET material).

In some embodiments, the plurality of foam layers may comprise at least one foam layer with a surface that is configured to contact a ground surface underneath the shoe. In some cases, the surface may include a ground contacting surface. In some cases, the ground contacting surface may comprise one or more recyclable PET materials that are configured to grip and/or adhere to the ground surface. In some cases, the ground contacting surface may include one or more grooves or textured regions configured to engage the ground surface and provide traction by way of frictional engagement between the ground surface and the one or more grooves or textured regions. In some cases, the ground contacting surface may comprise one or more traction elements. In some cases, the one or more traction elements may comprise a plurality of protrusions or projections extending from the outsole. In some cases, the plurality of protrusions or projections may be configured to penetrate the ground surface and provide traction by way of a mechanical interlock between the ground surface and the plurality of protrusions or projections.

Insole Board

In some embodiments, the recyclable golf shoe may comprise an insole board 1640. The insole board 1640 may comprise one or more recyclable PET materials as described elsewhere herein. In some cases, the insole board 1640 may be attached or coupled to the upper. In some cases, the insole board 1640 may be attached or coupled to the moderator plate 1620 and/or the one or more foam layers 1630 extending under the moderator plate 1620. In some embodiments, the moderator plate 1620 may be attached or coupled to the insole board 1640 of the recyclable golf shoe 1600. In some embodiments, the second plurality of foam layers 1632 or the moderator plate 1620 may be coupled to the insole board 1640. In some embodiments, the second plurality of foam layers 1632 or the moderator plate 1620 may be mechanically or adhesively coupled to the insole board 1640.

In some embodiments, a portion of the mesh layer 1610 may be configured to extend under the insole board 1640. In some embodiments, a portion of the mesh layer 1610 may be configured to extend between (i) the insole board 1640 and (ii) the moderator plate 1620 of the golf shoe. In some embodiments, a portion of the mesh layer 1610 may be configured to extend between (i) the insole board 1640 and (ii) the one or more foam layers 1630 forming the midsole or outsole of the recyclable golf shoe. In some embodiments, a portion of the mesh layer 1610 may be configured to extend between (i) the insole board 1640 and (ii) the second plurality of foam layers 1632.

Footbed

In some embodiments, the recyclable golf shoe may comprise a footbed 1650 configured to support a subject's foot. In some cases, the footbed may comprise one or more recyclable PET materials as described elsewhere herein. In some cases, the footbed may comprise a PET or polyester based recyclable material.

In some embodiments, the footbed may be insertable into and/or removable from the partially enclosed interior region. In some embodiments, the footbed 1650 may be positioned inside a partially enclosed region formed by the mesh layer 1610 of the upper and the insole board 1640. In some embodiments, the footbed 1650 may be positioned above the insole board 1640. In some cases, the footbed 1650 may be secured to the mesh layer 1610. In some cases, the footbed 1650 may be secured to the insole board 1640. In some cases, the footbed 1650 may not or need not be secured to the mesh layer 1610 or the insole board 1640.

Fasteners

In some embodiments, the recyclable golf shoe may comprise one or more mechanical fasteners. In some cases, the one or more mechanical fasteners may comprise a thread or a stitch formed of a recyclable PET material. In some cases, the one or more mechanical fasteners may be configured to attach or couple the first plurality of foam layers 1631 to the second plurality of foam layers 1632 (or vice versa). In some cases, the one or more mechanical fasteners may be configured to attach or couple the first plurality of foam layers 1631 and/or the second plurality of foam layers 1632 to the moderator plate 1620.

Additional Examples

Figure 18A:
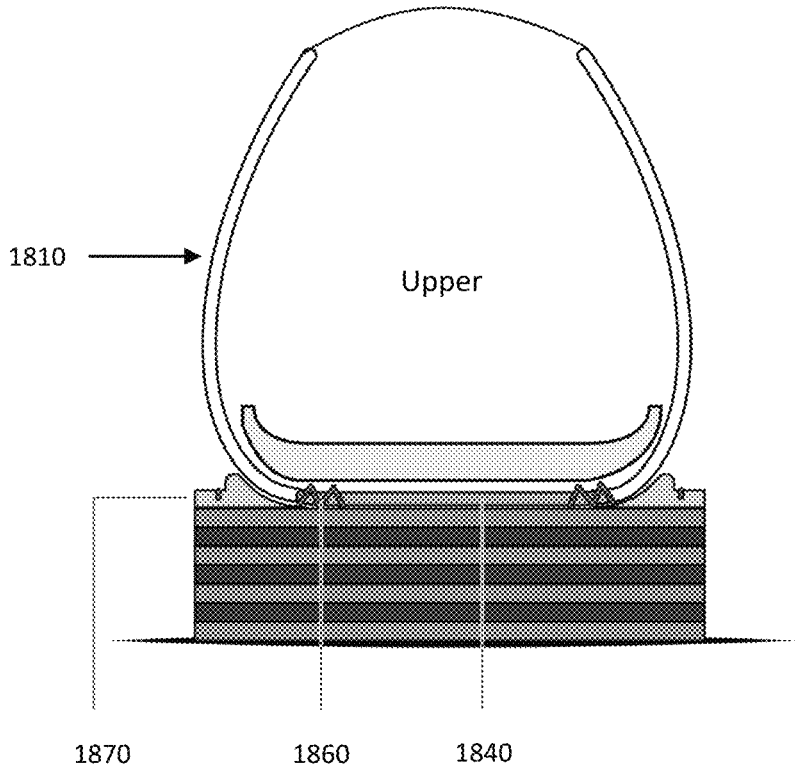
FIGS. 18A and 18B schematically illustrate additional alternative embodiments of a recyclable golf shoe, in accordance with some embodiments.
Figure 18B:
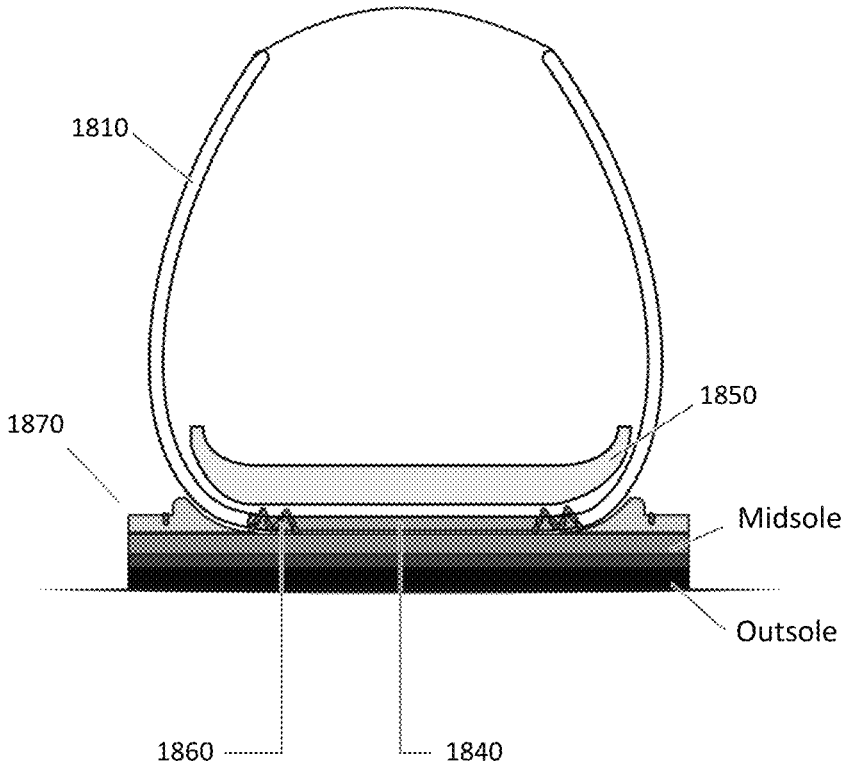

Referring now to FIGS. 18A and 18B, in some embodiments, the recyclable golf shoe may comprise a Strobel construction that can be formed by attaching the upper 1810 of the shoe to an insole component 1840 of the shoe. In some cases, the insole component 1840 may comprise a board. In some cases, the board may comprise an insole board or a strobel board.

In some non-limiting embodiments, the upper 1810 may be attached to a strobel board that is configured to cover or close off the bottom of the upper. In some embodiments, the strobel board of the shoe may be interchanged or replaced with a die cut insole board formed from a thin PET sheet. In other embodiments, the strobel board may be interchanged or replaced with a non-woven support layer comprising a recyclable material. In some cases, the recyclable material may comprise a polyester filament. In some cases, the recyclable material may comprise 100% polyester by weight or mass.

In some cases, the upper 1810 may be attached to the board using a thread 1860. In some cases, the thread 1860 may be configured to attach the bottom portion of the upper 1810 to the board in order to cover or close off the bottom opening of the upper (thereby creating a partially enclosed volume for accommodating a footbed 1850 that can support a subject's foot). In some cases, the thread 1860 may comprise a recyclable material (e.g., a recyclable polyester-based material).

In some embodiments, the recyclable golf shoe may comprise a welt construction 1870. In some cases, the welt construction 1870 may comprise a piece of material extending around the upper of the shoe. In some cases, the welt construction 1870 may be attached to the upper and/or the sole assembly of the shoe. In some cases, the welt construction 1870 may be configured to provide a plurality of attachment points for (i) coupling the upper to a portion of the sole assembly (e.g., the midsole) or (ii) coupling a portion of the sole assembly (e.g., the midsole) to the upper. In some cases, the welt construction 1870 may be configured as an intermediary component that facilitates a direct or indirect mechanical connection between the upper and the sole assembly. In some cases, the upper and/or the sole assembly may be coupled to the welt construction 1870 using a fastener or an adhesive. In some cases, the fastener may comprise a PET thread or a thread comprising a recyclable polyester-based material. In some cases, the adhesive may comprise a PET-based adhesive, a water or solvent based cement or primer, or any of the other adhesives, cements, or primers described elsewhere herein.

Figure 19:
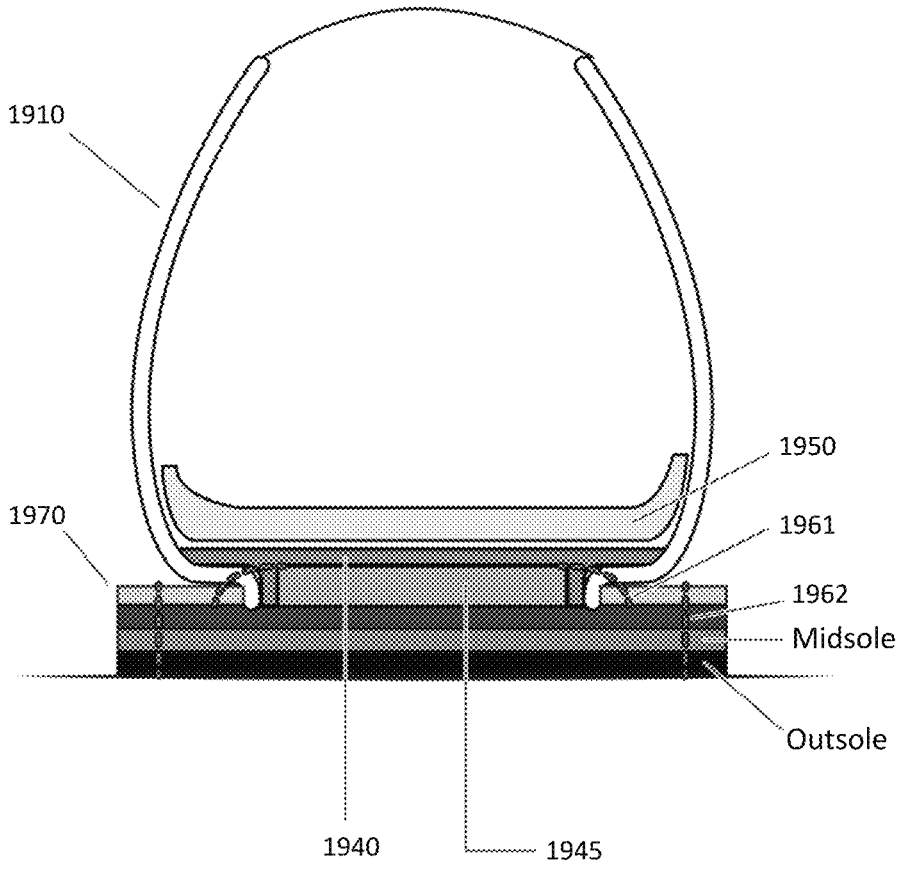
FIG. 19 schematically illustrates an example of a recyclable golf shoe with a welt construction, in accordance with some embodiments.

FIG. 19 illustrates another exemplary embodiment of a recyclable golf shoe. In some embodiments, the recyclable golf shoe may comprise an upper 1910 configured to extend around a subject's foot. In some cases, the upper 1910 may form a partially enclosed interior region configured to receive a subject's foot. In some cases, the recyclable golf shoe may comprise a footbed 1950 that is positionable within the partially enclosed interior region to provide a supportive platform for the subject's foot.

In some embodiments, the recyclable golf shoe may further comprise an insole component 1940. The insole component 1940 may be integrated with or implemented in the recyclable golf shoe in lieu of a ply rib insole which is typically or commonly used for shoes with a Goodyear welt construction. In some cases, the insole component 1940 may comprise an injection molded PET part. In some cases, the injection molded PET part may have a ply rib geometry. In some cases, the insole component 1940 may comprise an insole board. In some cases, the insole board may comprise a fiberboard insole comprising 100% polyester by weight or mass. In some cases, the fiberboard insole may comprise a plurality of polyester filaments. In some cases, the insole component 1940 may comprise a PET-based component comprising a ply rib flange. In some cases, the ply rib flange may be formed by way of a compression molding process. In some cases, the ply rib flange may be formed during a compression molding process for producing or manufacturing the fiberboard.

In some embodiments, the recyclable golf shoe may further comprise a PET foam support 1945 extending between the medial and lateral sides of the insole component 1940. The PET foam support 1945 may be integrated with or implemented in the recyclable golf shoe in lieu of a cork bed which is typically or commonly used for shoes with a Goodyear welt construction. In some cases, the PET foam support 1945 may be configured to extend between two or more vertical support columns of the insole component 1940. In some cases, the PET foam support 1945 may be positioned under or below the insole component 1940 of the recyclable golf shoe. In some cases, the PET foam support 1945 may be positioned between the insole component 1940 and a sole assembly of the recyclable golf shoe. The PET foam support 1945 may comprise a PET-based foam or any other type of recyclable foam material as described elsewhere herein.

In some embodiments, the recyclable golf shoe may comprise a welt construction 1970 extending around the shoe. The welt construction 1970 may be attached to the upper and/or the sole assembly of the golf shoe. In some cases, the welt construction 1970 may be provided along an interface between the upper and the sole assembly. In some cases, the welt construction 1970 may be disposed between the upper and the sole assembly. In some cases, the welt construction 1970 may be configured as an intermediary component that facilitates a direct or indirect mechanical connection between the upper and the sole assembly. In some non-limiting embodiments, the welt construction 1970 may comprise a PET welt comprising a recyclable PET-based material.

In some embodiments, the recyclable golf shoe may comprise a first set of stitches 1961 and a second set of stitches 1962. In some cases, the first set of stitches 1961 may be used to couple at least two of: the upper 1910, the sole assembly, the insole component 1940, the PET foam support 1945, and/or the welt construction 1970 of the recyclable golf shoe. In some cases, the second set of stitches 1962 may be used to couple at least two of: the midsole, the outsole, and/or the welt construction 1970 of the recyclable golf shoe. In some cases, the first set of stitches 1961 and the second set of stitches 1962 may be used to couple different components or combinations of components of the recyclable golf shoe. The first set of stitches 1961 and/or the second set of stitches 1962 may comprise a recyclable material as described elsewhere herein. In some non-limiting embodiments, the first set of stitches 1961 and/or the second set of stitches 1962 may comprise one or more PET-based threads.

Figure 20A:
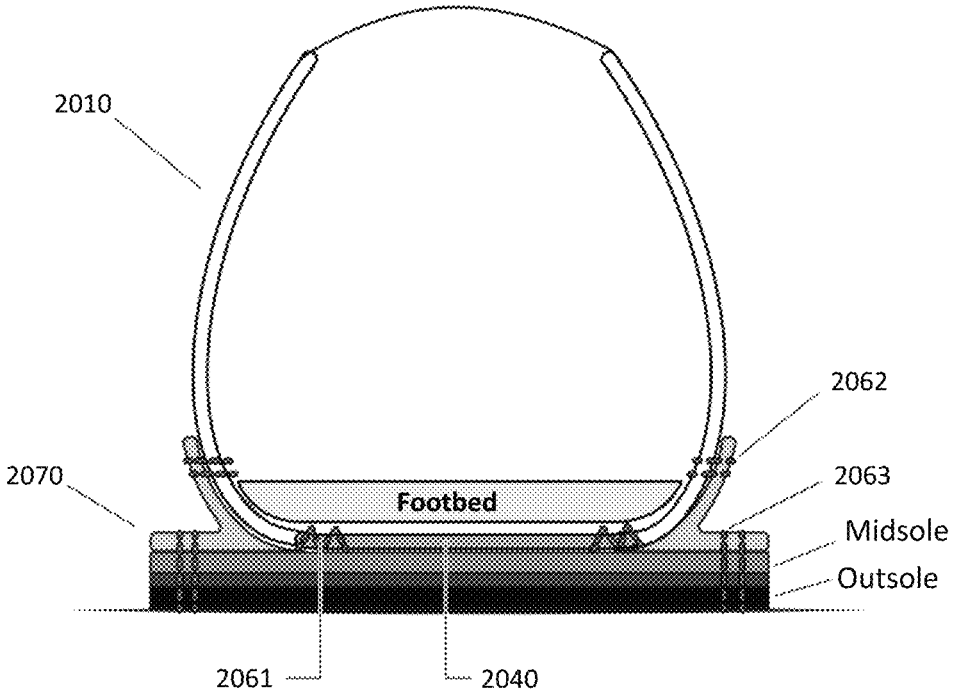
FIG. 20A schematically illustrates an example of a recyclable golf shoe with sidewall stitching, in accordance with some embodiments.
Figure 20B:
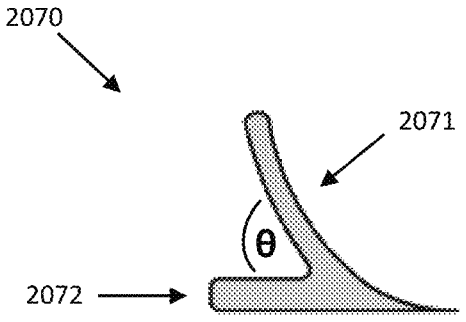
FIG. 20B schematically illustrates an example of an extruded PET welt that can be integrated with the recyclable golf shoes of the present disclosure.

Referring now to FIGS. 20A and 20B, in some embodiments, the recyclable golf shoe may comprise an extruded PET welt structure 2070. The extruded PET welt structure 2070 may permit the use of sidewall stitching to assemble the upper with the sole assembly, without using any adhesives or cements.

As shown in FIG. 20B, in some embodiments, the extruded PET welt structure 2070 may comprise a first section 2071 and a second section 2072 extending from the first section 2071. In some cases, the first section 2071 may have a curvature corresponding to a curvature, shape, or profile of the upper 2010. In some cases, the second section 2072 may be configured to extend laterally across an upper surface of the midsole of the recyclable golf shoe. In some cases, the first section 2071 and the second section 2072 may converge to form an angle θ ranging from about 10 degrees to about 90 degrees.

Referring back to FIG. 20A, in some embodiments, the upper 2010 of the recyclable golf shoe may form a partially enclosed interior region for receiving a subject's foot. In some cases, the partially enclosed interior region may be configured to accommodate a footbed for supporting the subject's foot. In some embodiments, the recyclable golf shoe may further comprise an insole component 2040 to which the bottom portion of the upper 2010 can be attached (e.g., to cover or close off the open bottom of the upper 2010). In some cases, the insole component 2040 may comprise a Strobel board. In other cases, the insole component 2040 may comprise a thin PET sheet or a non-woven material comprising 100% polyester filament. In some cases, the thin PET sheet or the non-woven material may be used in lieu of the Strobel board (i.e., the Strobel board typically or commonly used for traditional shoe constructions may be replaced with the thin PET sheet or the non-woven material comprising 100% polyester filament).

In some embodiments, the recyclable golf shoe may comprise a plurality of stitches. In some cases, the plurality of stitches may comprise a first set of stitches 2061, a second set of stitches 2062, and a third set of stitches 2063. In some cases, the first set of stitches 2061 may be used to couple the insole component 2040 to the upper 2010 or the sole assembly. In some cases, the second set of stitches 2062 may be used to couple the extruded PET welt structure 2070 directly to the upper 2010. In some cases, the second set of stitches 2062 may be provided by way of a cup sole sidewall stitching operation. In some cases, the third set of stitches 2063 may be used to couple the extruded PET welt structure 2070 to the midsole and/or the outsole of the sole assembly. In some cases, the third set of stitches 2063 may comprise a rapid stitch construction or configuration.

Figure 21:
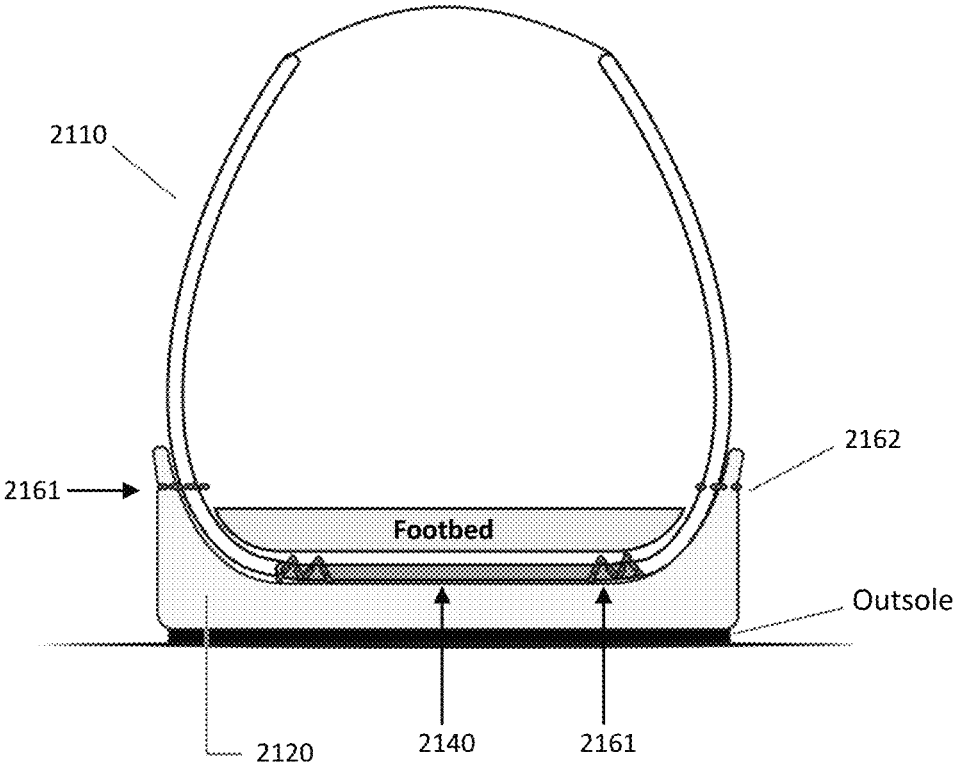
FIG. 21 schematically illustrates an example of a recyclable golf shoe with a cup sole construction, in accordance with some embodiments.

FIG. 21 illustrates another exemplary embodiment of a recyclable golf shoe comprising a cup sole construction. In some embodiments, the recyclable golf shoe may comprise an upper 2110 and a cup sole construction 2120. In some cases, the cup sole construction 2120 may extend under the upper 2110 or around a bottom portion of the upper 2110. In some cases, the cup sole construction 2120 may comprise one or more sidewalls extending up and across or over a portion of the upper 2110. In some non-limiting embodiments, the cup sole construction 2120 may comprise a PET-based foam material. In some cases, the PET-based foam material may be machined from a sheet foam or molded into the shape of the cup sole construction 2120.

In some embodiments, the recyclable golf shoe may further comprise a footbed and/or an insole component 2140. The insole component 2140 may comprise any of the insole components described elsewhere herein. In some cases, the insole component 2140 may comprise a board or a support configured to cover or close off the open bottom of the upper 2110.

In some embodiments, the recyclable golf shoe may comprise a plurality of stitches. In some cases, the plurality of stitches may comprise a first set of stitches 2161 and a second set of stitches 2162. In some cases, the first set of stitches 2161 may be used to couple the insole component 2140 to the upper 2110 and/or the sole assembly. In some cases, the second set of stitches 2162 may be used to couple the sidewalls of the cup sole construction 2120 to a portion of the upper 2110. In some cases, the second set of stitches 2162 may be provided by way of a cup sole sidewall stitching operation.

Laces

In some embodiments, the golf shoe may comprise one or more PET laces for securing the upper around a subject's foot. The one or more PET laces may comprise a recyclable PET material as described elsewhere herein. In some cases, the one or more PET laces may not or need not be removed prior to recycling the recyclable golf shoes of the present disclosure.

Removable Component

In some embodiments, the recyclable golf shoe may comprise a component that can be detachably coupled to or removably integrated with the recyclable golf shoes of the present disclosure. In some cases, the component may comprise a removable insole or a removable tag that can be detachably coupled to or removably integrated with the upper or the sole assembly. In some cases, the removable component may comprise recycling instructions for the golf shoe. In some embodiments, the removable component may comprise a same or similar material as the upper or the sole assembly. In some embodiments, the removable component may comprise a different material than the upper or the sole assembly. In some embodiments, the removable component may be recyclable. In other embodiments, the removable component may not or need not be recyclable. In some alternative embodiments, a portion of the removable component may be recyclable.

In some cases, the removable component of the recyclable golf shoe may be detachably coupled to or removably integrated with the shoe. In some embodiments, the removable component may be coupled to or integrated with an upper of the shoe. In some cases, the removable component may comprise a pull tab that can be coupled to or integrated with a heel region of the upper. In other embodiments, the removable component may be coupled to or integrated with the sole assembly of the shoe. In some cases, the removable component may comprise an insole component that can be inserted into an opening of the shoe and secured within the interior region of the shoe (e.g., between the medial and lateral sides of the shoe and/or between the anterior and posterior ends of the shoe).

Adhesives

In some embodiments, the recyclable golf shoe may comprise one or more adhesives. In some cases, the one or more adhesives may be configured to adhesively couple (i) the first plurality of foam layers to (ii) the second plurality of foam layers. In some cases, the one or more adhesives may be configured to adhesively couple (i) the first plurality of foam layers and/or the second plurality of foam layers to (ii) the moderator plate.

In some embodiments, the one or more adhesives may comprise a cement or a primer. In some cases, the cement or primer may comprise a water-based cement or primer. In other cases, the cement or primer may comprise a solvent-based cement or primer. In some cases, the cement or primer may comprise a PET-based cement or primer.

In some embodiments, the one or more adhesives may be configured to evaporate during a recycling process for the recyclable golf shoe. In some cases, the recycling process may yield at least one recyclable material. The at least one recyclable material may comprise a PET-based recyclable material that is usable to form an article or a component thereof. In other embodiments, the one or more adhesives may not or need not evaporate during a recycling process for the recyclable golf shoe.

In some cases, the one or more adhesives may not or need not be removed before the recyclable golf shoe is recycled. In some cases, the one or more adhesives may not or need not be processed separately from the other components of the recyclable golf shoe (i.e., the recyclable golf shoe may be recycled as is with the one or more adhesives applied).

Lightweight Shoe Construction

In some embodiments, the recyclable shoes of the present disclosure may utilize a lightweight construction. In some cases, the lightweight construction may help to reduce a total weight of the shoe without sacrificing or compromising the performance characteristics, the fit, or the structural integrity of the shoe.

In some embodiments, the recyclable shoes disclosed herein may incorporate a lightweight construction to keep the weight of the shoe under a predetermined threshold. In some cases, the predetermined threshold may be at most about 150 grams or less. In some cases, the predetermined threshold may be at most about 140 grams, at most about 130 grams, at most about 120 grams, at most about 110 grams, at most about 100 grams, or less than 100 grams. In some cases, the predetermined threshold may be at most about 90 grams or less, 80 grams or less, 70 grams or less, 60 grams or less, or 50 grams or less.

Methods of Manufacture

In another aspect, the present disclosure provides various methods for manufacturing and constructing the recyclable high performance golf shoes of the present disclosure. In some embodiments, the method may comprise constructing an upper. In some cases, various parts, layers, or components may be stitched, glued, or otherwise attached together to form the upper. In some embodiments, the upper may be connected or fused to a sole assembly (e.g., using a cement assembly process).

In some embodiments, the method may comprise constructing a sole assembly. In some cases, the sole assembly may comprise a midsole. In some cases, the midsole or the sole assembly may comprise a support structure or a support frame that is configured to stiffen, strengthen, secure, or stabilize one or more regions of the recyclable shoe. In some cases, the support structure or support frame can be configured to stiffen, strengthen, secure, or stabilize one or more components, parts, sections, and/or layers of the recyclable shoe. In some cases, the midsole or the sole assembly may comprise an internal structure that is integrated with or embedded in the midsole or sole assembly. The internal structure may be configured to modify or optimize a response characteristic or a property of the midsole or sole assembly during a golf-related action or movement.

In some embodiments, the method may comprise constructing an outsole. In some cases, the outsole may comprise one or more integrated traction elements. In other cases, the outsole may comprise one or more cleats or spikes and/or one or more receptacles for receiving the one or more cleats or spikes.

In some embodiments, the method may comprise assembling the outsole to the midsole to form the sole assembly. In some cases, at least a portion or a section of the bottom surface of the midsole may be bonded to a top surface of the outsole (e.g., using adhesives, glues, cements, or fasteners, or by co-molding the midsole and outsole).

In some embodiments, the method may comprise attaching the sole assembly to the upper. In some cases, prior to attachment to the sole assembly, the upper may be pulled onto a last, and a lasting board may be attached to the upper with an adhesive. The lasting board may then be attached to the sole assembly (e.g., with an adhesive, glue, or cement) to form the recyclable golf shoe.

In some alternative embodiments, the method may comprise attaching a material onto an open bottom of the upper, effectively closing off the open bottom to create a sock-like construction. In such embodiments, the sock-like construction may be directly or indirectly attached to the midsole or the sole assembly.

In some embodiments, the method may comprise integrating an insole component with the shoe. In some embodiments, the insole component may comprise an insole board or insole footbed. In some embodiments, the insole board or insole footbed may be bonded to the top surface of the midsole. In some cases, the insole board or insole footbed may be attached or otherwise fixed or coupled to a portion of the midsole using a lasting process (e.g., a single or double lasting process), a Strobel construction method, and/or a gasket hotmelt procedure.

Molding

In some embodiments, the recyclable golf shoes described herein (and any components or sub-assemblies thereof) may be manufactured using one or more molding processes. In some embodiments, various different components, parts, sections, or layers of the recyclable shoe can be molded together or separately in order to produce the recyclable shoe. In some embodiments, various different components, parts, sections, or layers of the recyclable shoe can be co-molded together to produce the recyclable shoe. The various different components, parts, sections, or layers of the recyclable shoe may include, for example, a mesh layer, a membrane layer, a hot melt backer layer, a saddle, a support frame, an internal structure, a support/moderator plate, or a foam layer of the recyclable shoe.

In some embodiments, the method may involve molding (e.g., injection molding or compression molding) the various different components, parts, sections, or layers of the recyclable shoe. In some embodiments, a molding agent and/or a foaming agent may be provided to a mold by way of a single shot operation (e.g., a single shot injection) or a multi-shot operation (e.g., a multi shot injection). In some embodiments, the molding agent and/or the foaming agent may be poured or flowed into the mold. In some embodiments, the molding agent and/or the foaming agent may be injected into a single location or region in the mold. In other embodiments, the molding agent and/or the foaming agent may be injected into multiple locations or regions in the mold. In some cases, the molding agent and/or the foaming agent may be injected into the multiple locations or regions in the mold simultaneously or concurrently. In other cases, the molding agent and/or the foaming agent may be injected into multiple locations or regions in the mold in series or in succession.

In some embodiments, at least a portion of the recyclable golf shoe may comprise two or more distinct parts that are formed and/or integrated together in one or more molding operations. The two or more distinct parts may include, for example, a component, section, layer, or sub-assembly of the recyclable golf shoe. In some cases, the two or more distinct parts may comprise parts that have different material properties. In some cases, the two or more distinct parts may comprise parts that are made of different materials and/or made at different times or using different processes.

Stock Fitting

In some non-limiting embodiments, the various components, parts, sections, and/or layers of the recyclable shoe can be integrated by way of a stock fitting process. In some cases, the stock fitting process may involve a manual integration of two or more components, parts, sections, and/or layers. In other cases, the stock fitting process may involve an automated or semi-automated integration of the components, parts, sections, and/or layers of the recyclable shoe. In some embodiments, the stock fitting process may involve coupling two or more components, parts, sections, and/or layers using one or more adhesives.

In some non-limiting embodiments, the various components, sections, layers, or portions of the recyclable golf shoe may be assembled by way of a stocking fitting process. For example, a first component, part, section, and/or layer can be manufactured and stock fit with a second component, part, section, and/or layer to produce either an intermediate assembly or a final part (e.g., a recyclable high performance shoe that is optimized to enhance a particular subject's anatomy and/or swing biomechanics).

Recyclable Golf Bag

In another aspect, the present disclosure provides various non-limiting examples of a recyclable golf article. In some embodiments, the recyclable golf article may comprise a recyclable golf bag.

Figure 22:
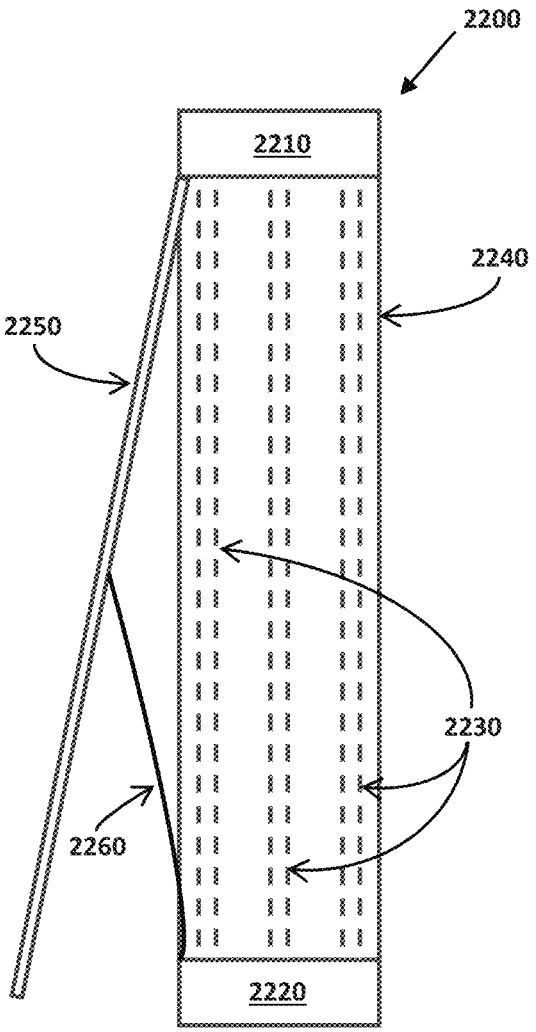
FIG. 22 schematically illustrates an example of a recyclable golf bag, in accordance with some embodiments of the present disclosure.

FIG. 22 schematically illustrates an example of a recyclable golf bag 2200 according to various embodiments of the present disclosure. In some embodiments, the recyclable golf bag 2200 may comprise a plurality of recyclable components.

In some embodiments, the plurality of recyclable components may include a top cuff or collar 2210 comprising a recyclable material. In some embodiments, the top cuff or collar 2210 may form a top opening of the golf bag.

In some embodiments, the top cuff or collar 2210 may include a divider assembly comprising one or more dividers formed of a recyclable material. In some embodiments, the one or more dividers may be configured to divide the top opening formed by the top cuff or collar 2210 into a plurality of discrete openings each configured to receive one or more golf clubs.

In some embodiments, the plurality of recyclable components may include a bottom base assembly 2220. The bottom base assembly 2220 may be disposed on an opposite end of the top cuff or collar 2210. In some cases, the bottom base assembly 2220 may comprise a support formed of a recyclable material. In some cases, the support may comprise a hinged construction or a flexible construction that allows a first portion of the bottom base assembly 2220 to rotate, pivot, or articulate relative to a second portion of the bottom base assembly 2220.

In some embodiments, the plurality of recyclable components may include a frame structure 2230 for the golf bag. In some cases, the frame structure 2230 may comprise an internal frame structure or an external frame structure that is configured to support or stiffen a body portion of the recyclable golf bag. In some cases, the internal or external frame structure may comprise a recyclable material.

In some embodiments, the plurality of recyclable components may include one or more body panels 2240 for the golf bag. In some cases, the one or more body panels 2240 may be configured to extend around the frame structure 2230 of the golf bag. In some cases, the one or more body panels 2240 may be configured to extend between the top cuff or collar 2210 and the bottom base assembly 2220 of the golf bag. In some cases, the one or more body panels 2240 may be configured to form a partially enclosed region that is accessible via the top opening formed by the top cuff or collar 2210. In some cases, the one or more body panels 2240 may include a recyclable fabric layer comprising a recyclable material.

In some embodiments, the plurality of recyclable components may include a leg assembly 2250 comprising one or more legs for supporting the golf bag. In some cases, the one or more legs may be extended and/or retracted to support the golf bag in a plurality of different upright, angled, and/or tilted positions. In some cases, the leg assembly 2250 may comprise a recyclable material.

In some embodiments, the plurality of recyclable components may comprise an actuator rod assembly 2260 that operatively couples the leg assembly 2250 and the bottom base assembly 2220 of the golf bag. In some cases, the actuator rod assembly 2260 may comprise one or more recyclable materials.

In some embodiments, the plurality of recyclable components may include one or more recyclable fasteners for attaching two or more components of the golf bag together. In some embodiments, the plurality of recyclable fasteners may be configured to detachably secure at least two of (i) the top cuff or collar 2210, (ii) the bottom base assembly 2220, (iii) the frame structure 2230, (iv) the recyclable fabric layer of the one or more body panels 2240, (v) the leg assembly 2250, and (vi) the actuator rod assembly 2260 to facilitate disassembly or deconstruction of the golf bag for recycling. In some cases, the one or more recyclable fasteners may comprise any of the recyclable materials described herein.

Recyclable Material

In some embodiments, the components of the golf bag may include one or more recyclable materials. In some cases, the one or more recyclable materials may comprise a recyclable thermoplastic material. In some cases, the recyclable thermoplastic material may comprise a recyclable polyurethane material. In some cases, the recyclable polyurethane material may comprise a recyclable thermoplastic polyurethane (TPU) material.

In some embodiments, the components of the golf bag may comprise one or more same recyclable materials. In other embodiments, the components of the golf bag may comprise a plurality of different recyclable materials. In some cases, the plurality of different recyclable materials may have a similar chemical composition or structure. In other cases, the plurality of different recyclable materials may have different chemical compositions or structures. In some cases, the plurality of different recyclable materials may be recycled using a same recycling process. In other cases, the plurality of different recyclable materials may be recycled using a plurality of different recycling processes.

In some embodiments, the components of the golf bag may comprise one or more recyclable materials having a material composition comprising at least a threshold amount of a recyclable material. In some cases, the threshold amount may be at least about 90% of the recyclable material by weight or mass. In some cases, the threshold amount may be at least about 95% of the recyclable material by weight or mass. In some cases, the threshold amount may be at least about 99% of the recyclable material by weight or mass.

In some embodiments, the components of the golf bag may be recyclable into a source material for producing a golf article. In some cases, the golf article may comprise, for example, a golf shoe, a golf club, a golf ball, another golf bag, a piece of golf apparel, and/or a piece of golf equipment.

Top Collar

In some embodiments, the golf bag may comprise a top cuff or collar. In some cases, the top cuff or collar may form a top opening of the golf bag. In some cases, the top cuff or collar may include one or more dividers extending across the top opening to divide the top opening into a plurality of openings for receiving golf equipment. In some cases, the one or more dividers may be integrated with the top cuff or collar. In other cases, the one or more dividers may be detachably coupled to the top cuff or collar.

Bottom Base

In some embodiments, the golf bag may comprise a bottom base opposing the top cuff or collar. In some cases, the bottom base may include a support structure that is configured to contact a ground surface under the golf bag. In some cases, the bottom base may comprise an articulating portion that is configured to pivot or rotate relative to another portion of the bottom base.

Wheels

In some non-limiting embodiments, the bottom base may comprise one or more wheels or rollers for enhancing or facilitating a transportability of the golf bag. In some cases, the one or more wheels or rollers may have a fixed position and/or orientation relative to the bottom base of the golf bag. In some cases, the one or more wheels or rollers may be configured to rotate about one or more fixed or predetermined axes. In some cases, the one or more wheels or rollers may be configured to swivel about a lateral or vertical axis to adjust a direction in which the golf bag can be rolled. In some cases, the lateral or vertical axis may be different than the one or more fixed or predetermined axes. In some cases, the one or more wheels or rollers may be configured to pivot or articulate about another axis that is different than (i) the lateral or vertical axis and/or (ii) the one or more fixed or predetermined axes.

In some non-limiting embodiments, the golf bag may comprise one or more wheels or rollers that are fixed or coupled to a movable component of the golf bag. In some cases, the movable component may include an articulating arm or leg that is configured to extend the one or more wheels or rollers away from the bag so that the golf bag can be rolled while in a tilted configuration. In some cases, the articulating arm or leg may be configured to retract the one or more wheels or rollers back towards the bag so that the golf bag can be stored or transported in an upright configuration.

In some embodiments, the golf bag may comprise a plurality of wheels or rollers. In some cases, the plurality of wheels or rollers may include a first set of wheels or rollers disposed on or attached to the bottom base of the golf bag, and a second set of wheels or rollers disposed on or attached to an articulating arm or leg of the golf bag. In some cases, the first set of wheels or rollers may be used to roll the golf bag in a desired direction when the golf bag is in an upright configuration and/or when the golf bag is in a tilted configuration. In some cases, the first set of wheels or rollers may be positioned at or near a perimeter or an edge of the bottom base so that the bag can be rolled in a desired direction when the bag is in either an upright configuration or a tilted configuration. In some cases, the second set of wheels or rollers may be used to roll the golf bag in a desired direction when the golf bag is in an upright configuration and/or when the golf bag is in a tilted configuration. In some cases, the second set of wheels or rollers may be positioned at or near a distal end of the articulating arm or leg so that the second set of wheels or rollers can contact the ground surface under the golf bag when the golf bag is in either the tilted configuration or the upright configuration.

Internal Frame Structure

Figure 23A:
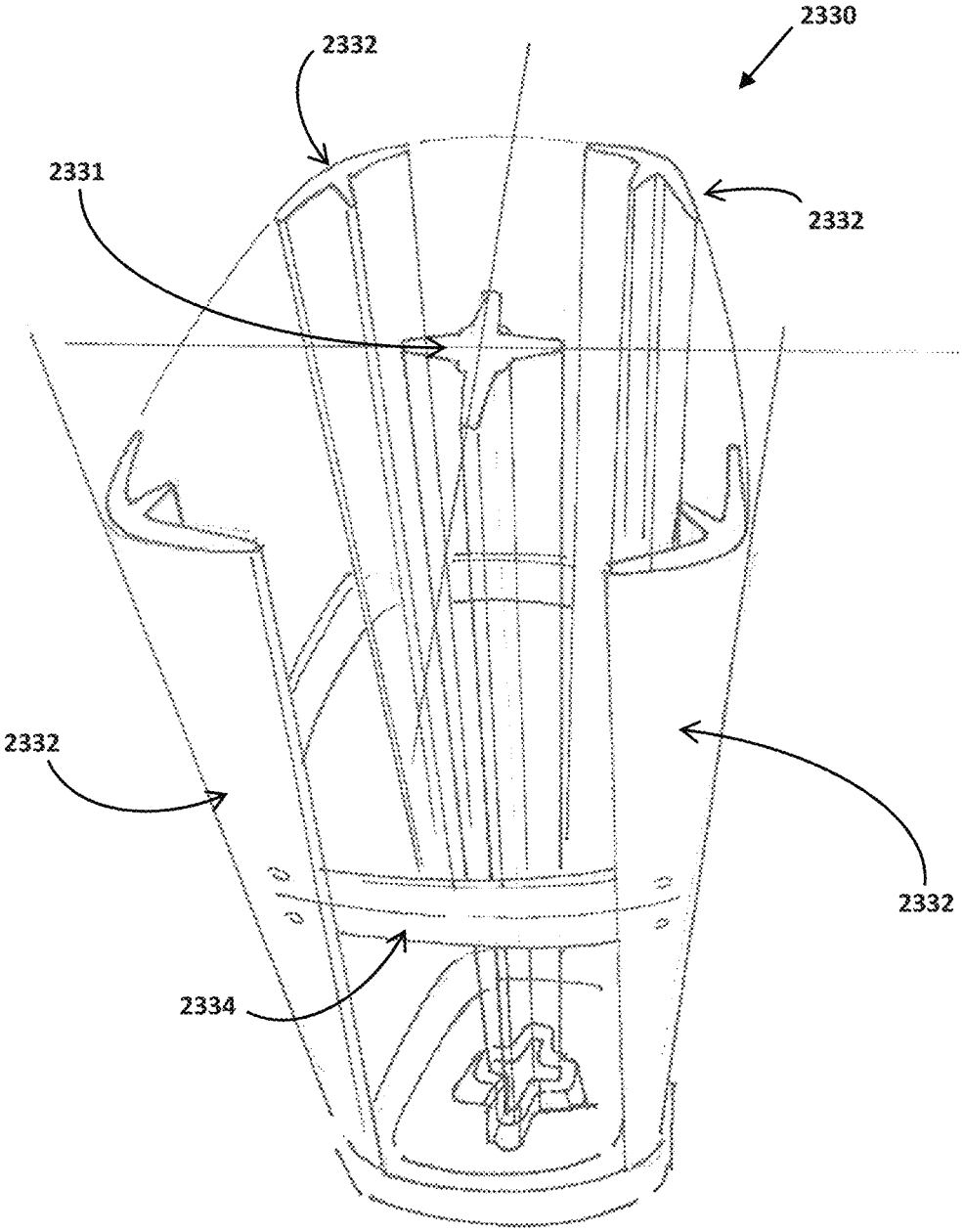
FIGS. 23A-23D schematically illustrate various non-limiting examples of a frame structure for a recyclable golf bag, in accordance with some embodiments.

Referring to FIG. 23A, in some embodiments, the golf bag may comprise a frame structure 2330 extending between the top cuff or collar and the bottom base of the golf bag. In some embodiments, the frame structure 2330 may comprise an external frame structure configured to extend across, along, or over an outer surface of the body panels of the golf bag. In other embodiments, the frame structure 2330 may comprise an internal frame structure configured to extend internally within the partially enclosed interior region formed by the body panels, the top cuff or collar, and the bottom base assembly of the golf bag.

In some embodiments, the golf bag may comprise an internal frame structure extending between the bottom base and the top cuff or collar. In some embodiments, the internal frame structure may comprise a central support 2331 extending along a central axis of the golf bag. In some cases, the central axis may extend vertically between a central region of the bottom base assembly and a central region of the top cuff or collar. In some cases, the central region may include a midpoint corresponding to a geometric center or a center of mass of the bottom base or the top cuff or collar. In some cases, the central support 2331 may comprise a first end that is configured to engage or interface with the top cuff or collar of the bag and a second end that is configured to engage or interface with the bottom base of the bag. In some cases, the second end of the central support 2331 may be slotted into a receptacle provided on a top surface of the bottom base. In some cases, the receptacle may be recessed into the top surface of the bottom base. In other cases, the receptacle may be formed within a protruding portion of the bottom base that extends upwards from the top surface of the bottom base.

In some embodiments, the central support of the frame structure may comprise one or more beams, struts, and/or rods extending along the central axis between the top cuff or collar and the bottom base of the golf bag. In some cases, the central support 2331 may have a T-shaped cross section. In some cases, the central support 2331 may have a double T-shaped cross-sectional shape. In some cases, the central support 2331 may have an X-shaped cross-sectional shape. In some cases, the T-shaped cross-sectional shape, the double T-shaped cross-sectional shape, or the X-shaped cross-sectional shape may be configured to enhance the stiffness and/or the rigidity of the central support 2331.

In some embodiments, the internal frame structure may further comprise a plurality of structural supports 2332 arranged around the central support. In some cases, the plurality of structural supports 2332 may comprise a T-frame structure. In some cases, the T-frame structure may comprise a curved outer edge, perimeter, or profile.

In some embodiments, the internal frame structure may further comprise a lateral support structure 2334 extending laterally along or around a midsection of the internal frame structure. In some embodiments, the lateral support structure 2334 may be detachably coupled to the plurality of structural supports 2332 to further stiffen and/or strengthen the mid-section of the golf bag.

Figure 23B:
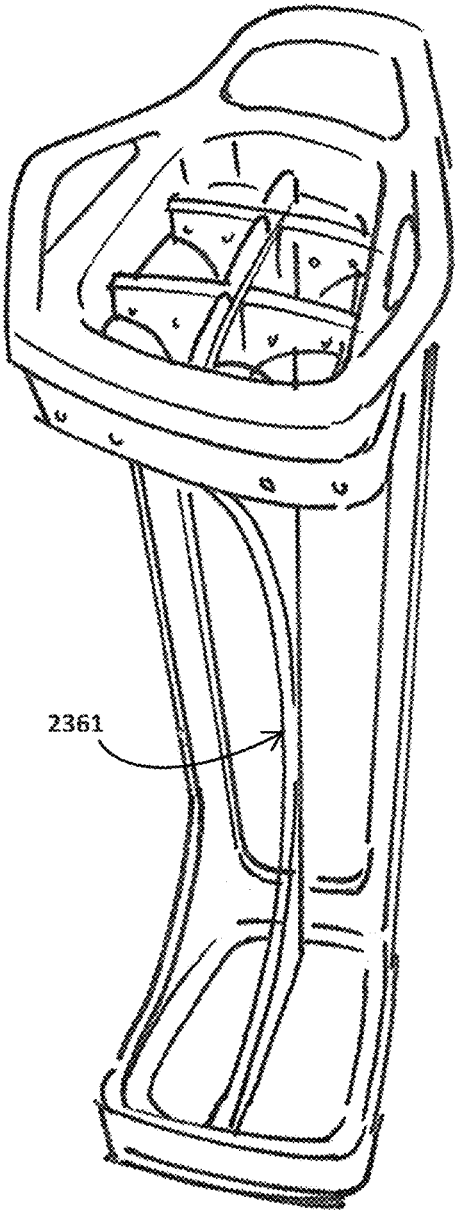
Figure 23C:
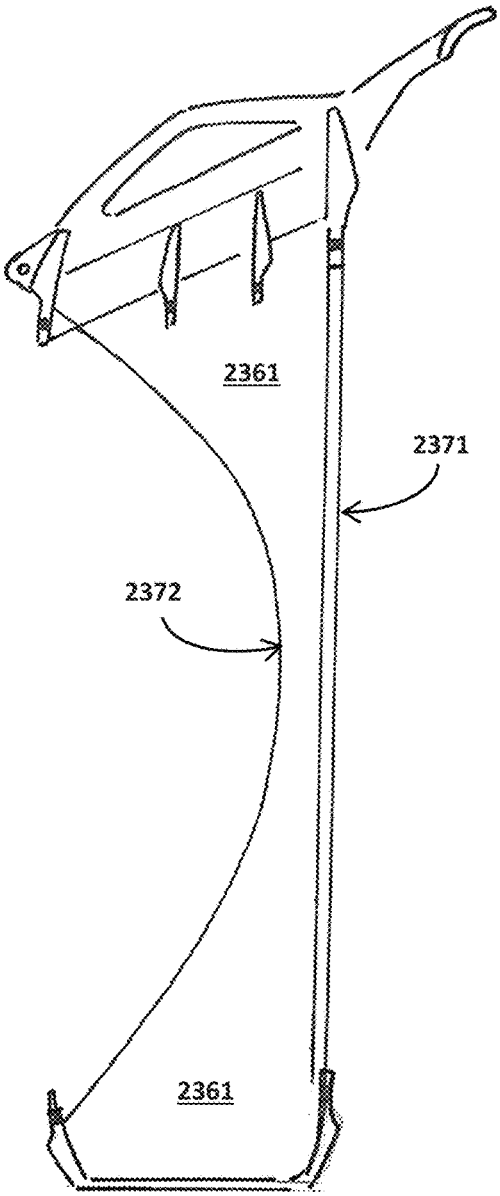

In some optional or alternative embodiments (e.g., as shown in FIGS. 23B and 23C), the central support may include a support structure 2361 extending between a top cuff or collar of the golf bag and a bottom base of the golf bag. In some cases, the support structure 2361 may comprise a TPU support structure positioned and/or oriented along a central axis of the golf bag. In some cases, the support structure 2361 may comprise a first side 2371 extending along a spine region of the golf bag and a second side 2372 opposing the first side. In some cases, the second side 2372 may comprise an upper portion, a lower portion, and a middle portion that is configured to curve inwardly from the upper portion and the lower portion towards the first side 2371 of the support structure 2361. In some cases, the second side 2372 may be configured to curve inwards towards the first side 2371 to form a concave curvature extending between the upper and lower portions of the second side 2372. In some cases, the middle portion may have a concave curvature facing a front or belly region of the golf bag. In some cases, the upper and/or lower portions of the support structure may have a greater width or thickness than the middle portion of the support structure.

Figure 23D:
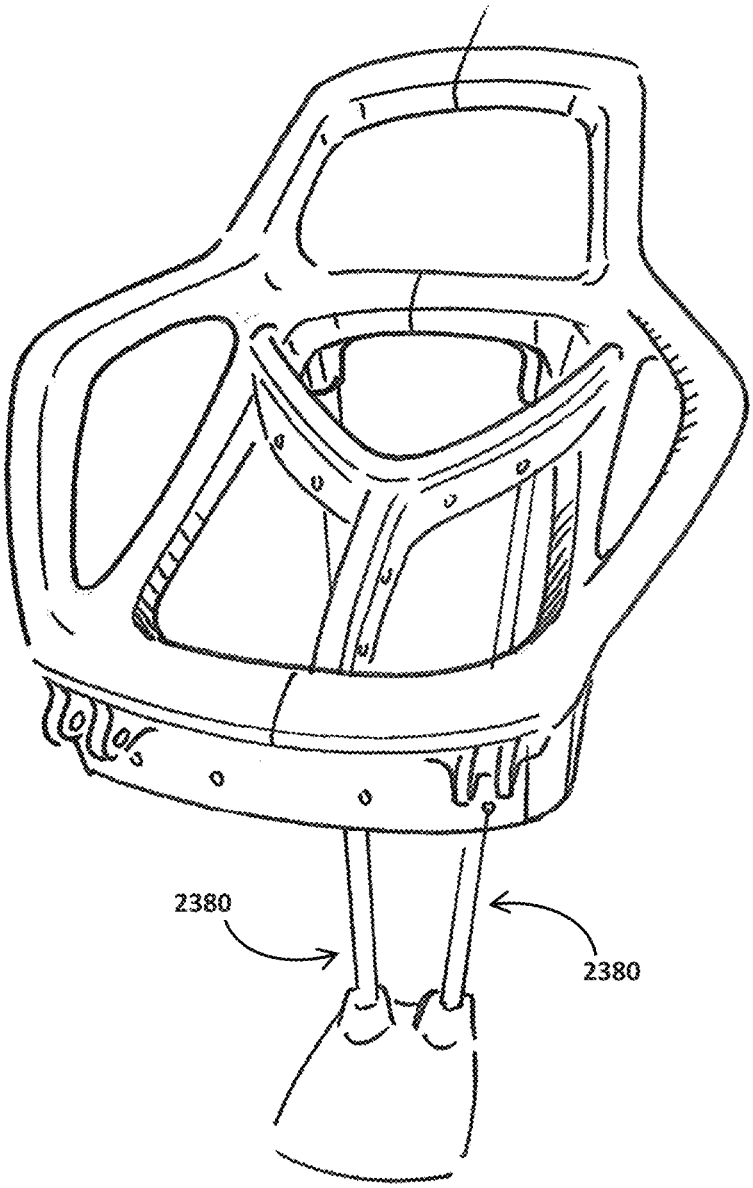

In other optional or alternative optional embodiments (e.g., as shown in FIG. 23D), the internal frame structure may comprise a lightweight frame structure 2380. In some cases, the lightweight frame structure 2380 may include one or more support posts extending between the top cuff or collar of the golf bag and the bottom base of the golf bag. In some cases, the one or more support posts may have a slim cross-sectional shape or profile to keep the overall frame structure lightweight. In some cases, the one or more support posts may be configured as solid cylindrical rods formed of a lightweight material. In some cases, the one or more support posts may be hollow or at least partially hollowed to further reduce the overall weight of the light-weight frame structure 2380.

Body Panels

In some embodiments, the golf bag may comprise one or more body panels extending around the internal frame structure of the golf bag. In some cases, the one or more body panels may include a recyclable fabric layer surrounding the internal frame structure to form a partially enclosed interior region for storing golf equipment.

In some embodiments, the recyclable fabric layer may comprise one or more extended portions configured to extend through the top cuff or collar. In some cases, the one or more extended portions may extend through a slot or a channel that is formed within the top cuff or collar. In some cases, the slot or channel may be configured to extend laterally between an outer/exterior surface of the top cuff or collar and an inner/interior surface of the top cuff or collar. In some cases, the slot or channel may be sized and/or shaped so that the sides and upper and lower surfaces of the slot or channel are in direct proximity to the one or more extended portions when the one or more extended portions are inserted through the slot or channel. In some cases, the slot or channel may be sized and/or shaped to minimize any gaps between the extended portions and the surfaces or sides of the slot or channel, in order to limit or restrict a movement of water, moisture, or debris through the slot or channel when the one or more extended portions are inserted through the slot or channel.

In some cases, the distal end(s) of the one or more extended portions may be configured to detachably secure to a portion or a section of the top cuff or collar. In some cases, the distal end(s) of the one or more extended portions may be configured to detachably secure to one or more other portions of the recyclable fabric layer. In some cases, a first portion or section of the recyclable fabric layer may be joined to a second portion or section of the recyclable fabric layer to form a loop structure that allows the top or upper portion of the recyclable fabric layer to be suspended from and/or detachably affixed to the top cuff or collar of the golf bag.

Figure 24:
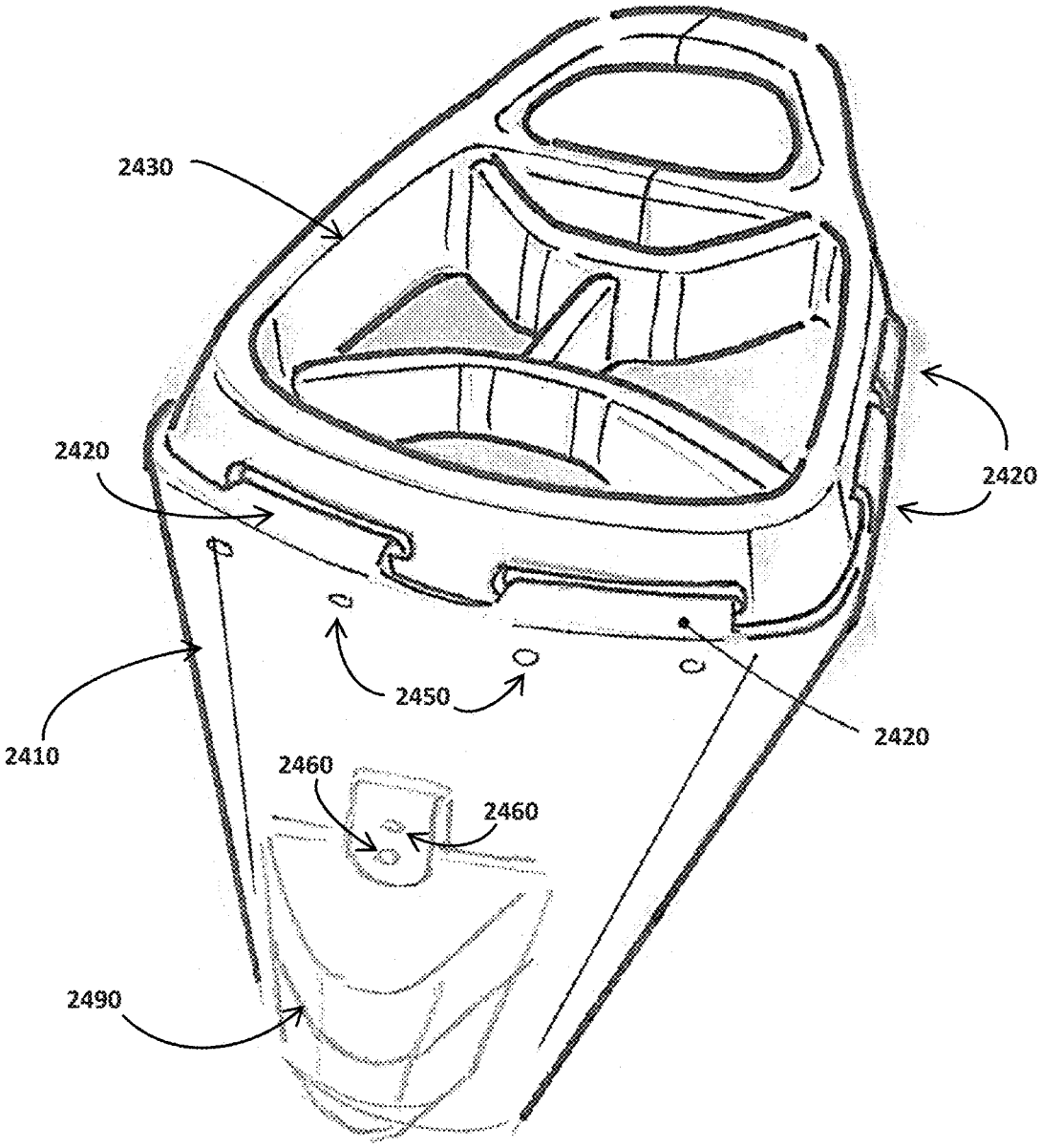
FIG. 24 schematically illustrates an exemplary construction for a recyclable golf bag, in accordance with some embodiments.

FIG. 24 schematically illustrates one example of a golf bag comprising a recyclable fabric layer 2410 with one or more extended portions 2420 configured to extend through the top cuff or collar 2430 of the golf bag. In some embodiments, the one or more extended portions 2420 may extend through a front facing portion of the top cuff or collar, a side facing portion of the top cuff or collar, and/or a rear facing portion of the top cuff or collar. In some embodiments, the one or more extended portions 2420 may be configured to extend through the top cuff or collar 2430, fold downwards and inwards into the interior region of the bag, and detachably secure to an inner surface portion of the recyclable fabric layer 2410. In some embodiments, the one or more extended portions 2420 may be secured to the inner surface portion of the recyclable fabric layer 2410 using one or more recyclable fasteners 2450 as described elsewhere herein.

Figure 25:
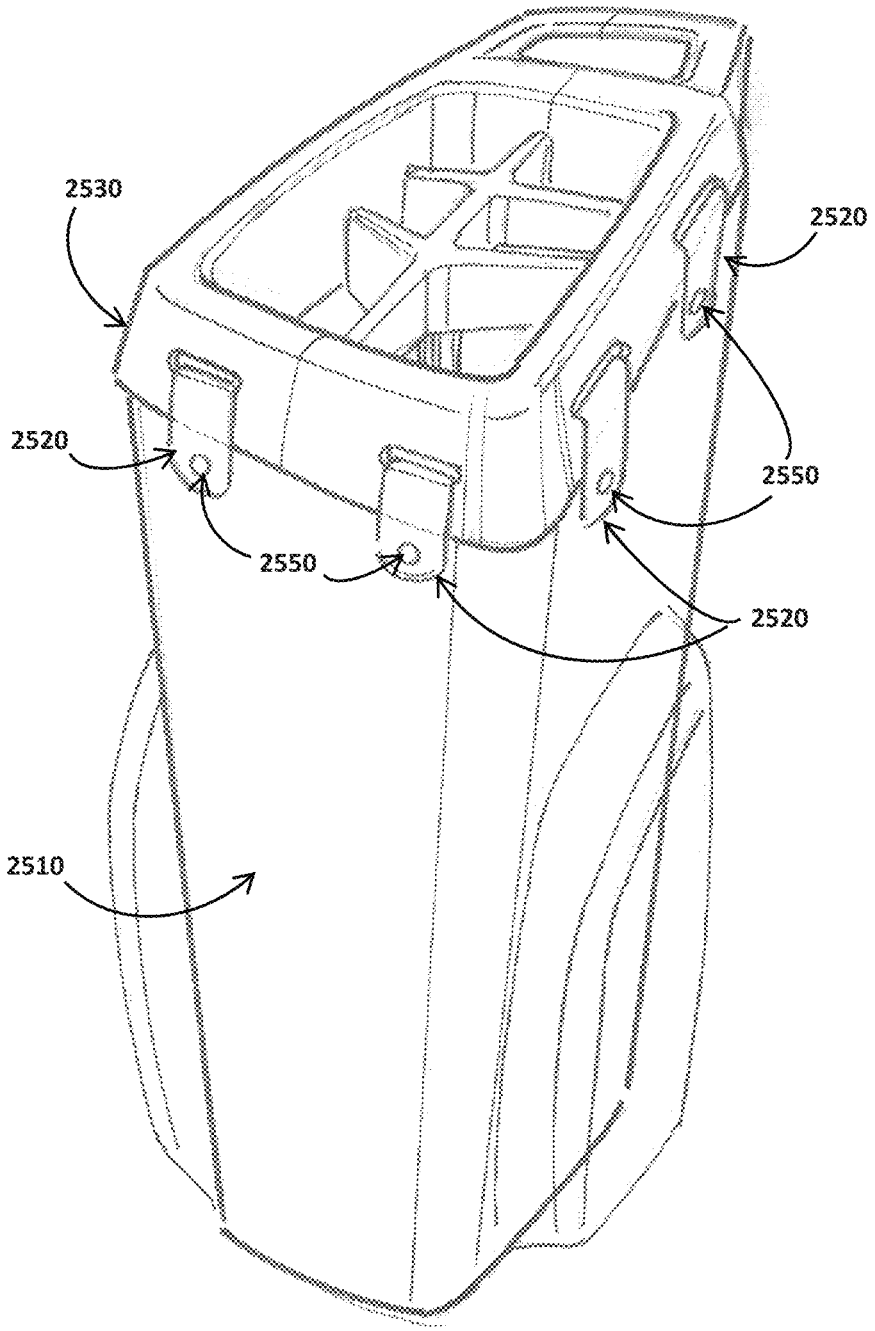
FIG. 25 schematically illustrates another exemplary construction for a recyclable golf bag, in accordance with some embodiments.

FIG. 25 schematically illustrates another example of a golf bag comprising a recyclable fabric layer 2510 with one or more extended portions 2520 configured to extend through the top cuff or collar 2530 of the golf bag. In some embodiments, the one or more extended portions 2520 may extend through a front facing portion of the top cuff or collar, a side facing portion of the top cuff or collar, and/or a rear facing portion of the top cuff or collar. In some embodiments, the one or more extended portions 2520 may be configured to extend through the top cuff or collar 2530 from the interior region/side of the bag, fold outwards and over a bottom edge of the outer portion of the top cuff or collar 2530, and detachably secure to an outer surface portion of the recyclable fabric layer 2510. In some embodiments, the one or more extended portions 2520 may be secured to the outer surface portion of the recyclable fabric layer 2510 using one or more recyclable fasteners 2550 as described elsewhere herein.

Modular Attachments

In some optional embodiments (e.g., as shown in FIG. 24), one or more snap attachments 2460 may be used to detachably secure one or more detachable components 2490 to the recyclable golf bag, thereby enhancing the modularity and customizability of the golf bag. In some cases, the one or more snap attachments 2460 may comprise a set of corresponding snap attachments that can be coupled together or decoupled to (i) secure the one or more detachable components 2490 to the golf bag and/or (ii) release the one or more detachable components 2490 from the golf bag as needed or when desired. In some cases, the one or more snap attachments 2460 may be affixed to or integrated with the recyclable fabric layer 2410, the frame structure, or the top cuff or collar of the golf bag. In some cases, the one or more snap attachments 2460 may be affixed to or integrated with the one or more detachable components 2490.

In some embodiments, the one or more detachable components 2490 may be configured to enhance or augment the functionality or utility of the recyclable golf bag. In some non-limiting embodiments, the one or more detachable components 2490 may include a detachable accessories unit or a detachable storage unit. In some cases, the detachable accessories unit may include a unit for holding or mounting a piece of golf equipment. In some cases, the detachable accessories unit may include an attachment for holding one or more beverage containers. In some cases, the detachable storage unit may include a unit for storing and/or housing golf equipment or one or more golf-related accessories.

Waterproof Construction

In some embodiments, the recyclable golf bag may comprise a waterproof or weatherproof construction. In some cases, the waterproof or weatherproof construction may comprise or utilize one or more welds to seal various adjoining portions, sections, or components of the golf bag to prevent or limit the movement of moisture or precipitation into one or more interior regions of the golf bag. In some cases, the one or more welds may include one or more hypersonic or ultrasonic welds. In some cases, the hypersonic or ultrasonic welds may be used in lieu of other connectors, fasteners, intermediary substrates, or adhesives which may not be waterproof and also readily recyclable.

In some embodiments, the recyclable fabric layer may comprise a waterproof material. In some embodiments, the recyclable fabric layer may comprise a plurality of recyclable textile panels or pieces that are joined together to form a waterproof construction. In some embodiments, the recyclable textile panels or pieces may be bonded, fused, or laminated together to form the waterproof construction. In some non-limiting embodiments, the recyclable textile panels or pieces may be ultrasonically or hypersonically welded together to form the waterproof construction. In other non-limiting embodiments, the recyclable textile panels or pieces may be hot melted together to form the waterproof construction.

Leg Assembly

In some embodiments, the recyclable golf bag may include a stand assembly. In some cases, the stand assembly may comprise a leg assembly that can be (i) deployed to support the golf bag and (ii) retracted for ease of transport or storage. In other alternative embodiments, the golf bag may not or need not include a stand assembly.

In some embodiments, the golf bag may comprise a leg assembly comprising a recyclable material. In some cases, the leg assembly may comprise a first leg and a second leg pivotally attached to the internal frame structure or the top cuff or collar of the golf bag. In some cases, the leg assembly may be configured to extend and/or retract depending on an input provided by a subject. In some cases, the leg assembly may be configured to transition between an extended state and a retracted state to move the golf bag between an upright position/configuration and a tilted position/configuration.

In some embodiments, the first leg and/or the second leg of the golf bag may be structurally optimized to bear the loads exerted on the first and/or second leg when the golf bag is placed in a tilted position or configuration. In some cases, the first leg or the second leg may comprise a hollow tubular construction to enhance a structural stiffness of the first or second leg. In some cases, the first leg or the second leg may comprise one or more flanges or ridges extending along a length of the first or second leg to enhance the structural stiffness of the first or second leg.

Figure 26:
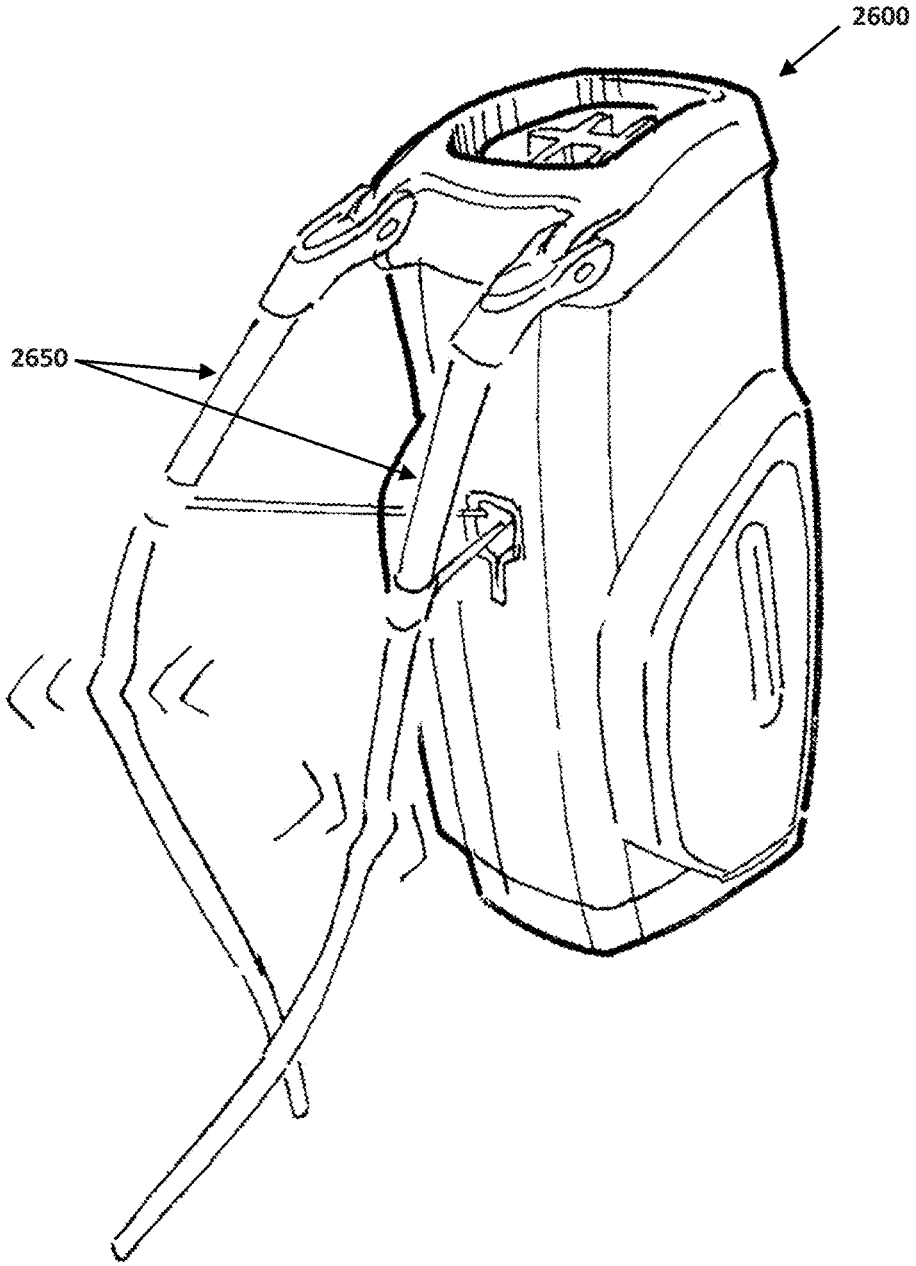
FIG. 26 (prior art)
FIG. 26 schematically illustrates an example of a conventional golf bag utilizing a leg assembly that is not structurally optimized for recyclable materials.

FIG. 26 illustrates an example of a conventional golf bag 2600 with a leg assembly that utilizes a traditional leg construction 2650. In some cases, conventional golf bags 2600 may comprise one or more legs formed of a metallic material or a composite material. In some cases, the structure of the legs may not be optimized for golf bag legs that are formed using the recyclable materials described herein. Thus, simply substituting the metallic or composite material in conventional leg assemblies for a recyclable material may not be feasible or practical, at least because the structures of conventional leg assemblies are not optimized to bear loads properly if these structures are formed using a recyclable material with a different set of material properties than other commonly used metallic or composite materials.

Figure 27A:
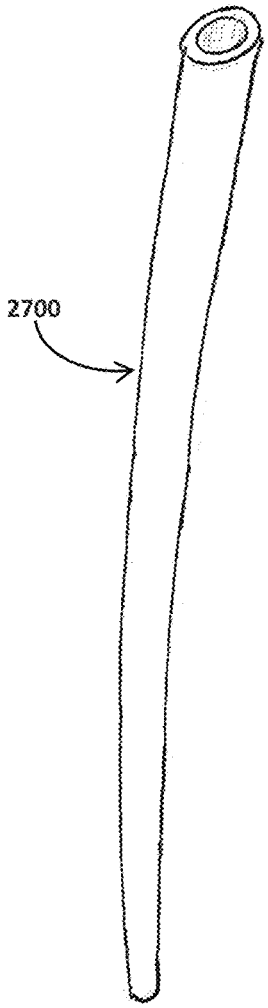
FIGS. 27A-27B, 28A-28B, and 29A-29B schematically illustrate various different examples of leg constructions that are structurally optimized for legs formed from one or more recyclable materials, in accordance with some embodiments.
Figure 27B:
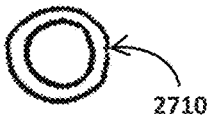

FIGS. 27A and 27B illustrate one non-limiting example of a construction for a leg 2700 of the recyclable golf bags disclosed herein. In some cases, the leg 2700 may comprise a hollow tubular construction 2710 to enhance a structural stiffness of the leg (e.g., in cases where the leg is formed of a recyclable material). In some cases, a leg with a hollow tubular construction 2710 may have a greater strength-to-weight ratio than a leg with a solid rod construction. In some cases, a hollow tubular construction 2710 may be used for the legs of the golf bag to preserve the strength and structural integrity of the legs while minimizing the amount of recyclable material needed to form a leg that does not break, snap, or deform under load.

Figure 28A:
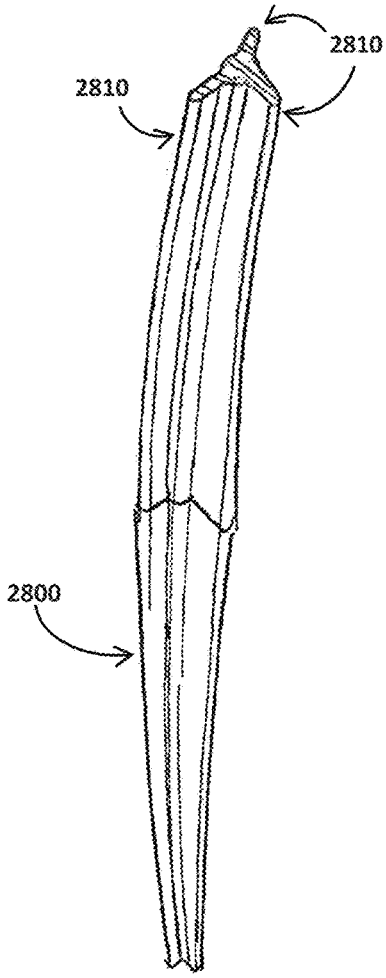
Figure 28B:
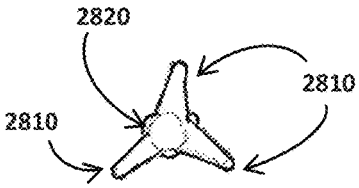

FIGS. 28A and 28B illustrate another non-limiting example of a construction for a leg 2800 of the recyclable golf bags disclosed herein. In some cases, the leg 2800 may comprise one or more flanges or ridges 2810 extending along a length of the leg to enhance the stiffness and rigidity of the leg. In some cases, the one or more flanges or ridges 2810 may be configured to extend radially outwards from a central portion 2820 of the leg. In some cases, the one or more flanges or ridges 2810 may include three or more flanges or ridges that are spaced apart at one or more angular intervals. In some cases, the one or more angular intervals may be the same (i.e., the three or more flanges or ridges may be evenly spaced apart around the central portion 2820 of the leg at an angular interval that is equal to 360/n degrees, where n is the number of flanges or ridges). In other cases, the one or more angular intervals may include two or more angular intervals that are different (e.g., a first set of flanges or ridges may be spaced apart at a first angular interval, and a second set of flanges or ridges may be spaced apart at a second angular interval that is different than the first angular interval).

Figure 29A:
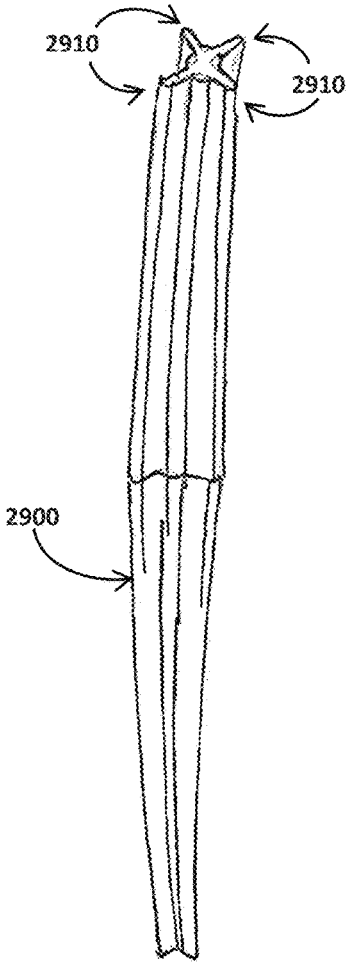
Figure 29B:
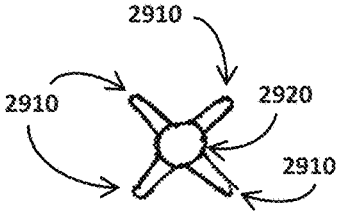

FIGS. 29A and 29B illustrate an alternative example of a construction for a leg 2900 of the recyclable golf bags disclosed herein. In some cases, the leg 2900 may comprise one or more flanges or ridges 2910 extending along a length of the leg to enhance the stiffness and rigidity of the leg. In some cases, the one or more flanges or ridges 2910 may be configured to extend radially outwards from a central portion 2920 of the leg. In some cases, the one or more flanges or ridges 2910 may include four or more flanges or ridges that are spaced apart at one or more angular intervals. In some cases, the one or more angular intervals may be the same (i.e., the four or more flanges or ridges may be evenly spaced apart around the central portion 2920 of the leg at an angular interval that is equal to 360/n degrees, where n is the number of flanges or ridges). In other cases, the one or more angular intervals may include two or more angular intervals that are different (e.g., a first set of flanges or ridges may be spaced apart at a first angular interval, and a second set of flanges or ridges may be spaced apart at a second angular interval that is different than the first angular interval).

Figure 30:
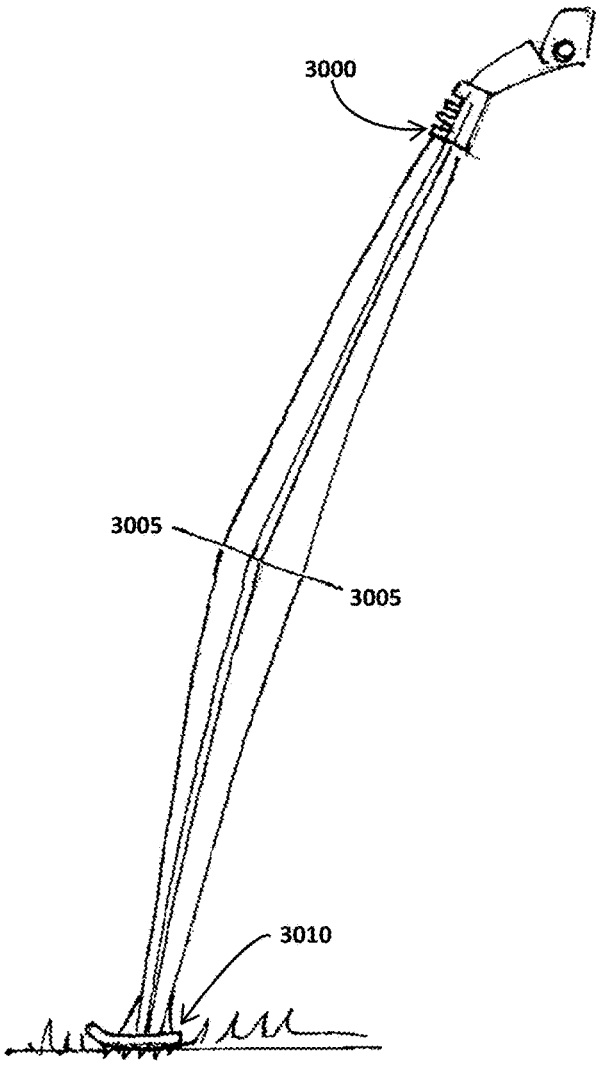
FIG. 30 schematically illustrates an example of a leg assembly for a recyclable golf bag, in accordance with some embodiments.

In some embodiments, the recyclable golf bags disclosed herein may comprise one or more legs having a variable width or thickness to further enhance a strength or a bending stiffness of the one or more legs. For example, as shown in FIG. 30, in some cases, a width or a thickness of the first leg or the second leg of the golf bag may increase from a proximal end 3000 of the first or second leg to a midpoint 3005 of the first or second leg. In some embodiments, the width or thickness of the first or second leg may decrease from the midpoint 3005 on the first or second leg to a distal end 3010 of the first or second leg. In some cases, the variation in the width or thickness of the first or second leg may strengthen and/or stiffen the first and second legs to bear the loads exerted on the first and/or second leg when the golf bag is placed in a tilted position or configuration.

Traction

In some embodiments, the first leg and/or the second leg of the golf bag may comprise a plurality of traction elements extending from a distal end of the first or second leg. The traction elements may be configured to engage a ground surface under the golf bag to restrict or limit a movement of the golf bag and/or to stabilize the golf bag on the ground surface.

In some embodiments, the plurality of traction elements may include one or more directional traction elements. In other embodiments, the plurality of traction elements may include one or more omni-directional traction elements. In some alternative embodiments, the plurality of traction elements may include one or more directional traction elements and one or more omni-directional traction elements.

Figure 31A:
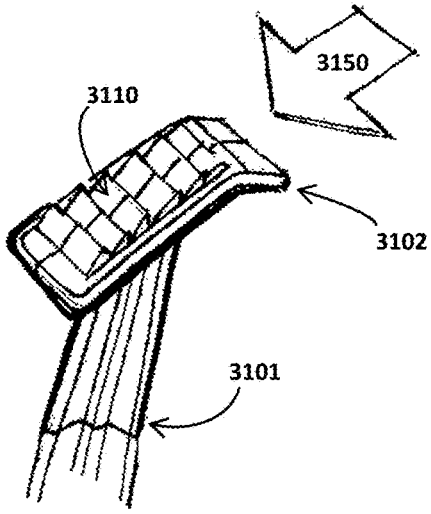
FIGS. 31A and 31B schematically illustrate different types of traction elements that can be provided on a distal end of a leg for a recyclable golf bag.

FIG. 31A schematically illustrates an exemplary leg for a recyclable golf bag in accordance with various embodiments of the present disclosure. In some cases, the leg may comprise a distal end 3101 that is configured to contact a ground surface under the leg. In some cases, the distal end 3101 may comprise a plurality of directional traction elements 3110 arranged along a bottom/ground facing surface of the distal end of the leg. In some cases, the distal end 3101 may comprise an elongated platform 3102 with a first lateral dimension that is greater than a second lateral dimension of the elongated platform. In some cases, the plurality of directional traction elements 3110 may be arranged on the bottom/ground facing surface of the elongated platform 3102.

In some non-limiting embodiments, the plurality of directional traction elements 3110 may include a row or a series of herringbone-shaped directional traction elements configured to provide traction in or along a select direction 3150. In some embodiments, the herringbone-shaped directional traction elements may comprise an angled or slanted surface extending from the distal end of the leg and a vertical wall extending downwards from an uppermost edge of the angled or slanted surface back towards the distal end of the leg. In some cases, the vertical wall may be configured to provide traction in a direction that is normal to the vertical wall. In some cases, the vertical wall may provide a contact area that engages with the ground surface to prevent or restrict a movement of the traction elements relative to the ground surface.

Figure 31B:
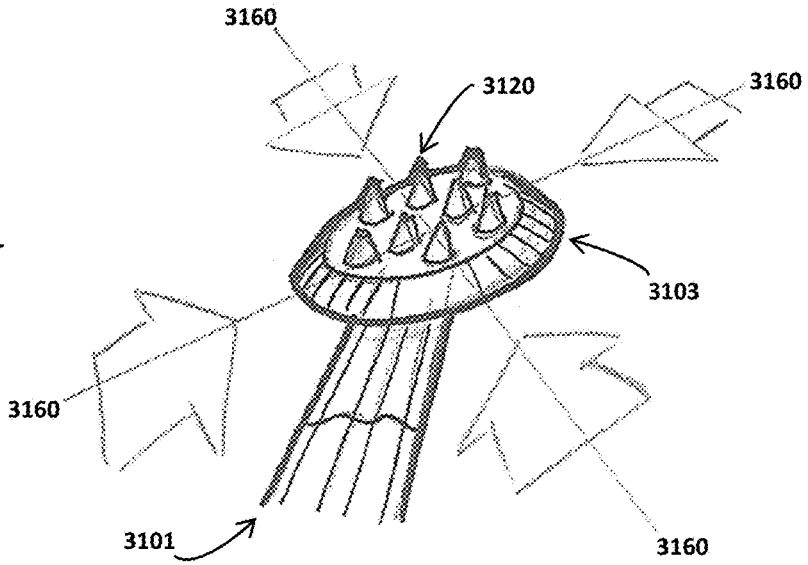

FIG. 31B schematically illustrates another exemplary leg for a recyclable golf bag in accordance with various other embodiments. In some cases, the leg may comprise a distal end 3101 that is configured to contact a ground surface under the leg. In some cases, the distal end 3101 may comprise a plurality of omni-directional traction elements 3120 arranged along a bottom/ground facing surface of the distal end 3101 of the leg. In some cases, the distal end 3101 may comprise a circular or oval platform 3103 with one or more chamfered edge portions. In some cases, the plurality of omni-directional traction elements 3120 may be arranged on the bottom/ground facing surface of the circular or oval platform.

In some non-limiting embodiments, the plurality of omni-directional traction elements 3120 may include one or more cone-shaped traction elements configured to provide traction in or along a plurality of different directions 3160. In some embodiments, the cone-shaped omni-directional traction elements 3120 may comprise an angled, slanted, and/or sloped surface extending from the distal end of the leg to an apex region of the traction element. In some cases, the apex region may be configured as a point that can penetrate the ground surface. In some cases, the apex region may comprise a rounded or truncated tip that can penetrate a first type of ground surface (e.g., an on course ground surface) without damaging a second type of ground surface (e.g., an off course ground surface). In some cases, the angled, slanted, and/or sloped surface of the cone-shaped omni-directional traction elements 3120 may be configured to provide traction in any radial direction about a central axis of the cone-shaped traction elements. In some cases, the angled, slanted, and/or sloped surface of the cone-shaped omni-directional traction elements may provide a contact area that engages with the ground surface to prevent or restrict a movement of the traction elements relative to the ground surface.

Actuator Rod Assembly

In some embodiments, the golf bag may further comprise an actuator rod assembly configured to operatively couple the leg assembly and the bottom base of the golf bag. In some cases, the actuator rod assembly may comprise a first end coupled to the leg assembly and a second end coupled to the bottom base. In some cases, the actuator rod assembly may be configured to facilitate an extension and/or a retraction of the legs of the golf bag, based on the input(s) provided by a subject.

Fasteners

In some embodiments, the golf bag may further comprise a plurality of recyclable fasteners. In some cases, the recyclable fasteners may be configured to detachably secure two or more components of the golf bag together in order to facilitate disassembly or deconstruction of the golf bag for recycling. In some cases, the recyclable fasteners may comprise one or more quick release fasteners for easily and rapidly disassembling or deconstructing the golf bag into separate components for recycling.

In some embodiments, a first type of recyclable fastener may be used to detachably couple at least two of the recyclable fabric layer, the internal frame structure, and the top cuff or collar of the golf bag. In some cases, the first type of recyclable fastener may be activated or engaged to detachably fasten or couple the recyclable fabric layer to the internal frame structure and/or the top cuff or collar. In some cases, the first type of recyclable fastener may be activated or engaged to detachably couple the internal frame structure to the top cuff or collar and/or the recyclable fabric layer. In some cases, the first type of recyclable fastener may be manipulated or released to detach or decouple the recyclable fabric layer from the internal frame structure and/or the top cuff or collar. In some cases, the first type of recyclable fastener may be manipulated or released to detach or decouple the internal frame structure from the top cuff or collar and/or the recyclable fabric layer.

In some embodiments, a second type of recyclable fastener may be used to detachably couple the recyclable fabric layer to the bottom base of the golf bag. In some cases, the second type of recyclable fastener may be activated or engaged to detachably couple the recyclable fabric layer to the bottom base. In some cases, the second type of recyclable fastener may be manipulated or released to detach or decouple the recyclable fabric layer from the bottom base.

In some embodiments, a third type of recyclable fastener may be used to detachably couple the leg assembly to the internal frame structure or the top cuff or collar of the golf bag. In some cases, the third type of recyclable fastener may be activated or engaged to detachably couple the leg assembly to the internal frame structure or the top cuff or collar. In some cases, the third type of recyclable fastener may be manipulated or released to detach or decouple the leg assembly from the internal frame structure or the top cuff or collar.

In some embodiments, a fourth type of recyclable fastener may be used to detachably couple the actuator rod assembly to the leg assembly or the bottom base of the golf bag. In some cases, the fourth type of recyclable fastener may be activated or engaged to detachably couple the actuator rod assembly to the leg assembly or the bottom base of the golf bag. In some cases, the fourth type of recyclable fastener may be manipulated or released to detach or decouple the actuator rod assembly from the leg assembly or the bottom base.

In some cases, the first type of recyclable fastener may be a same type of fastener as the second type of recyclable fastener, the third type of recyclable fastener, and/or the fourth type of recyclable fastener. In other cases, the first type of recyclable fastener may be a different type of fastener than the second type of recyclable fastener, the third type of recyclable fastener, and/or the fourth type of recyclable fastener.

In some cases, the second type of recyclable fastener may be a same type of fastener as the first type of recyclable fastener, the third type of recyclable fastener, and/or the fourth type of recyclable fastener. In other cases, the second type of recyclable fastener may be a different type of fastener than the first type of recyclable fastener, the third type of recyclable fastener, and/or the fourth type of recyclable fastener.

In some cases, the third type of recyclable fastener may be a same type of fastener as the first type of recyclable fastener, the second type of recyclable fastener, and/or the fourth type of recyclable fastener. In other cases, the third type of recyclable fastener may be a different type of fastener than the first type of recyclable fastener, the second type of recyclable fastener, and/or the fourth type of recyclable fastener.

In some cases, the fourth type of recyclable fastener may be a same type of fastener as the first type of recyclable fastener, the second type of recyclable fastener, and/or the third type of recyclable fastener. In other cases, the fourth type of recyclable fastener may be a different type of fastener than the first type of recyclable fastener, the second type of recyclable fastener, and/or the third type of recyclable fastener.

In some embodiments, the plurality of recyclable fasteners may include one or more TPU rivets or buttons. In other embodiments, the plurality of recyclable fasteners may include a TPU pin system configured to detachably couple (i) the recyclable fabric layer to (ii) the top cuff or collar, (iii) the frame structure, and/or (iv) the bottom base of the golf bag. In some embodiments, the plurality of recyclable fasteners may include a slotted head clip or a snap fastener.

Figure 32A:
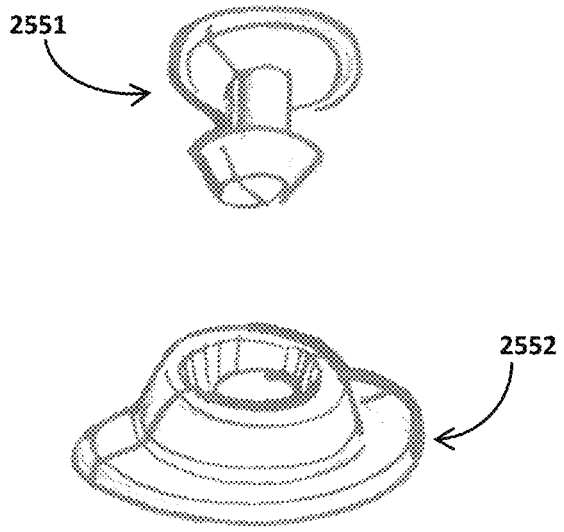
FIGS. 32A-32D schematically illustrate various examples of different recyclable fasteners that can be used to detachably couple two or more components of the recyclable golf bags disclosed herein.

FIG. 32A schematically illustrates an exemplary fastener that can be used to attach a first portion or component of the golf bag to a second portion or component of the golf bag. In some non-limiting embodiments, the fastener may be used to join a first portion of the recyclable fabric layer of the golf bag to a second portion of the recyclable fabric layer of the golf bag (e.g., as shown in FIG. 25). In some embodiments, the fastener may include a snap fastener system with a first component 2551 having a protrusion and a second component 2552 having a receptacle for receiving and engaging with the protrusion to detachably join the first component 2551 and the second component 2552. In some embodiments, the first component 2551 with the protrusion may be positioned on a distal end of an extended portion of the recyclable fabric layer. In some cases, the second component 2552 may be provided on a portion or section of the recyclable fabric layer that is under or below the top cuff or collar of the golf bag. In some cases, the second component 2552 may be positioned to engage with the distal end of the extended portion of the recyclable fabric layer when the extended portion projects through the top cuff or collar and folds or wraps downwards over the bottom edge of the top cuff or collar towards the outer surface of the recyclable fabric layer.

In some embodiments, the protrusion of the first component 2551 may be pushed or pressed into the receptacle of the second component 2552 to detachably couple the first and second components. In some embodiments, the protrusion of the first component 2551 may be pulled out or separated from the receptacle of the second component 2552 to decouple the first and second components (e.g., to aid in a disassembly or deconstruction of the golf bag into individual parts for recycling).

Figure 32B:
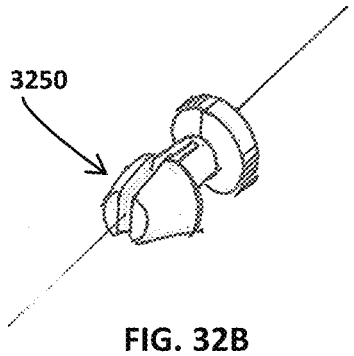
Figure 32C:
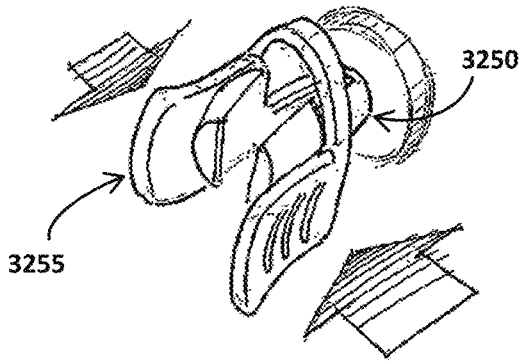

FIGS. 32B and 32C schematically illustrate another exemplary fastener that can be used to attach a first portion or component of the golf bag to a second portion or component of the golf bag. In some cases, the fastener may comprise a clip 3250 with a slotted head having a set of opposing protrusions configured to move towards and away from each other when an input (e.g., a compressive force) is applied to the opposing protrusions and/or when said input is released.

In some embodiments, the clip 3250 may be attached or fixed to a first component or portion of the golf bag, and the opposing protrusions may be pressed or pinched together and threaded through a second component or portion of the golf bag. In some embodiments, the slotted head portion of the clip 3250 may be inserted into a receiving component 3255 having an opening with a predetermined size and/or shape. In some cases, the receiving component 3255 may be integrated with the first or second component or portion of the golf bag. In other cases, the receiving component 3255 may be a standalone component that is not integrally formed with any structural component of the golf bag. In some embodiments, the opening of the receiving component 3255 may be sized and shaped to allow the opposing protrusions of the slotted head to spread apart and separate so that the opposing protrusions latch onto the receiving component 3255 when a force is applied to separate the clip 3250 from the receiving component 3255. In some embodiments, an input may be provided to press or pinch together the opposing protrusions so that the slotted head portion of the clip 3250 can retract through the opening of the receiving component 3255 to allow the first and second components or portion of the golf bag to separate or detach from one another.

In some embodiments, the clip 3250 may not or need not be attached or fixed to the first or second component or portion of the golf bag, and may be a standalone component. In some embodiments, the opposing protrusions on the slotted head portion of the clip 3250 may be pressed or pinched together and threaded through a first component or portion of the golf bag and a second component or portion of the golf bag. In some embodiments, the slotted head portion of the clip 3250 may be inserted into a receiving component 3255 having an opening with a predetermined size and/or shape. In some cases, the receiving component 3255 may be integrated with the first or second component or portion of the golf bag. In other cases, the receiving component 3255 may be a standalone component that is not integrally formed with any structural component of the golf bag. In some embodiments, the opening of the receiving component 3255 may be sized and shaped to allow the opposing protrusions of the slotted head to spread apart and separate so that the opposing protrusions latch onto the receiving component 3255 when a force is applied to separate the clip 3250 from the receiving component 3255. In some embodiments, an input may be provided to press or pinch together the opposing protrusions so that the slotted head portion of the clip 3250 can retract through the opening of the receiving component 3255 to allow the first and second components or portion of the golf bag to separate or detach from one another.

In some non-limiting embodiments, the receiving component 3255 may comprise one or more wings extending from the opening of the receiving component 3255. In some cases, the one or more wings may be configured as tabs that can be pressed or pinched together to move the opposing protrusions on the slotted head portion of the clip 3250 together when the slotted head portion is inserted through the opening of the receiving component 3255. In some cases, the tabs may be pressed or pinched together to allow the slotted head portion of the clip 3250 to fit through the opening of the receiving component 3255 so that the clip 3250 can be decoupled from the receiving component 3255. In some cases, the wings or tabs of the receiving component 3255 may be used to manipulate the receiving component 3255 to function as a clip tool for detaching the fasteners from the components or portions of the golf bag to which the fasteners are attached or coupled. In some cases, the receiving component 3255 may be configured as both (i) a complementary component for engaging a clip fastener for the golf bag and (ii) a tool for detaching the clip fasteners (e.g., to facilitate a disassembly or deconstruction of the golf bag into individual parts for recycling).

In some embodiments, the plurality of recyclable fasteners described herein may be manipulated using a tool. In some embodiments, the tool may be used to tighten or loosen the recyclable fasteners to aid in the assembly and/or disassembly of the golf bag (e.g., for storage, transport, recycling, etc.). In some optional embodiments, the tool may be integrated into another component of the golf bag and manipulated, operated, removed, or detached when needed.

Figure 32D:
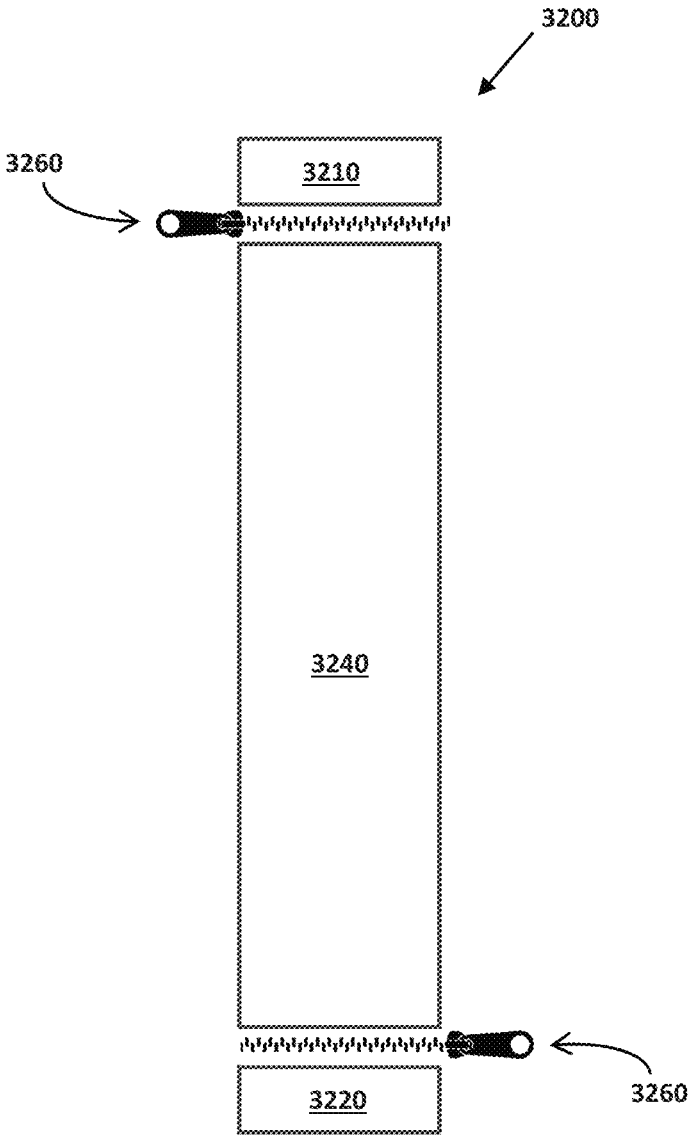

FIG. 32D illustrates an alternative example of a recyclable fastener 3260 that can be used to detachably couple two or more components of a recyclable golf bag 3200. In some embodiments, the recyclable fastener 3260 may include a slidable fastener configured to detachably couple (i) the recyclable fabric layer 3240 and (ii) the bottom base 3220 of the golf bag. In some embodiments, the recyclable fastener 3260 may optionally include a slidable fastener for detachably coupling (i) the recyclable fabric layer 3240 and (iii) the top cuff or collar 3210 of the golf bag.

In some non-limiting embodiments, the golf bag may include a flap that extends across and covers the slidable fastener to enhance a water resistance of the golf bag. In some non-limiting embodiments, the flap may be configured to limit or restrict a movement of water or moisture into the interior region of the golf bag through the slidable fastener or the connecting regions between the components that are detachably joinable using the slidable fastener. In some embodiments, the flap may be moved or repositioned as needed to allow a subject to access the slidable fastener positioned underneath the flap.

Figure 33A:
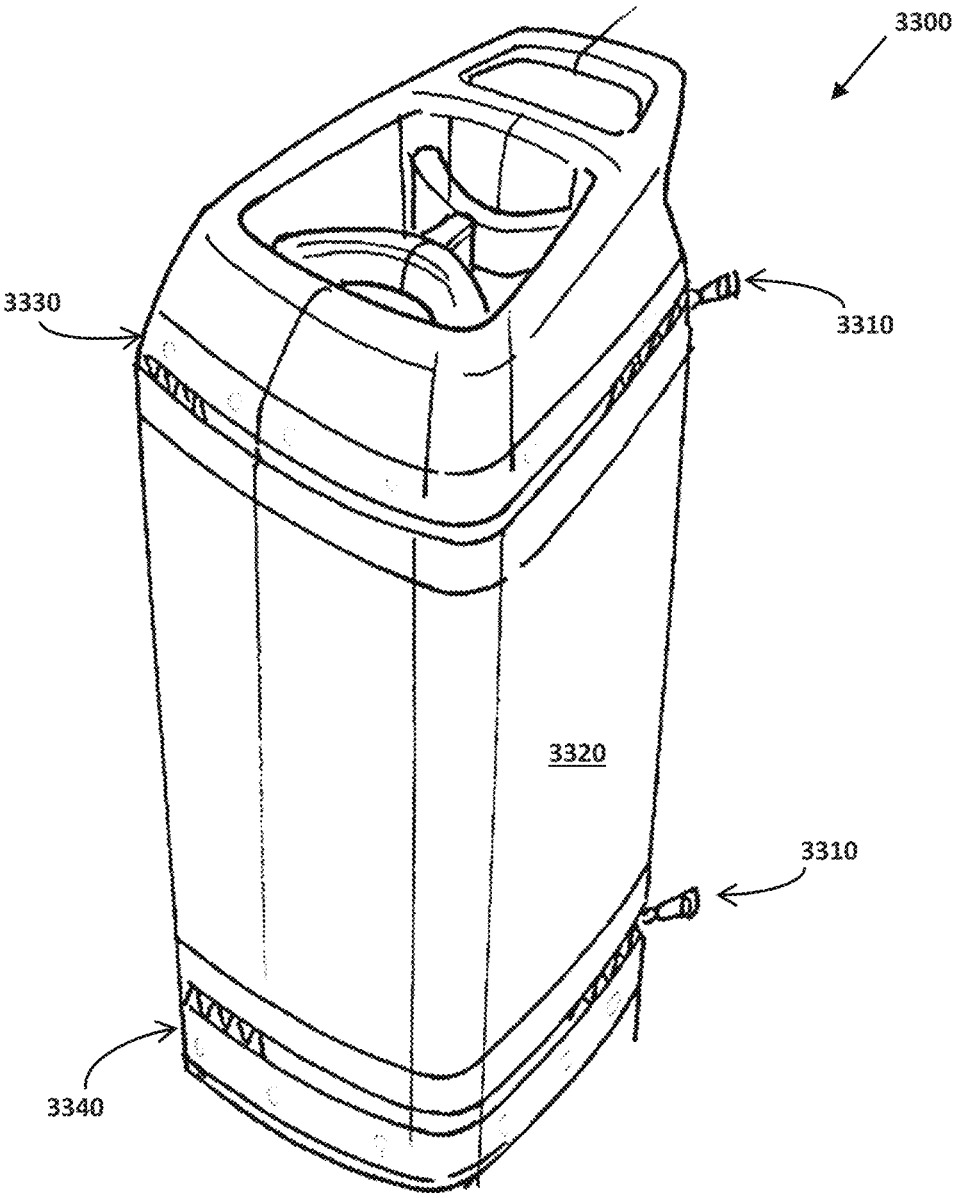
FIG. 33A schematically illustrates an example of a recyclable golf bag comprising a slidable fastener for detachably coupling two or more components of the golf bag.

FIG. 33A illustrates another example of a recyclable golf bag 3300 comprising a slidable fastener assembly 3310. In some cases, the slidable fastener assembly 3310 may comprise a slidable fastener and two separate panels or pieces that can be secured together or released from one another using the slidable fastener. In some cases, the two separate panels or pieces may correspond to a flange portion of the slidable fastener assembly. In some cases, the two separate panels or pieces may be attached or fixed to two or more components of the golf bag. In some cases, the two or more components may include a recyclable fabric layer 3320 of the golf bag, a top cuff or collar 3330 of the golf bag, a bottom base assembly 3340 of the golf bag, and/or a frame structure of the golf bag.

Figure 33B:
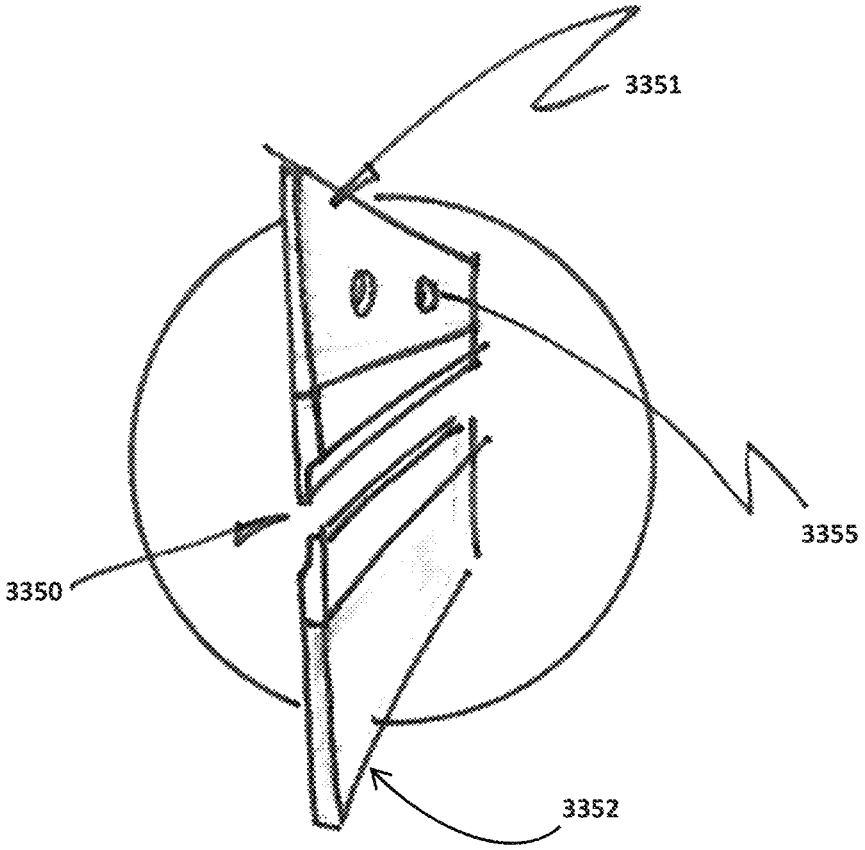
FIGS. 33B and 33C schematically illustrate a detailed view of an exemplary golf bag construction to accommodate a slidable fastener, in accordance with some embodiments.

In some embodiments, the slidable fastener assembly may comprise one or more flange portions that are couplable to (i) the top cuff or collar or (ii) the recyclable fabric layer. As shown in FIG. 33B, in some embodiments, the slidable fastener assembly may comprise a first flange 3351 and a second flange 3352 that can be secured together or separated/detached from one another using a slidable fastener 3350 (e.g., a zipper). In some cases, the first flange 3351 and/or the second flange 3352 may comprise a panel or piece of material comprising a thermoplastic polyurethane (TPU) material.

In some cases, the TPU panel or piece may be attached or affixed to a component of the golf bag using one or more recyclable fasteners (e.g., one or more clips or snap fasteners as disclosed herein). In some cases, the TPU panel or piece may comprise one or more openings 3355 for receiving and/or engaging with the one or more recyclable fasteners. In other cases, the TPU panel or piece may be attached or affixed to a component of the golf bag using an adhesive, or by lamination, hot melting, or welding.

Figure 33C:
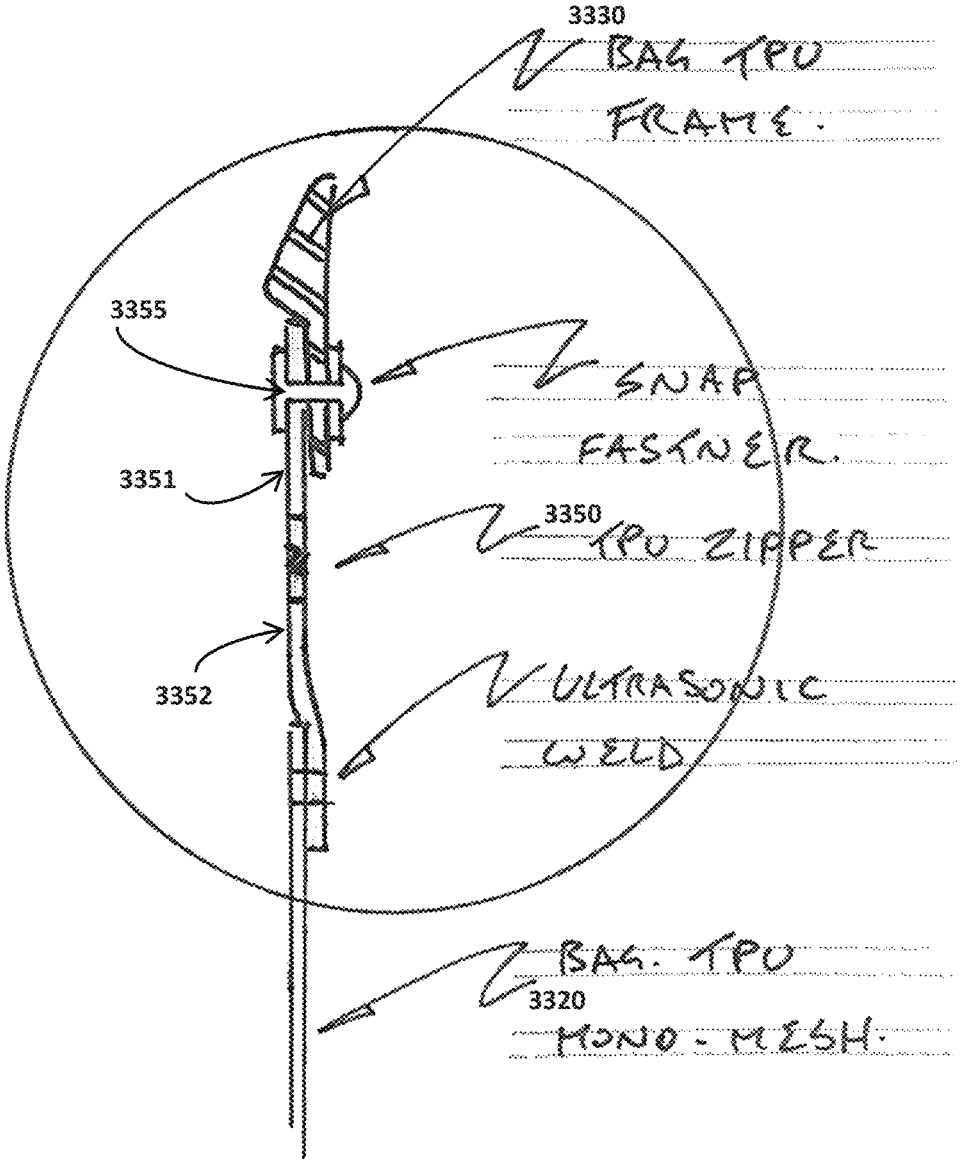

Referring to FIG. 33C, in some cases, the first flange 3351 may be detachably coupled to the top cuff or collar 3330 of the golf bag using one or more recyclable fasteners. In some cases, the one or more recyclable fasteners may comprise one or more snap fasteners configured to extend through one or more openings 3355 provided in the first flange 3351. In some cases, the one or more openings may be configured to receive or engage with one or more fasteners to facilitate a coupling between the flange portion(s) of the slidable fastener assembly and the top cuff or collar. In some cases, the second flange 3352 may be coupled to the recyclable fabric layer 3320 of the golf bag. In some cases, the second flange portion of the slidable fastener assembly may be bonded, laminated, hot melted, fused, and/or welded to the recyclable fabric layer to form a waterproof seal.

In some cases, a slidable fastener 3350 may be used to couple the first flange 3351 and the second flange 3352 together to indirectly couple the top cuff or collar 3330 of the golf bag and the recyclable fabric layer 3320 of the golf bag. In some cases, the slidable fastener 3350 may be used to decouple the first flange 3351 and the second flange 3352 so that the top cuff or collar 3330 of the golf bag and the recyclable fabric layer 3320 of the golf bag can be detached or separated in preparation for recycling.

Heavy Duty Construction

Figure 34:
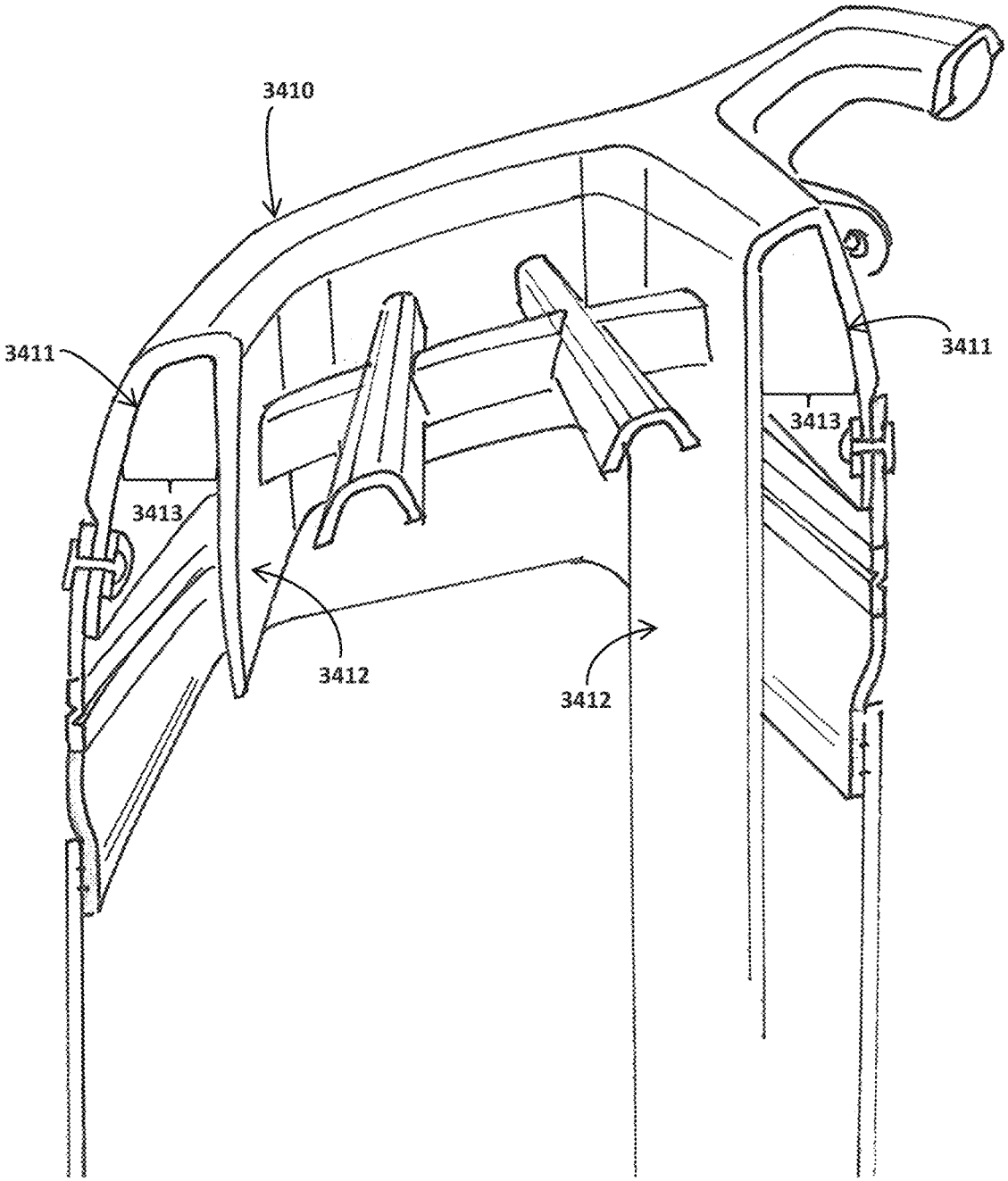
FIG. 34 schematically illustrates an exemplary construction for a recyclable heavy duty golf bag, in accordance with some embodiments.

In some embodiments, the recyclable golf bag may utilize a heavy duty construction for additional strength, structural support, rigidity, and/or durability. As shown in FIG. 34, in some cases, the heavy duty construction may comprise a top cuff or collar 3410 with a U-frame structure. In some cases, the U-frame structure may comprise a set of opposing walls comprising a first wall 3411 extending along an outer portion of the top cuff or collar 3410 and a second wall 3412 extending along an inner portion of the top cuff or collar 3410. In some cases, the first wall 3411 and the second wall 3412 may be spaced apart with a gap 3413 provided between the first and second walls. In some cases, the first wall 3411 may be attached or coupled to a recyclable fabric layer associated with one or more body panels of the golf bag. In some cases, the second wall 3412 may be attached, coupled to, or integrally formed with a divider assembly extending across the top opening formed by the top cuff or collar.

In some embodiments, the U-frame structure may comprise one or more structural supports extending between the opposing walls of the U-frame structure. In some embodiments, the U-frame structure may comprise one or more structural supports extending within the gaps 3413 formed between the first wall 3411 and the second wall 3412 of the U-frame structure. In some cases, the one or more structural supports may include one or more beams, struts, braces, or lattice substructures extending between the opposing walls of the U-frame structure. In some cases, the one or more structural supports may be configured as internal transversal sidewalls reinforcement structures to further enhance the strength and rigidity of the top cuff or collar.

Adhesive

In some embodiments, the recyclable golf bag may comprise at least two or more components that can be adhesively coupled to form a structure of the golf bag. In some cases, at least two or more components of the recyclable golf bag may be joined using an adhesive material. In some cases, the at least two or more components may include, for example, the top cuff or collar, the bottom base, the internal frame structure, the recyclable fabric layer, the leg assembly, and/or the actuator rod assembly of the golf bag.

In some cases, the adhesive material may include a recyclable adhesive material. In some cases, the recyclable adhesive material may comprise a recyclable compound that is configured to adhere to the recyclable components of the golf bag. In some cases, the recyclable adhesive material may be configured to evaporate during a recycling process for the components of the recyclable golf bag.

Disassembly/Detachability

In some embodiments, the recyclable golf bags disclosed herein may be disassembled or deconstructed into their constituent parts or components to prepare the parts or components for one or more recycling processes. In some embodiments, the recyclable golf bags of the present disclosure may be deconstructed or disassembled so that the top cuff or collar, the bottom base, the frame structure, the recyclable fabric layer, the leg assembly, and/or the actuator rod assembly can be separately or individually recycled using one or more recycling processes.

In some cases, the recyclable fabric layer of the golf bag may be configured to detach or decouple from the internal frame structure upon a release of the recyclable fastener coupling the recyclable fabric layer to the internal frame structure. In some cases, the recyclable fabric layer of the golf bag may be configured to detach or decouple from the top cuff or collar upon a release of the recyclable fastener coupling the recyclable fabric layer to the top cuff or collar of the golf bag. In some cases, the recyclable fabric layer of the golf bag may be configured to detach or decouple from the bottom base upon a release of the recyclable fastener coupling the recyclable fabric layer to the bottom base of the golf bag.

In some embodiments, the top cuff or collar may be detachably coupled to the frame structure of the golf bag to enhance a recyclability of the golf bag. In some cases, the top cuff or collar may be deconstructed, disassembled, detached, and/or released from the frame structure of the golf bag to prepare the golf bag (and any components thereof) for one or more recycling processes. In some cases, the frame structure of the golf bag may be configured to detach or decouple from the top cuff or collar upon a release of the recyclable fastener coupling the frame structure to the top cuff or collar of the golf bag.

In some embodiments, the leg assembly may be detachably coupled to the internal frame structure and/or the top cuff or collar of the golf bag to enhance a recyclability of the golf bag. In some cases, the leg assembly may be deconstructed, disassembled, detached, and/or released from the internal frame structure and/or the top cuff or collar of the golf bag to prepare the golf bag for recycling. In some cases, the leg assembly of the golf bag may be configured to detach or decouple from the top cuff or collar upon a release of the recyclable fastener coupling the leg assembly to the top cuff or collar of the golf bag. In some cases, the leg assembly of the golf bag may be configured to detach or decouple from the internal frame structure of the golf bag upon a release of the recyclable fastener coupling the leg assembly to the internal frame structure of the golf bag.

In some embodiments, the actuator rod assembly of the golf bag may be detachably coupled to the internal frame structure, the leg assembly, and/or the bottom base of the golf bag to enhance a recyclability of the golf bag. In some cases, the actuator rod assembly may be deconstructed, disassembled, detached, and/or released from the internal frame structure, the leg assembly, and/or the bottom base of the golf bag to prepare the golf bag for recycling. In some cases, the actuator rod assembly of the golf bag may be configured to detach or decouple from the internal frame structure, the leg assembly, and/or the bottom base upon a release of the recyclable fastener coupling the actuator rod assembly to the internal frame structure, the leg assembly, and/or the bottom base of the golf bag.

Padding

In some optional embodiments, the recyclable golf bag may include one or more padded components. In some cases, the one or more padded components may comprise a foamed material. In some cases, the foamed material may include a recyclable material as described elsewhere herein. In some cases, the recyclable material may comprise a foamed thermoplastic polyurethane (TPU) material.

In some cases, the one or more padded components may include a padded component for a strap assembly of the golf bag. In other cases, the one or more padded components may include a padded component provided on a recyclable fabric layer of the golf bag. In some cases, the padded component may be provided on an outer portion of the recyclable fabric layer that contacts a hip region of a subject's body (e.g., when the subject is carrying or handling the golf bag).

All patents, publications, test procedures, and other references cited herein, including priority documents, are fully incorporated by reference to the extent such disclosure is not inconsistent with this technology and for all jurisdictions in which such incorporation is permitted. It is understood that the materials, designs, constructions, and structures; components; and assemblies and sub-assemblies described and illustrated herein represent only some embodiments of the technology. It is appreciated by those skilled in the art that various changes, optimizations, and additions can be made to such products and materials without departing from the spirit and scope of the present disclosure. It is intended that all such embodiments be covered by the claims presented herewith.

What is claimed is:

1. A golf bag, comprising:

a top cuff or collar forming a top opening;

a bottom base;

an internal frame structure extending between the bottom base and the top cuff or collar, the internal frame structure comprising a central support extending along a central axis of the golf bag;

a recyclable fabric layer surrounding the internal frame structure to form a partially enclosed interior region for storing golf equipment, wherein the recyclable fabric layer comprises one or more extended portions configured to extend through the top cuff or collar and detachably secure to one or more other portions of the recyclable fabric layer, wherein the one or more extended portions are configured to extend through the top cuff or collar, fold downwards and inwards into the interior region of the bag, and detachably secure to an inner surface portion of the recyclable fabric layer;

a leg assembly formed of a recyclable thermoplastic polyurethane material, the leg assembly comprising a first leg and a second leg pivotally attached to the internal frame structure or the top cuff or collar;

an actuator rod assembly with a first end coupled to the leg assembly and a second end coupled to the bottom base; and a plurality of recyclable fasteners configured to detachably secure at least two of (i) the top cuff or collar, (ii) the bottom base, (iii) the internal frame structure, (iv) the recyclable fabric layer, (v) the leg assembly, and (vi) the actuator rod assembly to facilitate disassembly or deconstruction of the golf bag for recycling.

2. The golf bag of claim 1, wherein the central support of the internal frame structure comprises a beam, a strut, or a rod extending along the central axis.

3. The golf bag of claim 1, wherein the central support of the internal frame structure comprises a support structure with a first side and a second side opposite the first side, wherein the first side is configured to extend along a spine portion of the golf bag between the bottom base and the top cuff or collar, and wherein the second side is configured to curve inwards towards the first side to form a concave curvature extending between an upper and lower portion of the second side.

4. The golf bag of claim 1, wherein the internal frame structure comprises a plurality of structural supports arranged around the central support, wherein the plurality of structural supports comprise a T-frame structure.

5. The golf bag of claim 4, wherein the T-frame structure comprises a curved outer perimeter, profile, or edge.

6. The golf bag of claim 4, wherein the internal frame structure further comprises a lateral support extending along or around a midsection of the internal frame structure, wherein the lateral support is detachably coupled to the plurality of structural supports.

7. The golf bag of claim 1, wherein the one or more extended portions are configured to extend through the top cuff or collar from the interior region of the bag, fold outwards and over a bottom edge of the top cuff or collar, and detachably secure to an outer surface portion of the recyclable fabric layer.

8. The golf bag of claim 1, wherein the plurality of recyclable fasteners includes one or more rivets, buttons, snap fasteners, or clips.

9. The golf bag of claim 1, further comprising a TPU pin system configured to detachably couple (i) the recyclable fabric layer and (ii) the top cuff or collar or (iii) the bottom base.

10. The golf bag of claim 1, wherein the plurality of recyclable fasteners includes a slidable fastener configured to detachably couple (i) the recyclable fabric layer and (ii) the bottom base or (iii) the top cuff or collar.

11. The golf bag of claim 10, wherein the slidable fastener includes a flange portion that is couplable to (i) the top cuff or collar or (ii) the recyclable fabric layer.

12. The golf bag of claim 11, wherein the flange portion comprises one or more openings configured to receive or engage with another fastener to facilitate a coupling between the flange portion of the slidable fastener and the top cuff or collar.

13. The golf bag of claim 11, wherein the flange portion is bonded, laminated, hot melted, fused, or welded to the recyclable fabric layer to form a waterproof seal.

14. The golf bag of claim 1, wherein the top cuff or collar comprises a heavy duty U-frame structure with opposing sidewalls and one or more struts or substructures extending between the opposing sidewalls.

15. The golf bag of claim 1, wherein the first leg or the second leg comprises a plurality of traction elements extending from a distal end of the first or second leg.

16. The golf bag of claim 15, wherein the plurality of traction elements include one or more directional traction elements and/or one or more omni-directional traction elements.

17. The golf bag of claim 1, wherein the first leg or the second leg comprises a hollow tubular construction to enhance a structural stiffness of the first or second leg.

18. The golf bag of claim 1, wherein the first leg or the second leg comprises one or more flanges or ridges extending along a length of the first or second leg to enhance a structural stiffness of the first or second leg.

19. The golf bag of claim 1, wherein a width or a thickness of the first leg or the second leg increases from a proximal end of the first or second leg to a midpoint on the first or second leg, and wherein the width or the thickness of the first or second leg decreases from the midpoint on the first or second leg to a distal end of the first or second leg.

* * * * *